US011365656B2

(12) United States Patent
Wormsbaker et al.

(10) Patent No.: US 11,365,656 B2
(45) Date of Patent: Jun. 21, 2022

(54) SYSTEMS, DEVICES, AND/OR METHODS FOR MANAGING MOTORCYCLE ENGINE COOLING

(71) Applicants: Curtis Wormsbaker, Kimberly, ID (US); Ken Gould, Filer, ID (US); Scott Wayment, Filer, ID (US)

(72) Inventors: Curtis Wormsbaker, Kimberly, ID (US); Ken Gould, Filer, ID (US); Scott Wayment, Filer, ID (US)

( * ) Notice: Subject to any disclaimer, the term of this patent is extended or adjusted under 35 U.S.C. 154(b) by 194 days.

(21) Appl. No.: 16/109,727

(22) Filed: Aug. 22, 2018

(65) Prior Publication Data

US 2019/0063280 A1 Feb. 28, 2019

Related U.S. Application Data

(60) Provisional application No. 62/548,496, filed on Aug. 22, 2017.

(51) Int. Cl.
*F01M 11/03* (2006.01)
*F01M 5/00* (2006.01)

(52) U.S. Cl.
CPC ..... *F01M 11/03* (2013.01); *F01M 5/002* (2013.01); *F01M 2005/004* (2013.01); *F01M 2011/033* (2013.01)

(58) Field of Classification Search
CPC .. F01M 11/03; F01M 5/002; F01M 2011/033; F01M 2005/004
See application file for complete search history.

(56) References Cited

U.S. PATENT DOCUMENTS 3,463,317 A * 8/1969 Prier ..... B01D 35/18 210/181
4,660,624 A * 4/1987 Yamaguchi ..... F28D 1/0471 165/41
4,662,470 A * 5/1987 Fujisawa ..... B60K 11/00 165/44
5,351,664 A * 10/1994 Rotter ..... B01D 35/18 123/196 AB
5,363,823 A * 11/1994 Gittlein ..... F01M 5/002 123/196 AB
5,653,206 A * 8/1997 Spurgin ..... B01D 35/18 123/196 AB
5,740,772 A * 4/1998 Bluma ..... F28F 1/20 210/186
5,746,170 A * 5/1998 Moriya ..... F01M 5/005 123/196 AB
5,901,808 A * 5/1999 Swenson ..... B62J 11/00 180/68.4
8,424,589 B2 * 4/2013 McMillan ..... F28D 1/024 165/41
8,911,620 B2 * 12/2014 Silegren ..... F01M 11/03 210/175

(Continued)

*Primary Examiner* — David Hamaoui
(74) *Attorney, Agent, or Firm* — Dale Jensen, PLC; Dale Jensen

(57) ABSTRACT

Certain exemplary embodiments can provide a system comprising an oil filter adapter constructed to be installed between an engine of a motorcycle and an oil filter of the motorcycle. The oil filter adapter defines an oil inlet aperture and an oil outlet aperture. The system comprises a heat exchanger, which defines an oil inlet port and an oil outlet port.

6 Claims, 88 Drawing Sheets

19000

(56) References Cited

U.S. PATENT DOCUMENTS

| | | | | |
|---|---|---|---|---|
| 2009/0038580 | A1* | 2/2009 | Hamilton | F28F 3/048<br>123/196 AB |
| 2012/0090811 | A1* | 4/2012 | Lemley | F28D 1/0333<br>165/51 |

* cited by examiner

4000

7000

8000

9000

10000

11000

12000

13000

14000

17000

19000

21000

22000

23000

24000

25000

26000

27000

28000

29000

31000

32000

33000

34000

35000

36000

37000

38000

39000

40000

41000

42000

43000

44000

46000

48000

49000

50000

51000

52000

53000

54000

56000

57000

58000

59000

60000

61000

62000

63000

64000

69000

70000

73000

74000

83000

86000

87000

88000

SYSTEMS, DEVICES, AND/OR METHODS FOR MANAGING MOTORCYCLE ENGINE COOLING

CROSS-REFERENCES TO RELATED APPLICATIONS

This application claims priority to, and incorporates by reference herein in its entirety, U.S. Provisional Patent Application Ser. No. 62/548,496, filed Aug. 22, 2017.

BRIEF DESCRIPTION OF THE DRAWINGS

FIGS. 66-88 are executed in color. Copies of this patent or patent application publication with color drawing(s) will be provided by the Office upon request and payment of the necessary fee. A wide variety of potential practical and useful embodiments will be more readily understood through the following detailed description of certain exemplary embodiments, with reference to the accompanying exemplary drawings in which:

FIG. 66 is a photograph of a perspective view of an exemplary embodiment of a heat exchanger 66000;

FIG. 67 is a photograph of a perspective view of an exemplary embodiment of a system 67000;

FIG. 68 is a photograph of a perspective view of an exemplary embodiment of a system 68000;

FIG. 69 is a photograph of a perspective view of an exemplary embodiment of a system 69000;

FIG. 70 is a photograph of a perspective view of an exemplary embodiment of a system 70000;

FIG. 71 is a photograph of a perspective view of an exemplary embodiment of a system 71000;

FIG. 72 is a photograph of a perspective view of an exemplary embodiment of a system 72000;

FIG. 73 is a photograph of a perspective view of an exemplary embodiment of a system 73000;

FIG. 74 is a photograph of a perspective view of an exemplary embodiment of a system 74000;

FIG. 75 is a photograph of a perspective view of an exemplary embodiment of a engine adapter plate 75000;

FIG. 76 is a photograph of a perspective view of an exemplary embodiment of a 90-degree oil filter adapter 76000;

FIG. 77 is a photograph of a perspective view of an exemplary embodiment of a 90-degree oil filter adapter 77000;

FIG. 78 is a photograph of a perspective view of an exemplary embodiment of a 90-degree oil filter adapter 78000;

FIG. 79 is a photograph of a perspective view of an exemplary embodiment of a heat exchanger 79000;

FIG. 80 is a photograph of a perspective view of an exemplary embodiment of a heat exchanger 80000;

FIG. 81 is a photograph of a perspective view of an exemplary embodiment of a heat exchanger 81000;

FIG. 82 is a photograph of a perspective view of an exemplary embodiment of a heat exchanger 82000;

FIG. 83 is a photograph of a perspective view of an exemplary embodiment of a system 83000;

FIG. 84 is a photograph of a perspective view of an exemplary embodiment of a system 84000;

FIG. 85 is a photograph of a perspective view of an exemplary embodiment of a engine adapter plate 85000;

FIG. 86 is a photograph of a perspective view of an exemplary embodiment of a system 86000;

FIG. 87 is a photograph of a perspective view of an exemplary embodiment of a system 87000;

FIG. 88 is a photograph of a perspective view of an exemplary embodiment of a system 88000.

DETAILED DESCRIPTION

Certain exemplary embodiments can provide a system comprising an oil filter adapter constructed to be installed between an engine of a motorcycle and an oil filter of the motorcycle. The oil filter adapter defines an oil inlet aperture and an oil outlet aperture. The system comprises a heat exchanger, which defines an oil inlet port and an oil outlet port.

Certain exemplary embodiments provide a system constructed to allow motorcycles to operate at a lower temperature and, thereby, improve engine life of the motorcycle. The system comprises a heat exchanger that receives engine oil from the motorcycle and causes heat to be transferred from the oil to surrounding air and, thereby, reducing the temperature of the oil.

Figure 1:
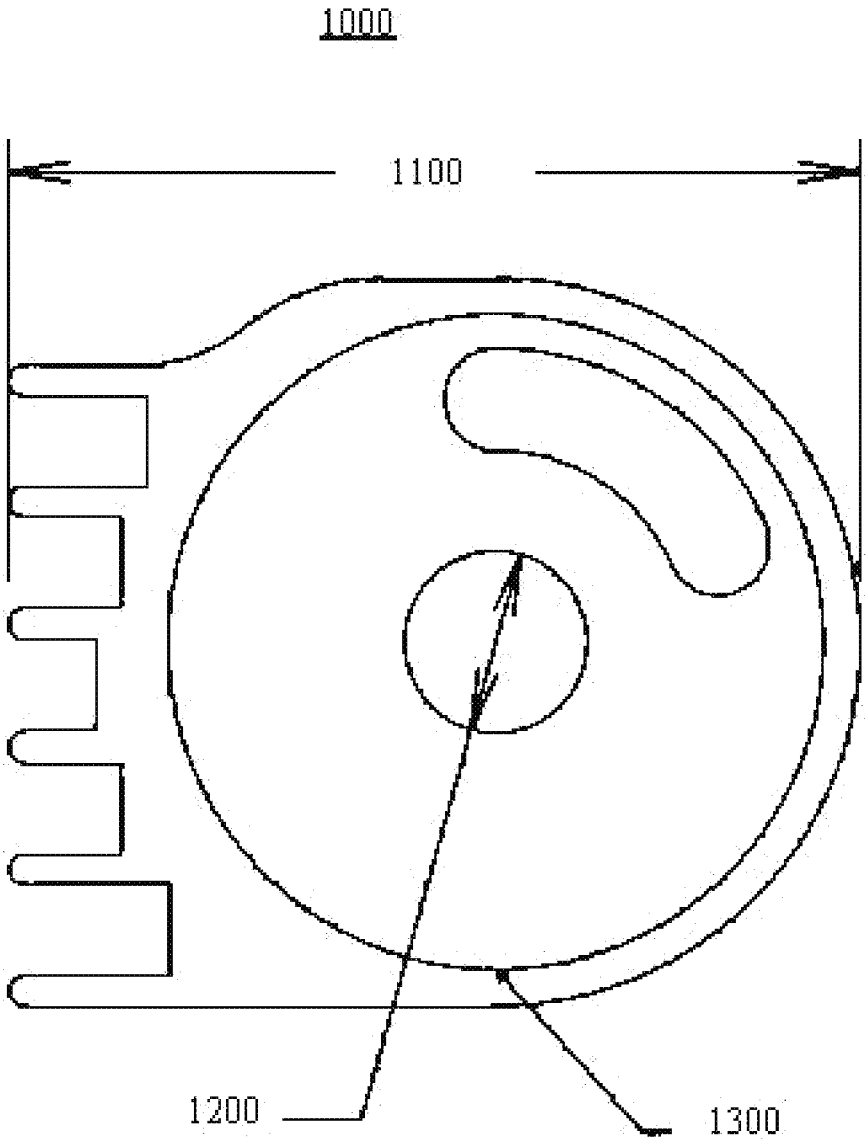
FIG. 1 is a plan view of an exemplary embodiment of an engine adapter plate 1000.

FIG. 1 is a plan view of an exemplary embodiment of an engine adapter plate 1000, which is characterized by a width 1100, an aperture diameter 1200, and an O-ring 1300. Width 1100 and/or a first aperture diameter 1200 can be any dimensions appropriate for a particular motorcycle heat exchanger. For example, in certain exemplary embodiments:

width 1100 can be approximately 3.506 inches; and/or first aperture diameter 1200 can be approximately 0.750 inches.

Figure 2:
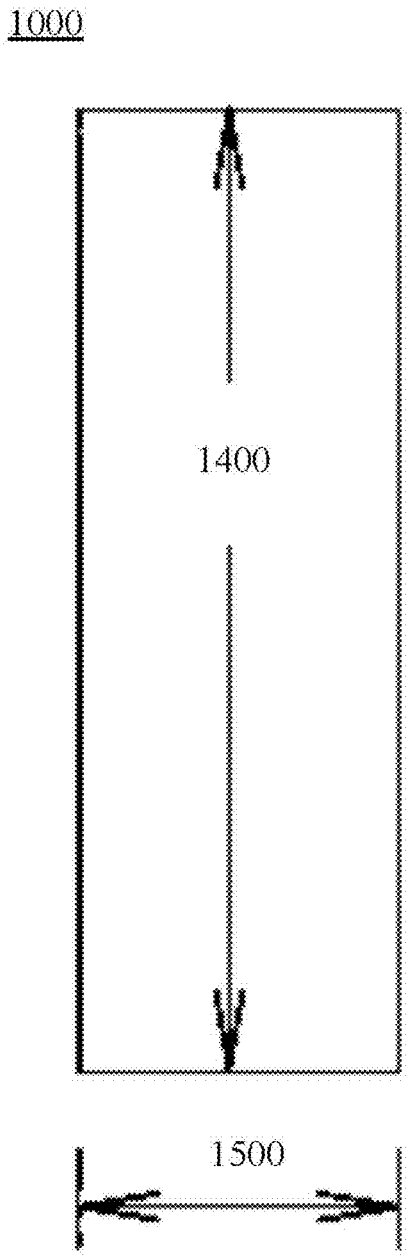
FIG. 2 is a side view of exemplary engine adapter plate 1000.

FIG. 2 is a side view of exemplary engine adapter plate 1000, which illustrates a height 1400 and a thickness 1500. Height 1400 and/or aperture thickness 1500 can be any dimensions appropriate for a particular motorcycle heat exchanger. For example, in certain exemplary embodiments:

height 1400 can be approximately 3.000 inches; and/or thickness 1500 can be approximately 1.000 inches.

Figure 3:
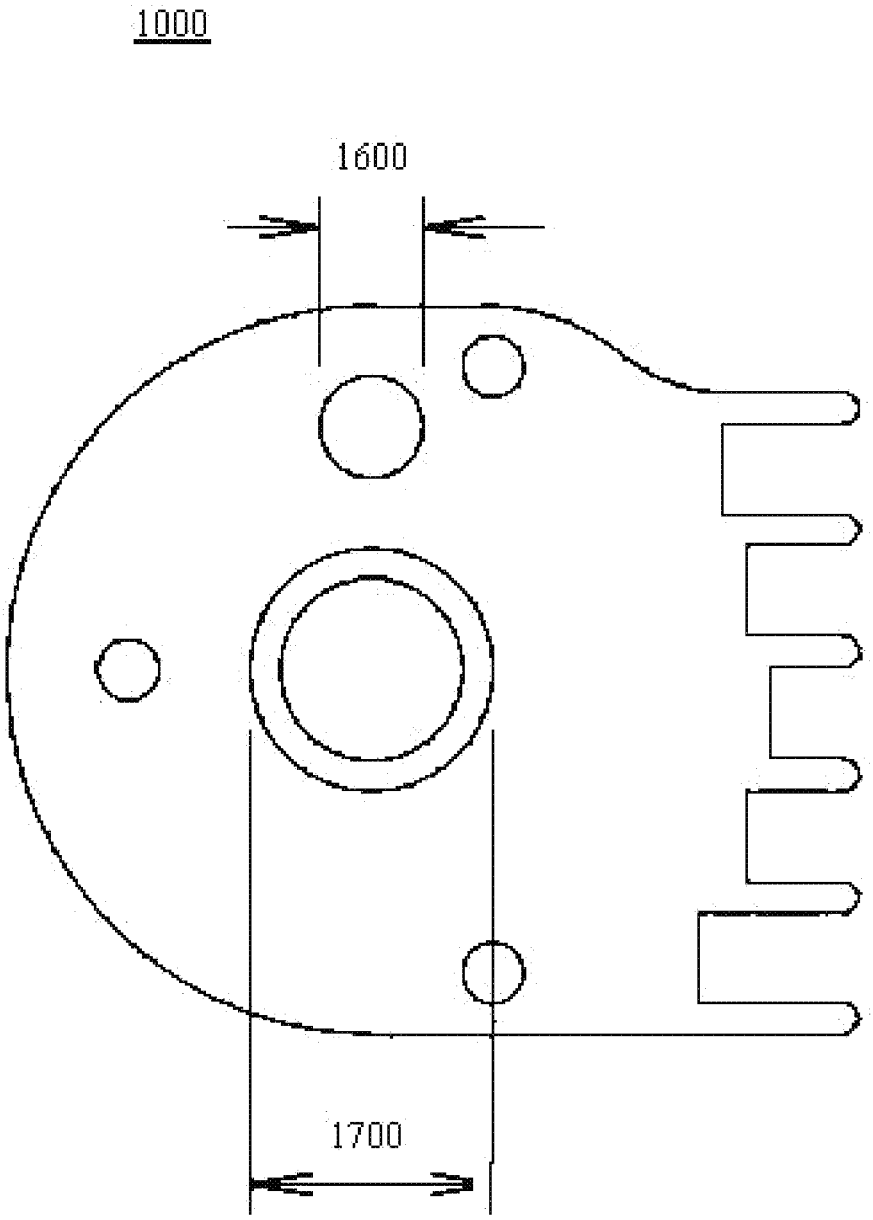
FIG. 3 is a bottom view of exemplary engine adapter plate 1000.

FIG. 3 is a bottom view of exemplary engine adapter plate 1000, which illustrates a second aperture diameter 1600 and an aperture recess diameter 1700. Aperture diameter 1600 and/or aperture recess diameter 1700 can be any dimensions appropriate for a particular motorcycle heat exchanger. For example, in certain exemplary embodiments:

second aperture diameter 1600 can be approximately 0.422 inches; and/or aperture recess diameter 1700 can be approximately 1.000 inches.

Figure 4:
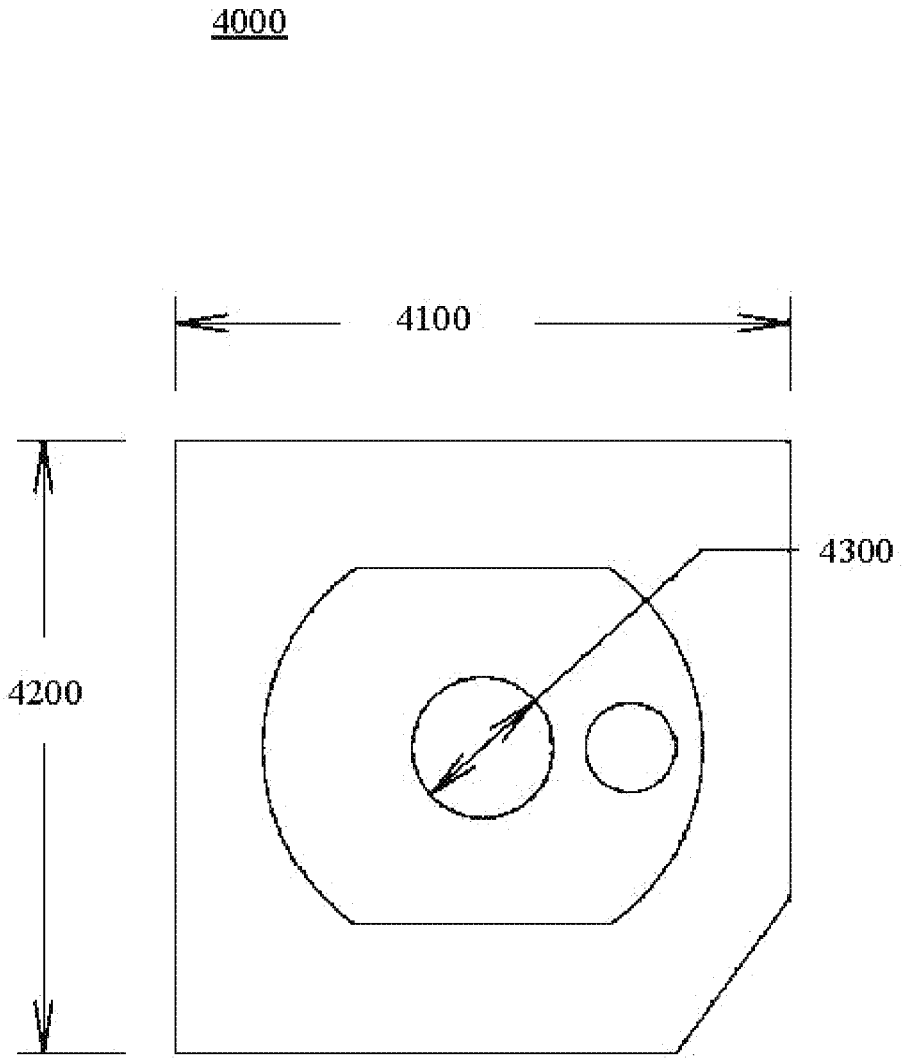
FIG. 4 is a plan view of an exemplary embodiment of a 90-degree oil filter adapter 4000.

FIG. 4 is a plan view of an exemplary embodiment of a 90-degree oil filter adapter 4000, which is characterized by a width 4100, a height 4200, and an aperture diameter 4300. Width 4100, height 4200, and/or aperture diameter 4300 can be any dimensions appropriate for a particular motorcycle heat exchanger. For example, in certain exemplary embodiments:

width 4100 can be approximately 3.000 inches;

width 4200 can be approximately 3.000 inches and/or aperture diameter 4300 can be approximately 0.687 inches.

Figure 5:
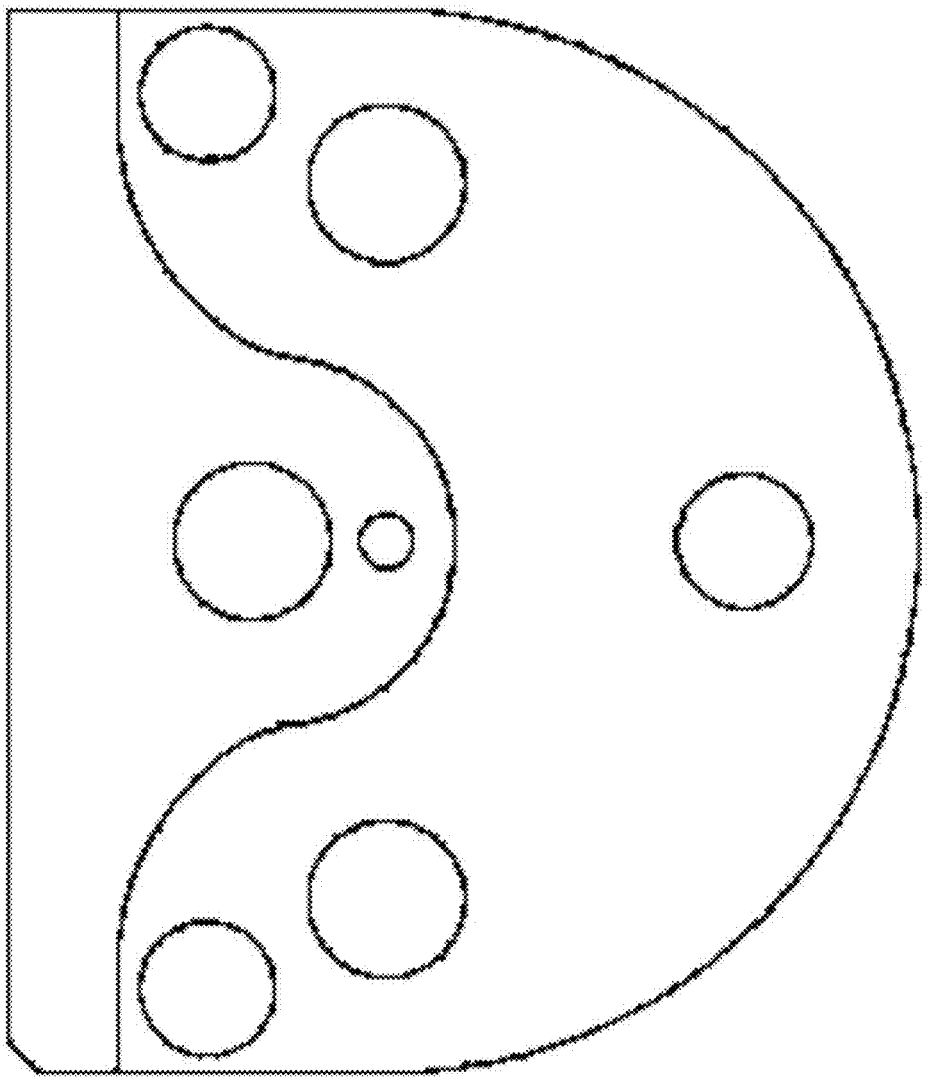
FIG. 5 is a side view of exemplary 90-degree oil filter adapter 4000.

FIG. 5 is a side view of exemplary 90-degree oil filter adapter 4000.

Figure 6:
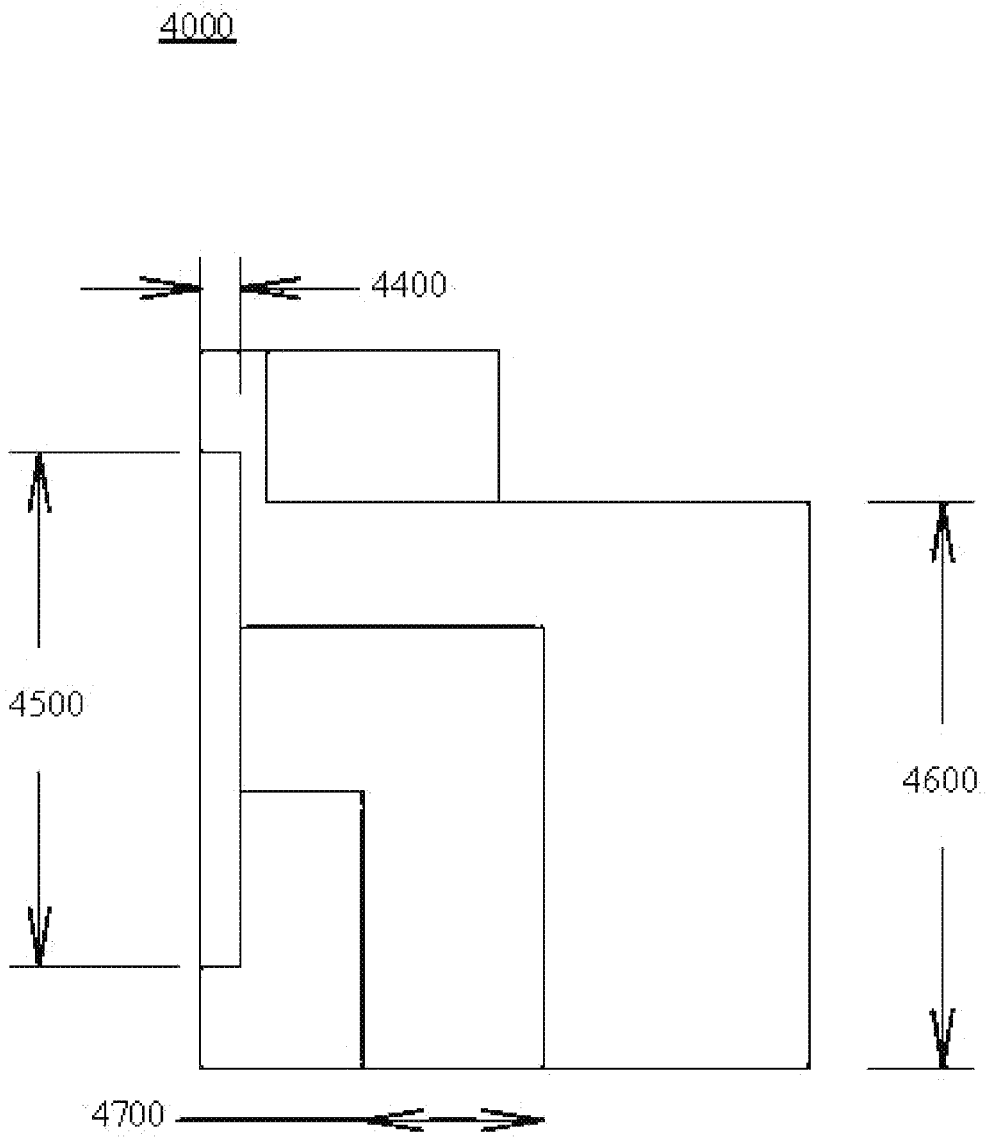
FIG. 6 is a side view of exemplary 90-degree oil filter adapter 4000.

FIG. 6 is a side view of exemplary 90-degree oil filter adapter 4000, which is characterized by dimensions 4400, 4500, 4600, and 4700. Dimensions 4400, 4500, 4600, and 4700 can be any dimensions appropriate for a particular motorcycle heat exchanger. For example, in certain exemplary embodiments:

dimension 4400 can be approximately 0.160 inches;

dimension 4500 can be approximately 2.150 inches;

dimension 4600 can be approximately 2.370 inches; and/or dimension 4700 can be approximately 0.750 inches.

Figure 7:
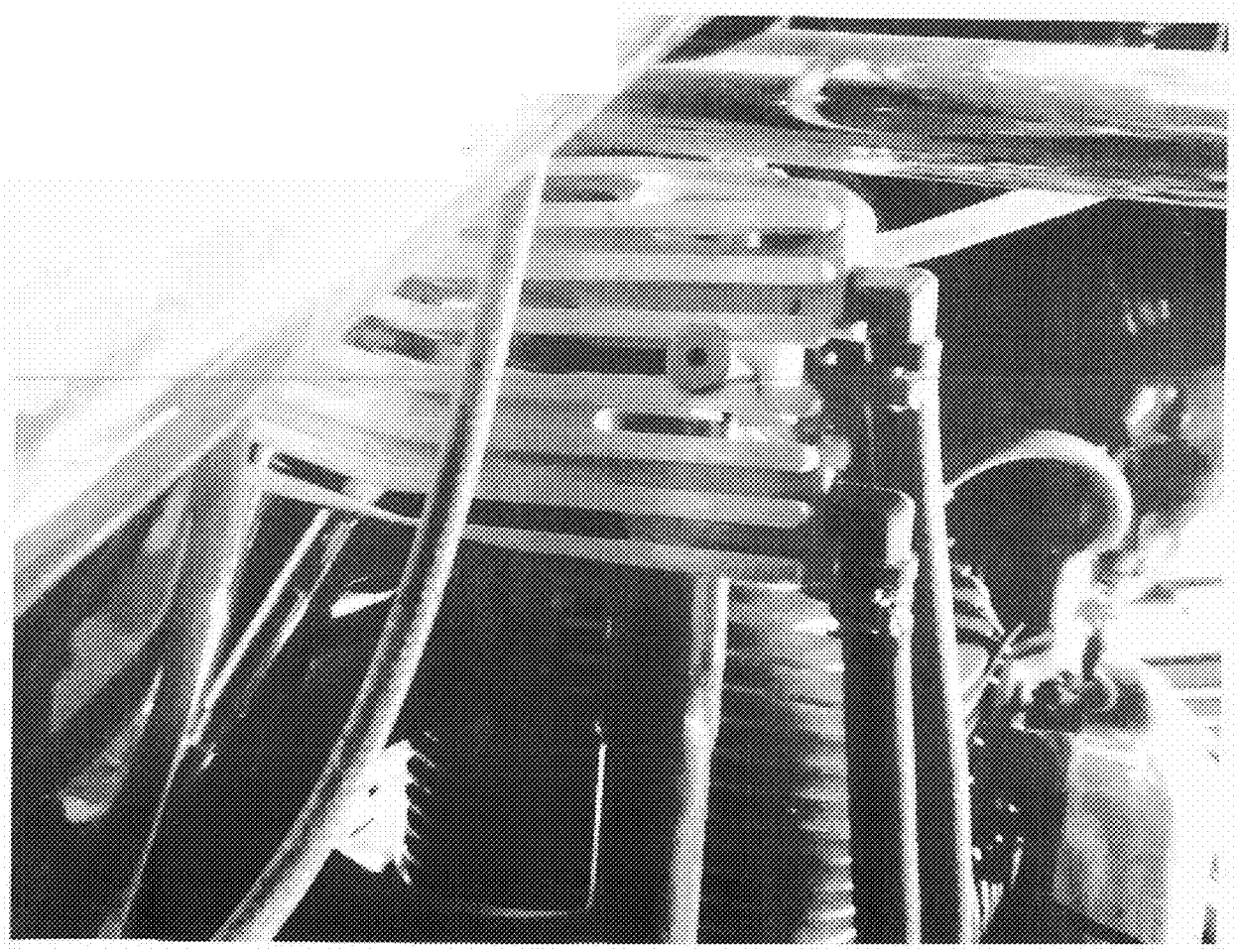
FIG. 7 is a photograph of a perspective view of an exemplary embodiment of a system 7000.

FIG. 7 is a photograph of a perspective view of an exemplary embodiment of a system 7000. System 7000 illustrates a heat exchanger mounted to a motorcycle frame and oil lines connected from 90-degree oil filter adapter.

Figure 8:
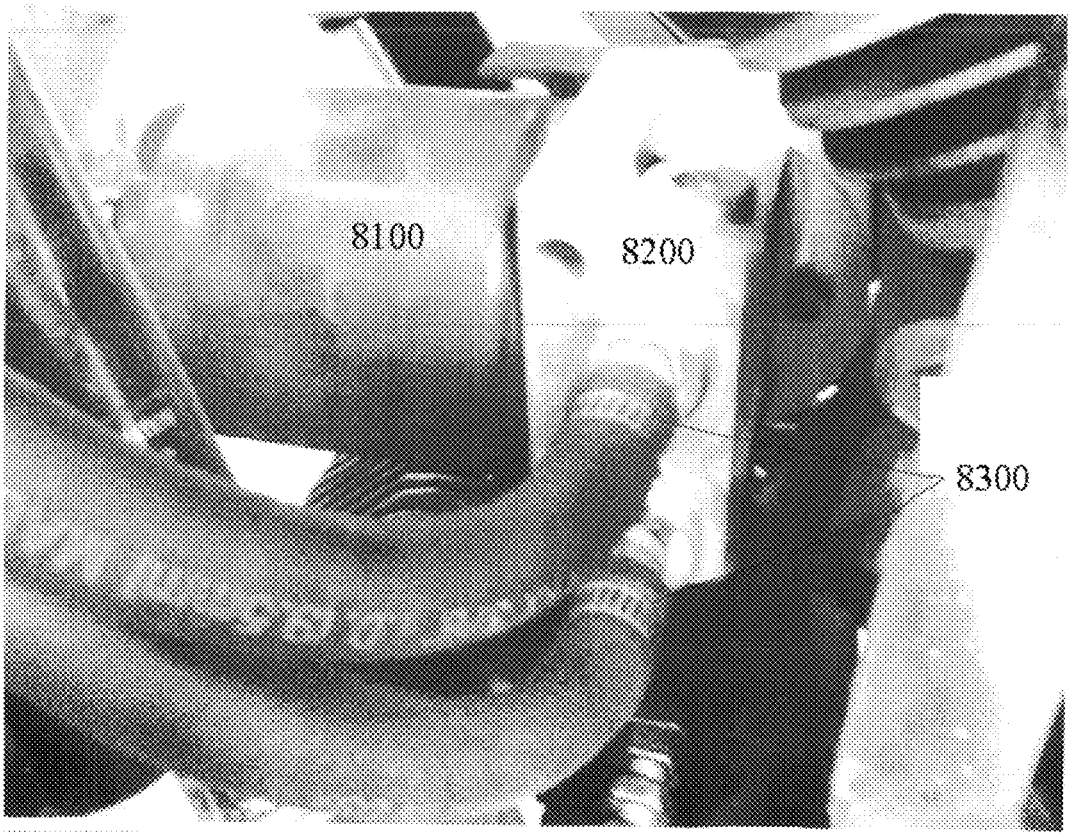
FIG. 8 is a photograph of a perspective view of an exemplary embodiment of a system 8000.

FIG. 8 is a photograph of a perspective view of an exemplary embodiment of a system 8000, which comprises an oil filter 8100 mounted to an exemplary 90-degree oil filter adapter 8200. Pair of oil lines 8300 are each coupled to the heat exchanger and cycle oil through both 90-degree oil filter adapter 8200 and oil filter 8100.

Figure 9:
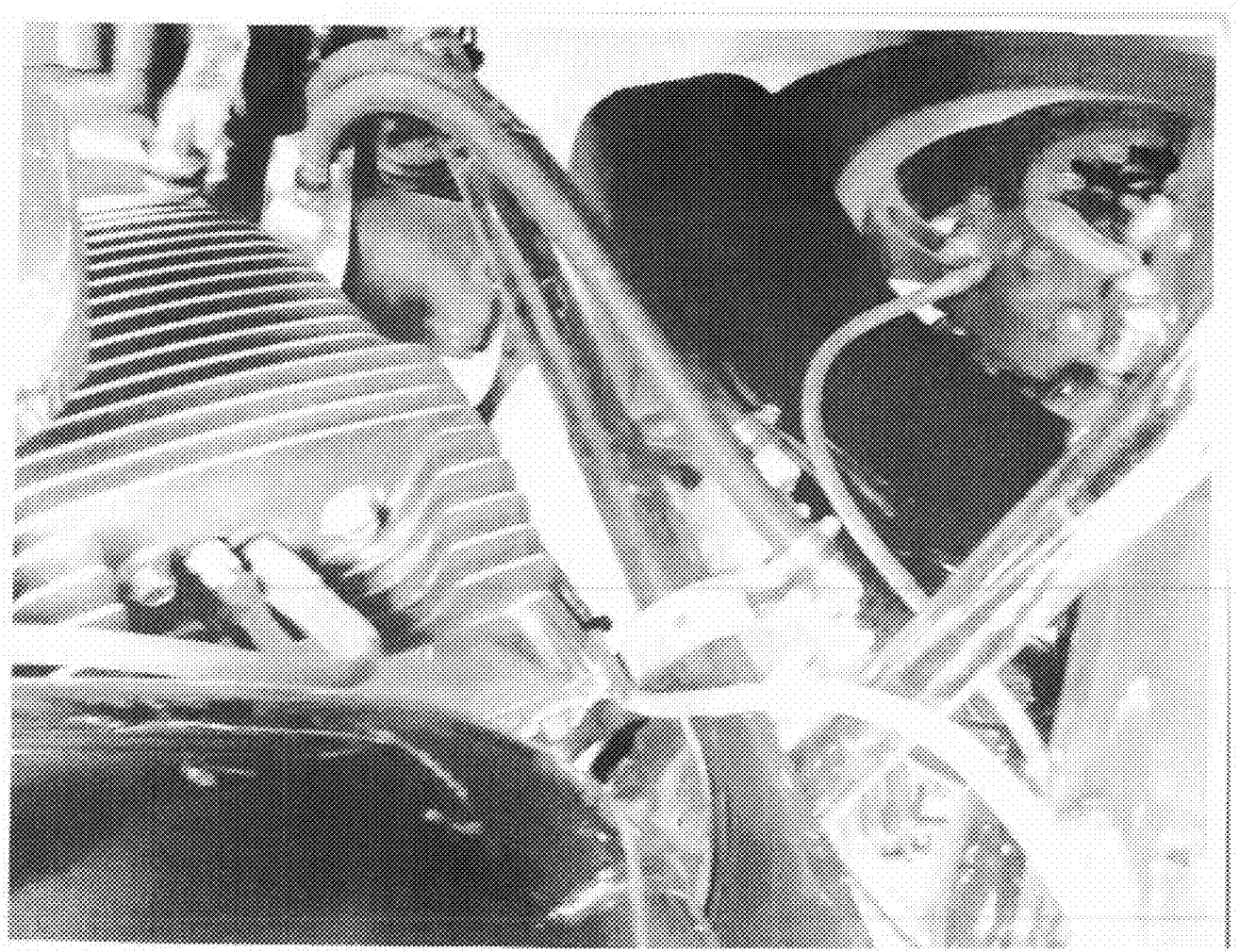
FIG. 9 is a photograph of a perspective view of an exemplary embodiment of a system 9000.
Figure 10:
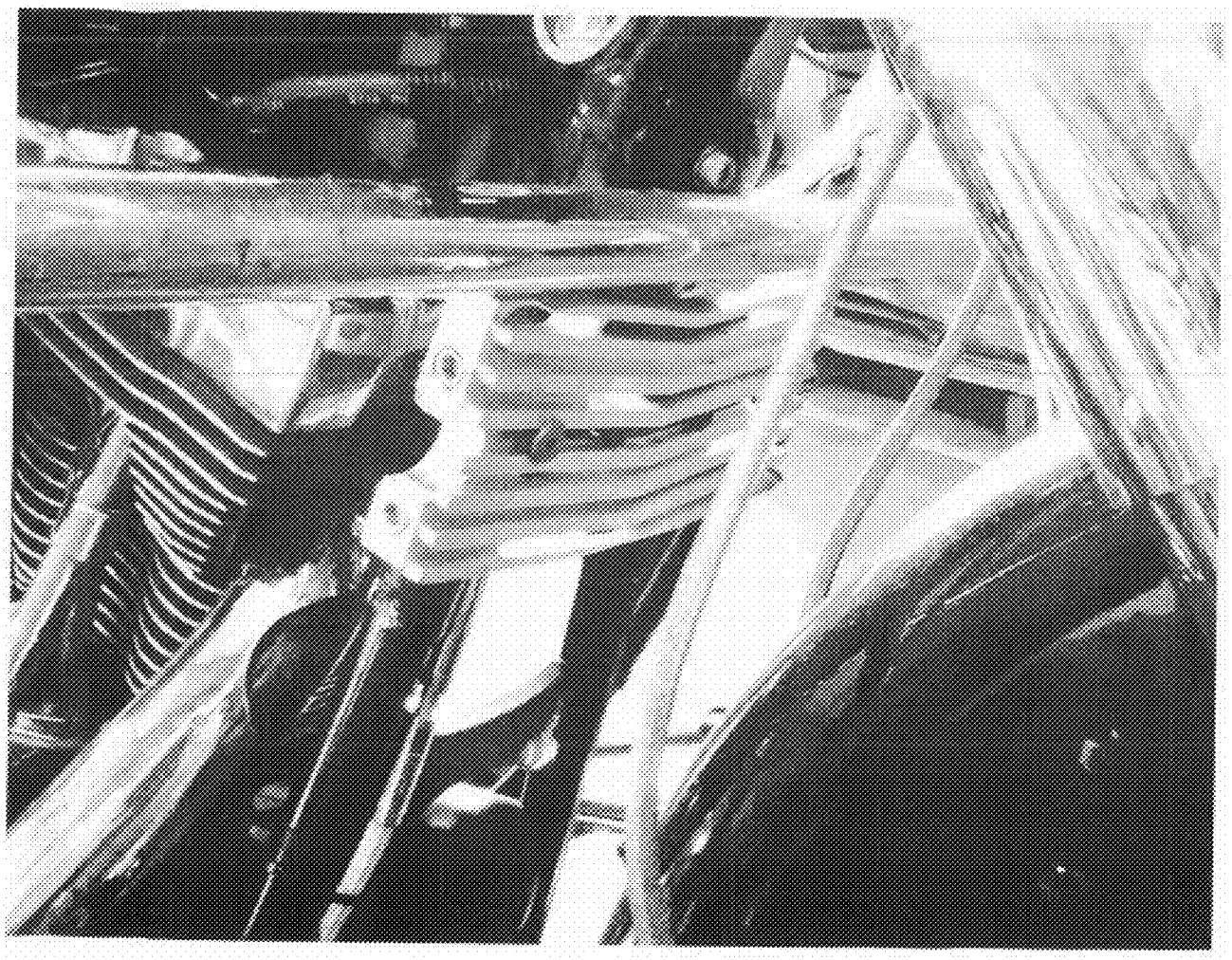
FIG. 10 is a photograph of a perspective view of an exemplary embodiment of a system 10000.
Figure 11:
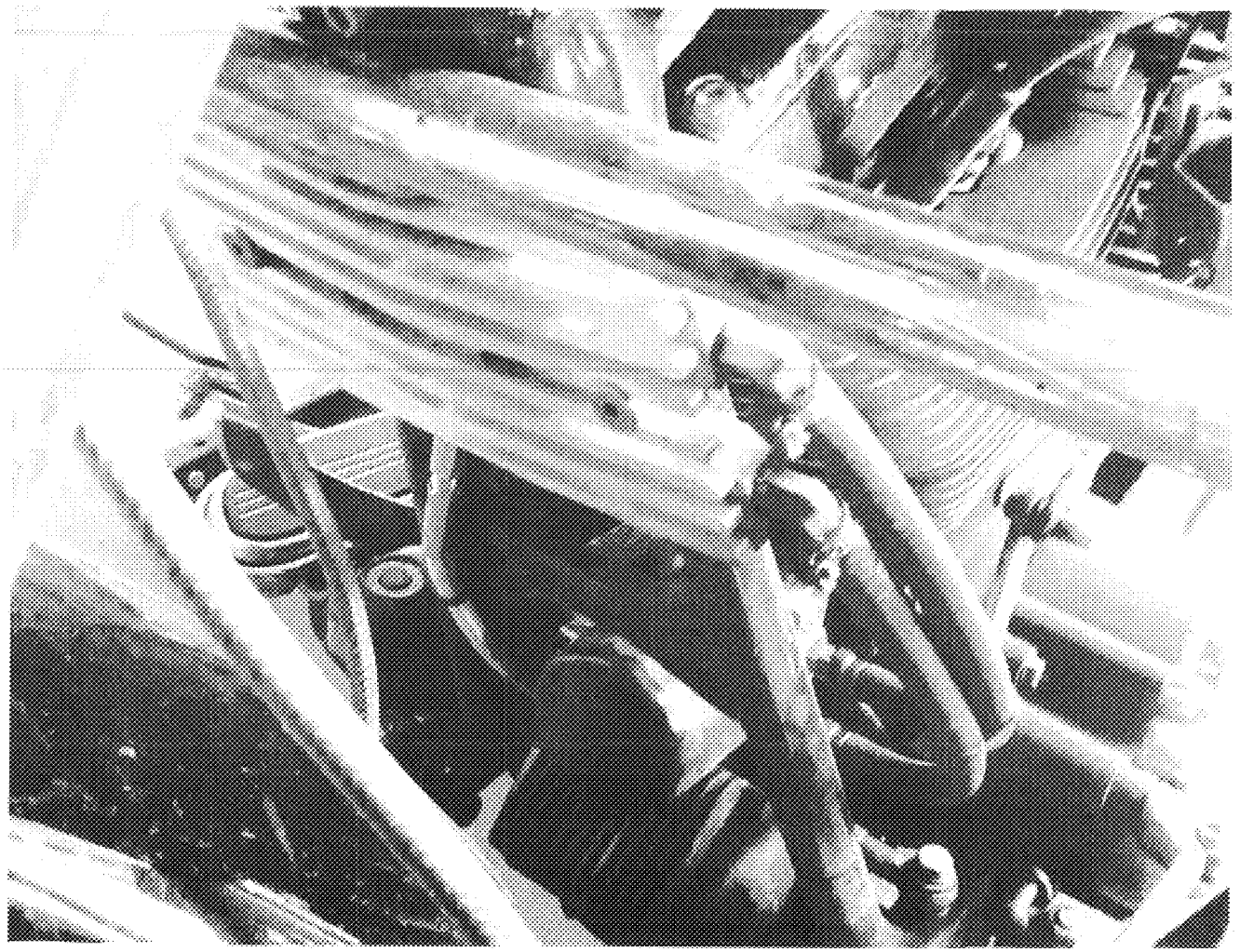
FIG. 11 is a photograph of a perspective view of an exemplary embodiment of a system 11000.
Figure 12:
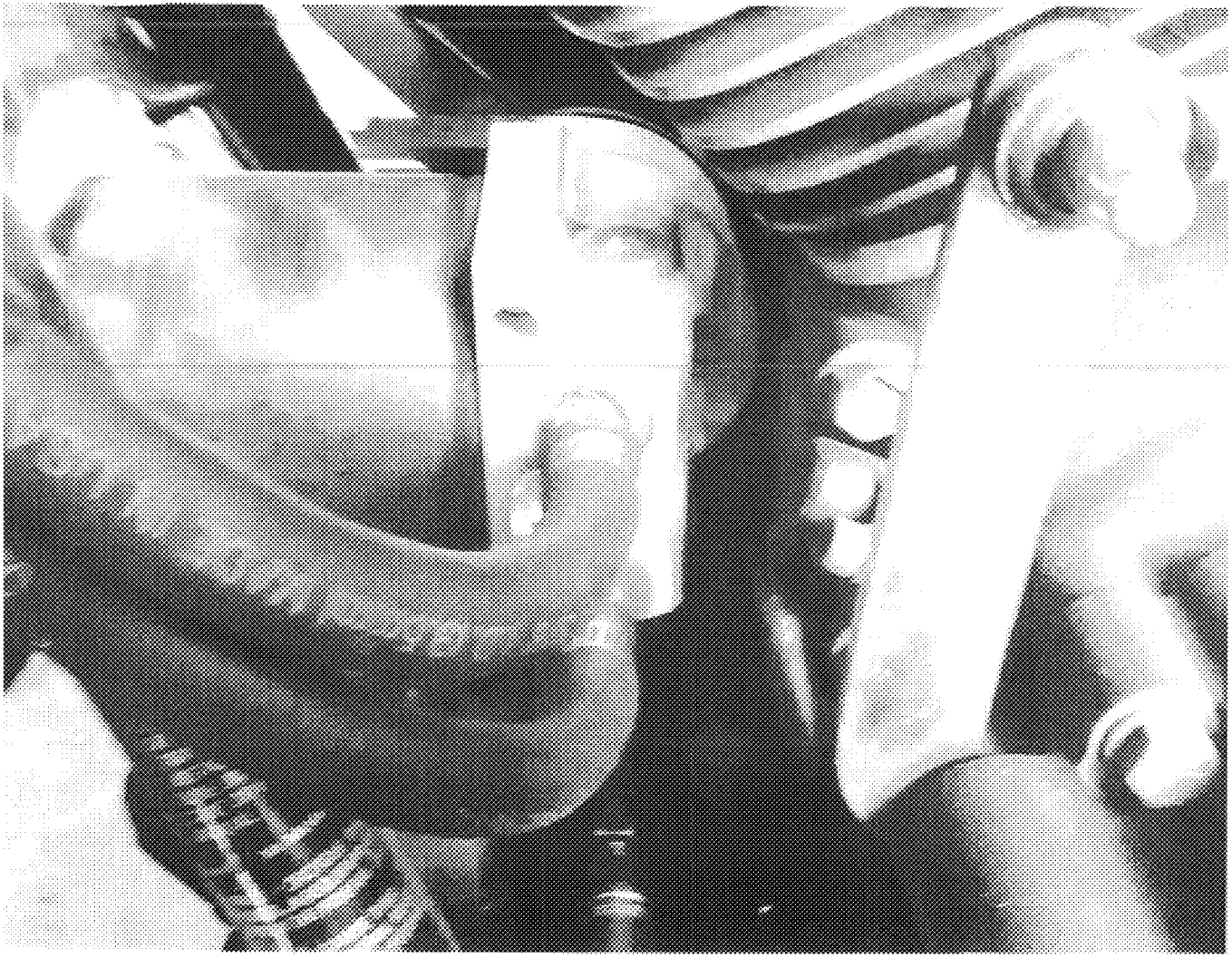
FIG. 12 is a photograph of a perspective view of an exemplary embodiment of a system 12000.
Figure 13:
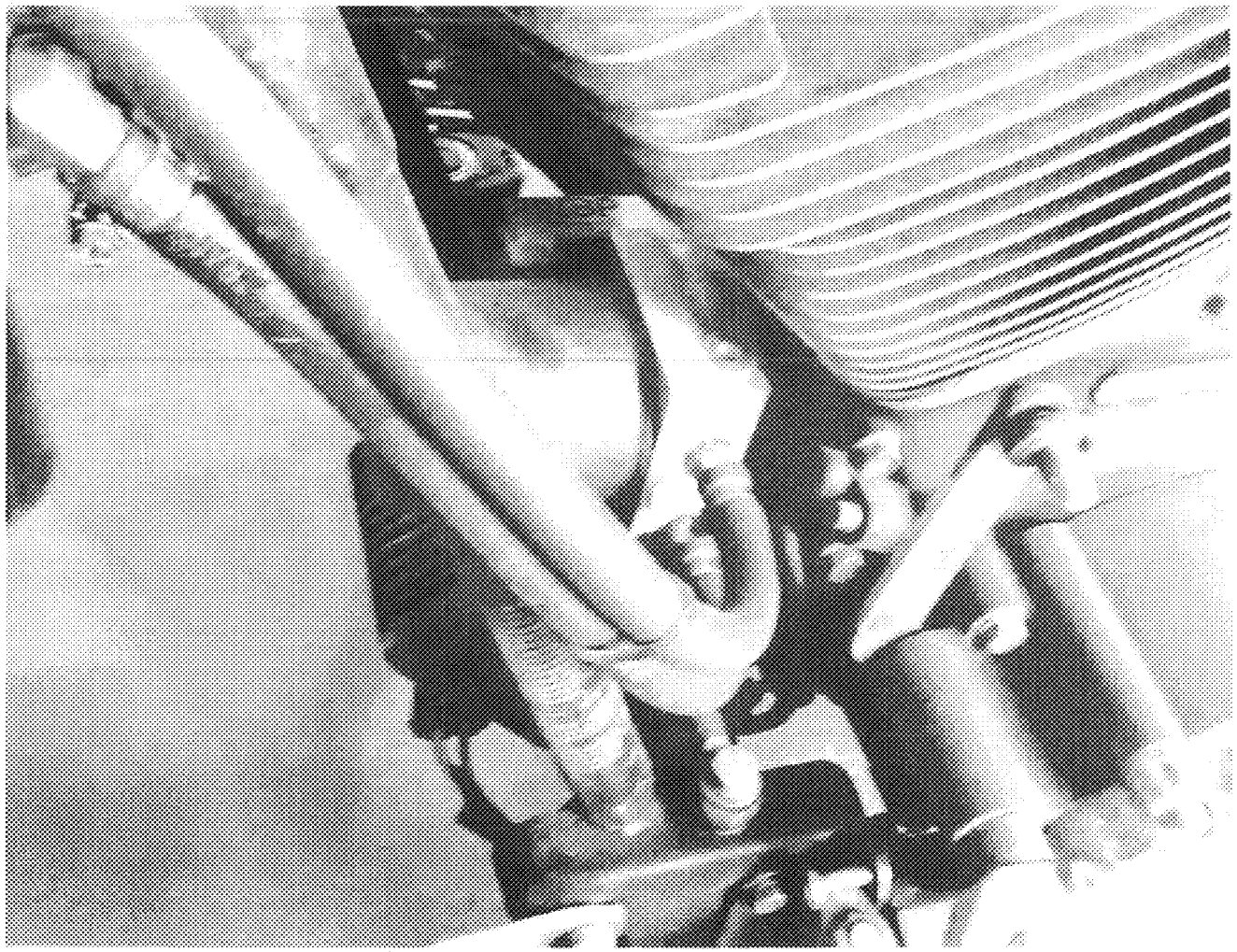
FIG. 13 is a photograph of a perspective view of an exemplary embodiment of a system 13000.
Figure 14:
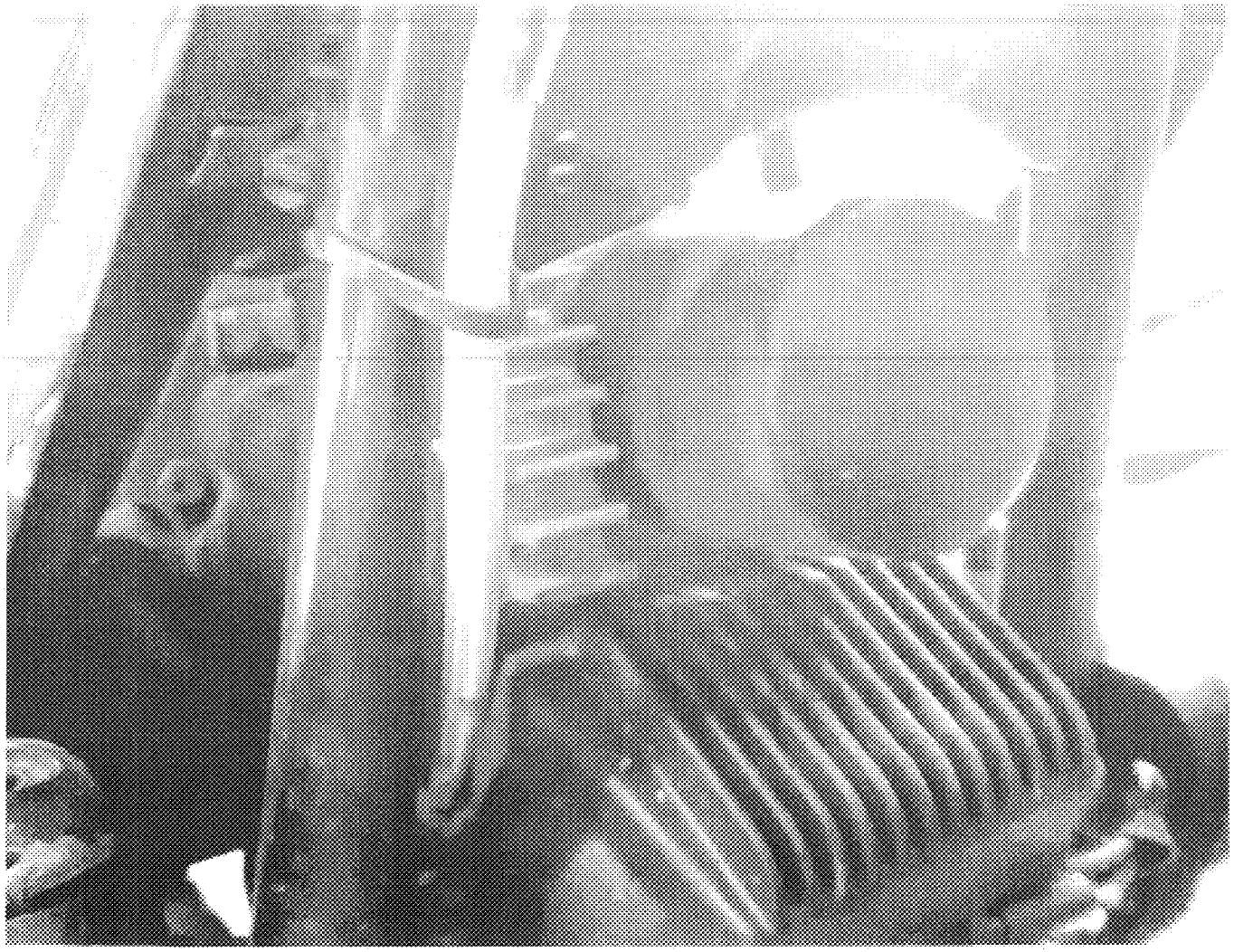
FIG. 14 is a photograph of a perspective view of an exemplary embodiment of a system 14000.

FIG. 9 is a photograph of a perspective view of an exemplary embodiment of a system 9000. FIG. 10 is a photograph of a perspective view of an exemplary embodiment of a system 10000. FIG. 11 is a photograph of a perspective view of an exemplary embodiment of a system 11000. FIG. 12 is a photograph of a perspective view of an exemplary embodiment of a system 12000. FIG. 13 is a photograph of a perspective view of an exemplary embodiment of a system 13000. FIG. 14 is a photograph of a perspective view of an exemplary embodiment of a system 14000.

Figure 15:
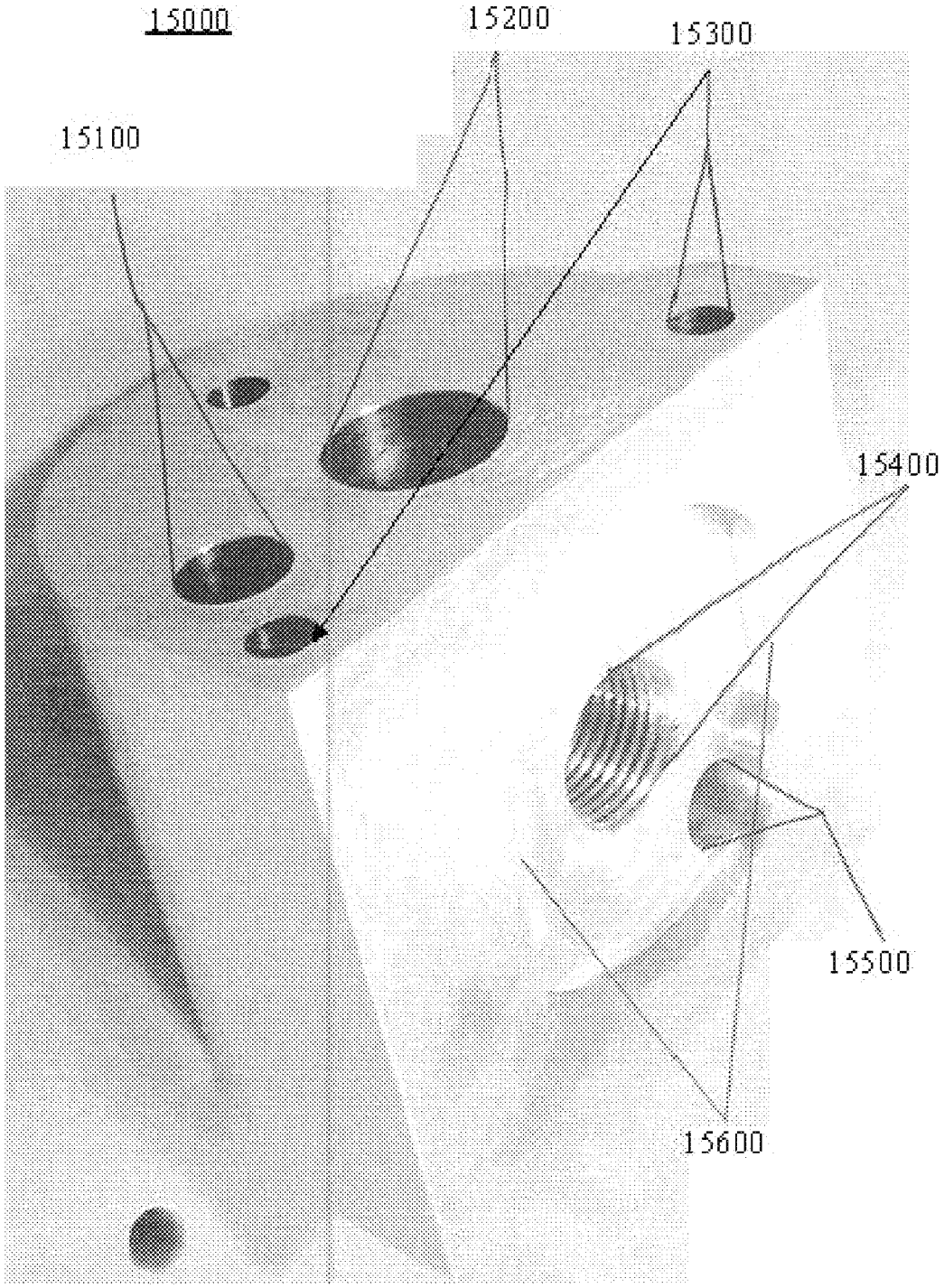
FIG. 15 is a photograph of a perspective view of an exemplary embodiment of an oil filter adapter 15000.

FIG. 15 is a photograph of a perspective view of an exemplary embodiment of an oil filter adapter 15000, which defines a first aperture 15100, a second aperture 15200, a pair of third apertures 15300, a fourth aperture 15400, a fifth aperture 15500, and a sixth aperture 15600. First aperture 15100 is constructed to be an oil pressure channel from an engine of a motorcycle. Second aperture 15200 is constructed to be a return oil channel from an oil filter to the engine of the motorcycle. Each of pair of third apertures 15300 is constructed to receive fasteners to couple oil filter adapter 15000 to an engine adapter plate of the motorcycle (e.g., drilled and tapped for nominal ¼ inch hex screws with 20 thread per inch threads). Fourth aperture 15400 is constructed to be a return channel from the oil filter and can be threaded for a double tap bushing to mount to the oil filter. Fifth aperture 15500 is constructed to be a return oil channel from the heat exchanger or a thermostat routing chamber depending upon oil temperature. Sixth aperture 15600 is constructed to be an inlet bath to the oil filter.

Figure 16:
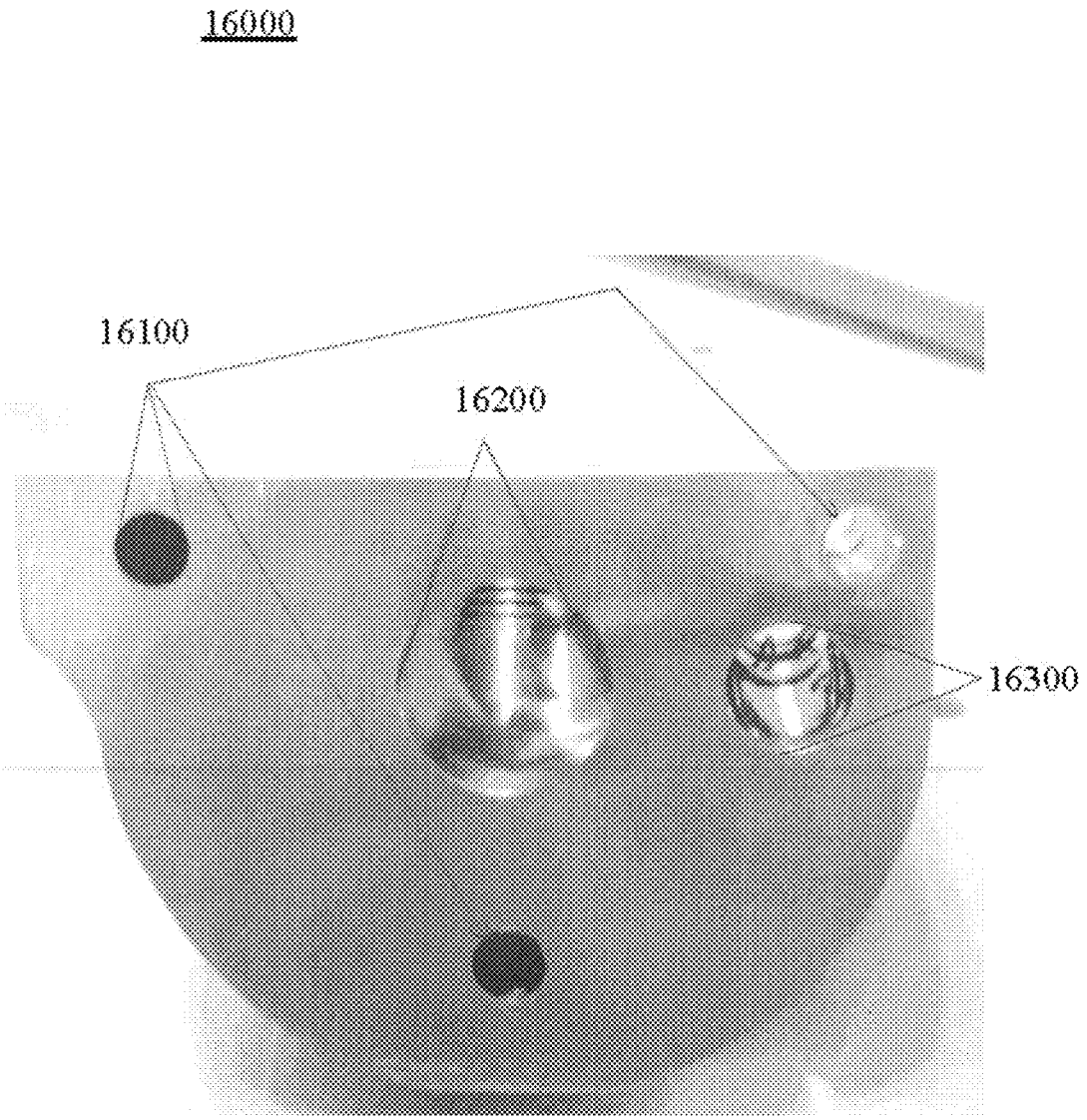
FIG. 16 is a photograph of a perspective view of an exemplary embodiment of an oil filter adapter 16000.
Figure 19:
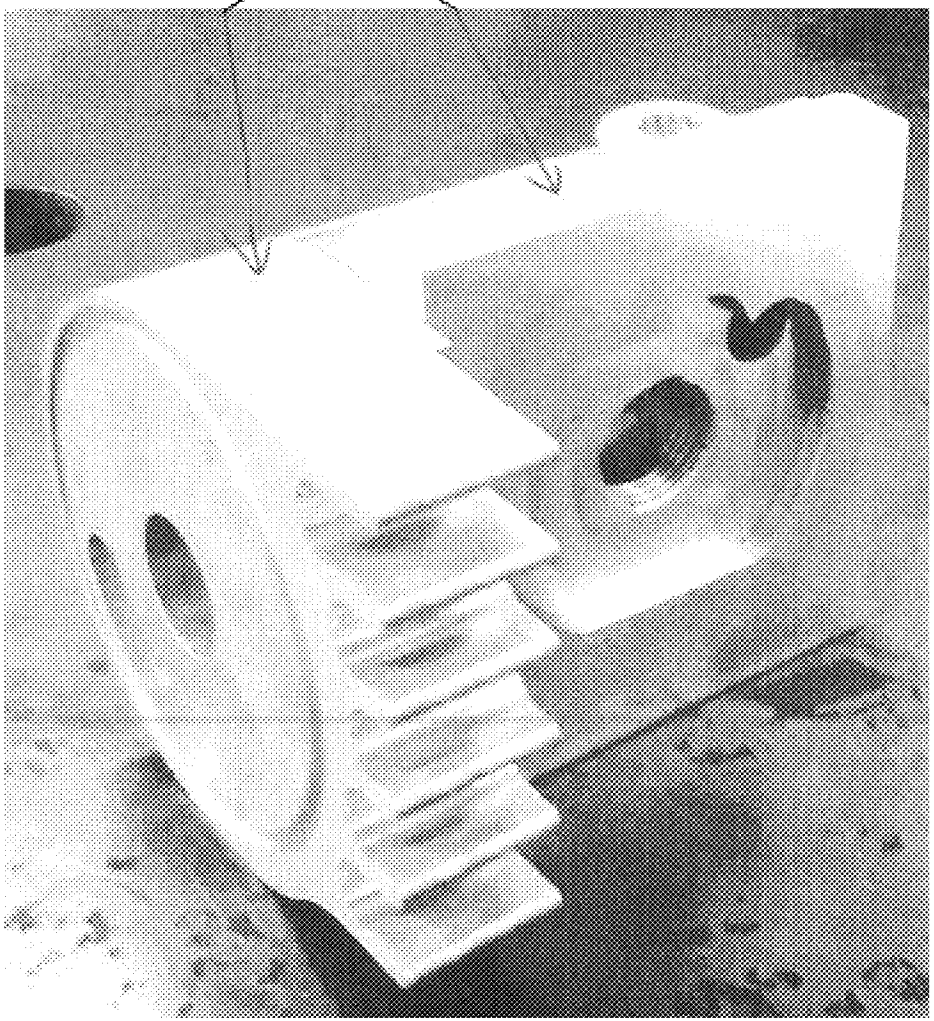
FIG. 19 is a photograph of a perspective view of an exemplary embodiment of an engine adapter plate 19000.

FIG. 16 is a photograph of a perspective view of an exemplary embodiment of an oil filter adapter 16000, which defines a first set of apertures 16100, a second aperture 16200, and a third aperture 16300. Each of first set of apertures 16100 is constructed to mount oil filter adapter 16000 to an engine of a motorcycle (e.g., drilled to approximately 0.250 inches) via an engine adapter plate as illustrated in FIG. 19. Second aperture 16200 is constructed to be a return channel from an oil filter to the engine of the motorcycle. In certain exemplary embodiments, second aperture 16200 is drilled and tapped to a nominal 0.750-inch size. Third aperture 16300 is constructed to be an oil pressure channel. In certain exemplary embodiments, third aperture 16300 can be approximately 0.422 inches.

Figure 17:
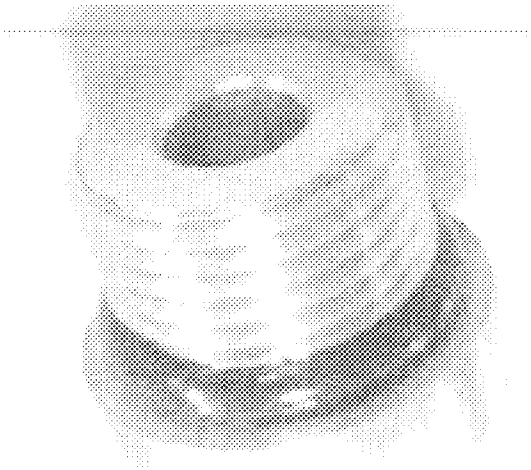
FIG. 17 is a photograph of a perspective view of an exemplary embodiment of a threaded plug 17000.
Figure 18:
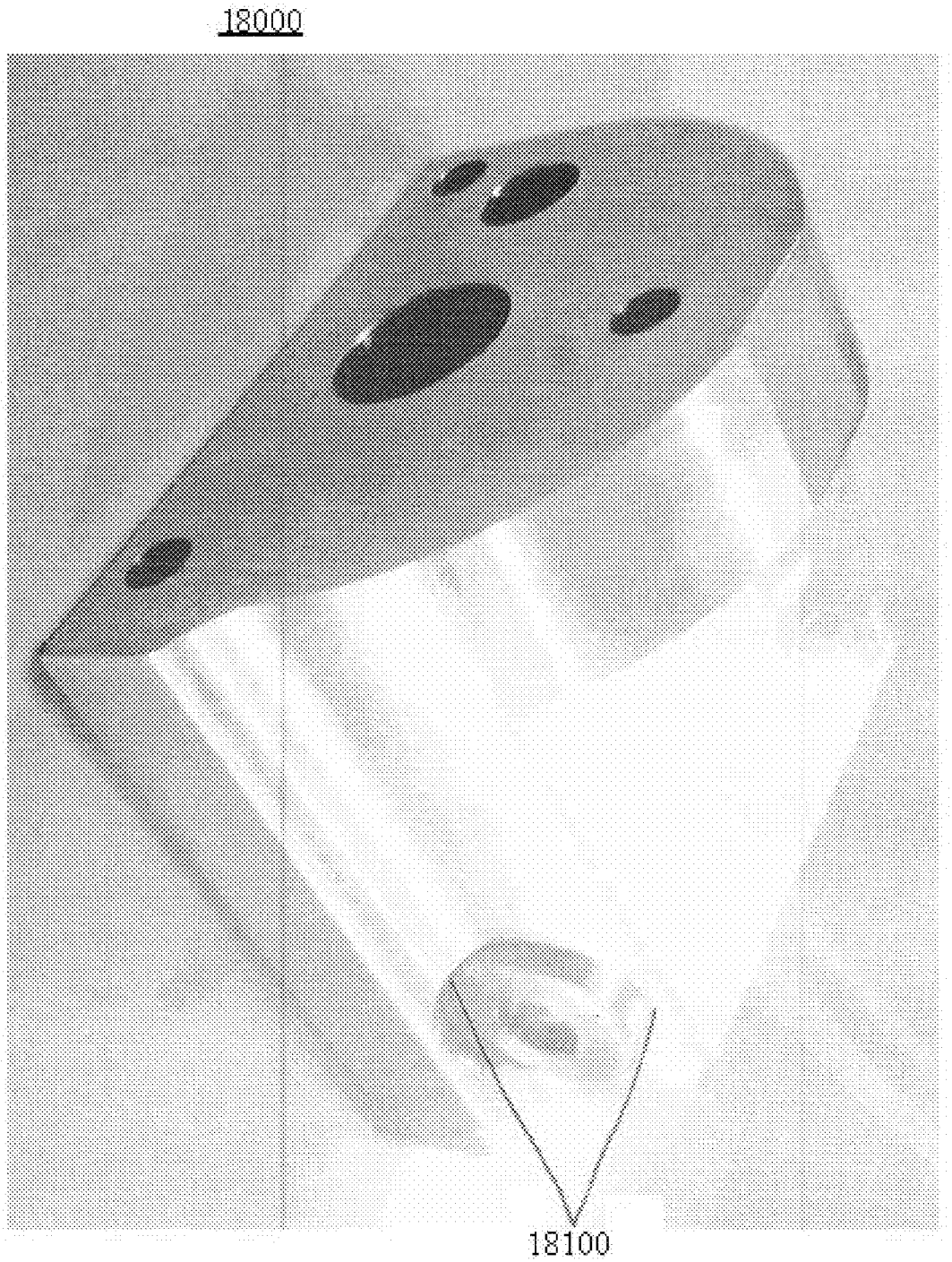
FIG. 18 is a photograph of a perspective view of an exemplary embodiment of an oil filter adapter 18000.

FIG. 17 is a photograph of a perspective view of an exemplary embodiment of a threaded plug 17000. Threaded plug 17000 is a thermostat plug with a guide hole and O-ring seal. FIG. 18 is a photograph of a perspective view of an exemplary embodiment of an oil filter adapter 18000, which illustrates a threaded plug 18100 with an internal guide hole installed in oil filter adapter 18000.

Figure 20:
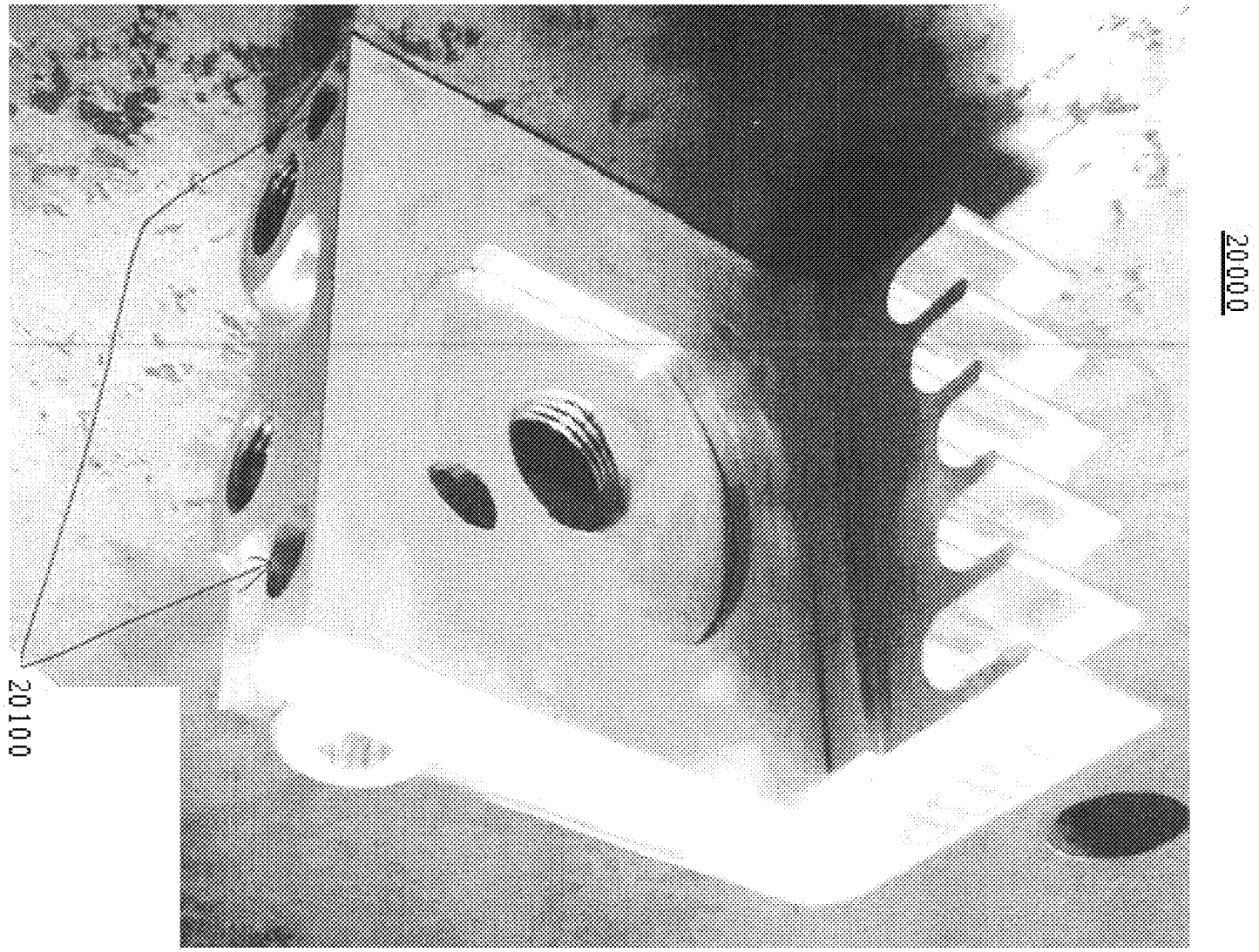
FIG. 20 is a photograph of a perspective view of an exemplary embodiment of a 90-degree oil filter adapter 20000 bolted to engine adapter plate.
Figure 21:
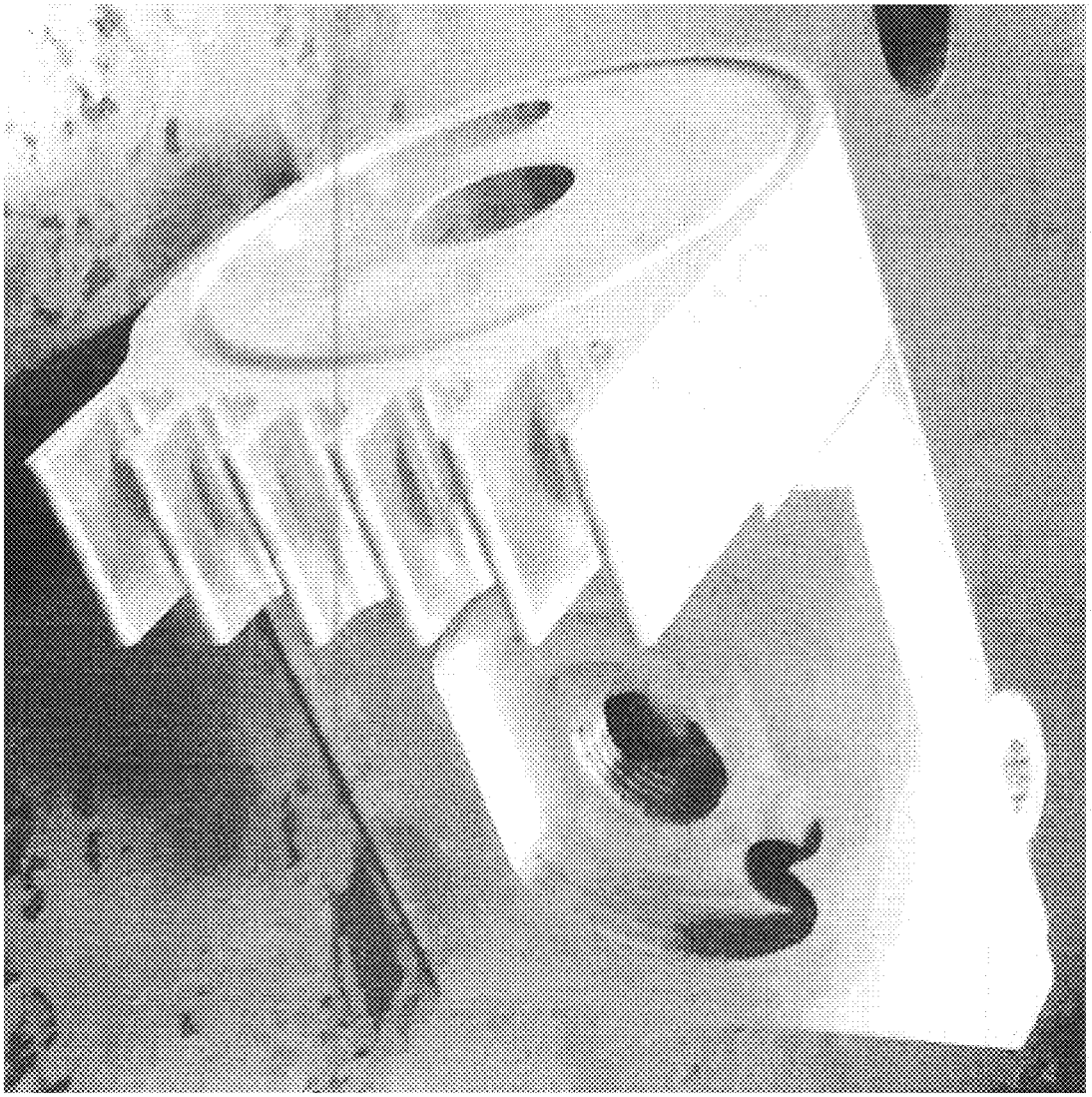
FIG. 21 is a photograph of a perspective view of an exemplary embodiment of a 90-degree oil filter adapter 21000.

FIG. 19 is a photograph of a perspective view of an exemplary embodiment of a engine adapter plate 19000, which is a 90-degree oil filter adapter. Engine adapter plate 19000 mounts to an engine of the motorcycle. FIG. 20 is a photograph of a perspective view of an exemplary embodiment of a 90-degree oil filter adapter 20000 bolted to engine adapter plate, which defines a plurality of apertures 20100 constructed to couple 90-degree oil filter adapter 20000 to an adapter plate via mounting channels. In certain exemplary embodiments, plurality of apertures 20100 can be nominal ¼ inch apertures with 20 threads per inch threads. FIG. 21 is a photograph of a perspective view of an exemplary embodiment of a 90-degree oil filter adapter 21000 mounted to an engine adapter plate.

Figure 22:
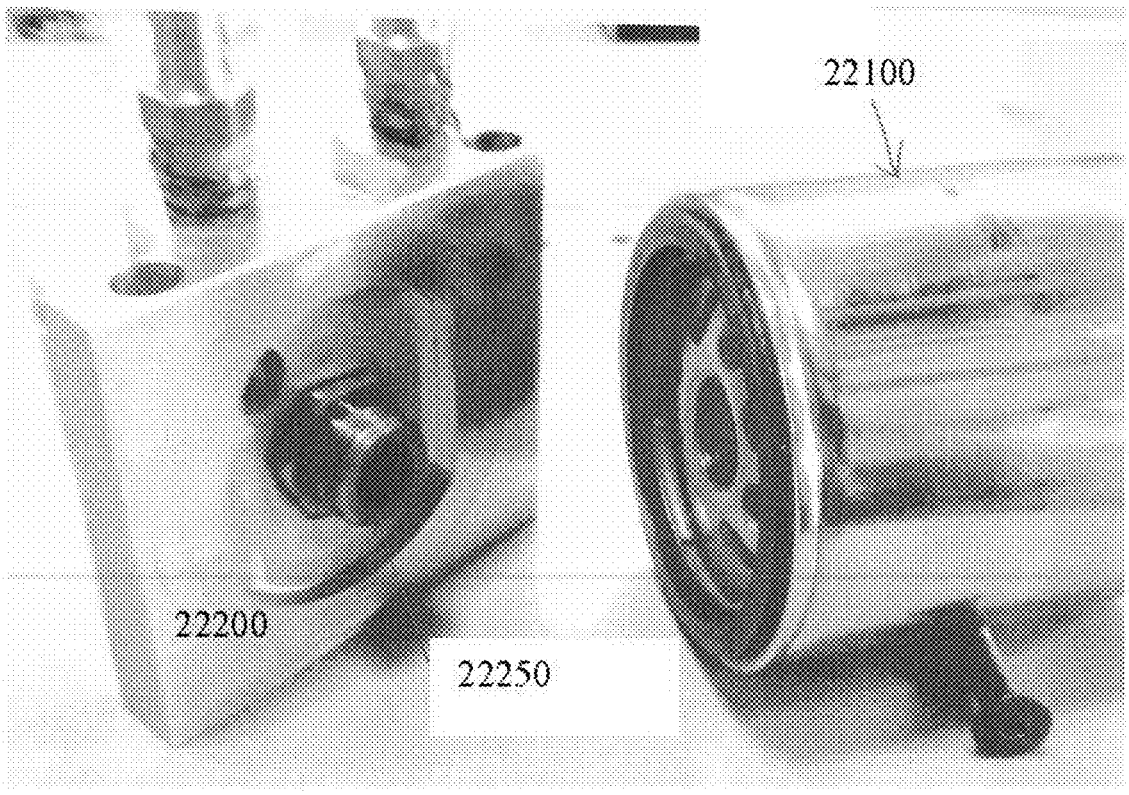
FIG. 22 is a photograph of a perspective view of an exemplary embodiment of a system 22000.
Figure 23:
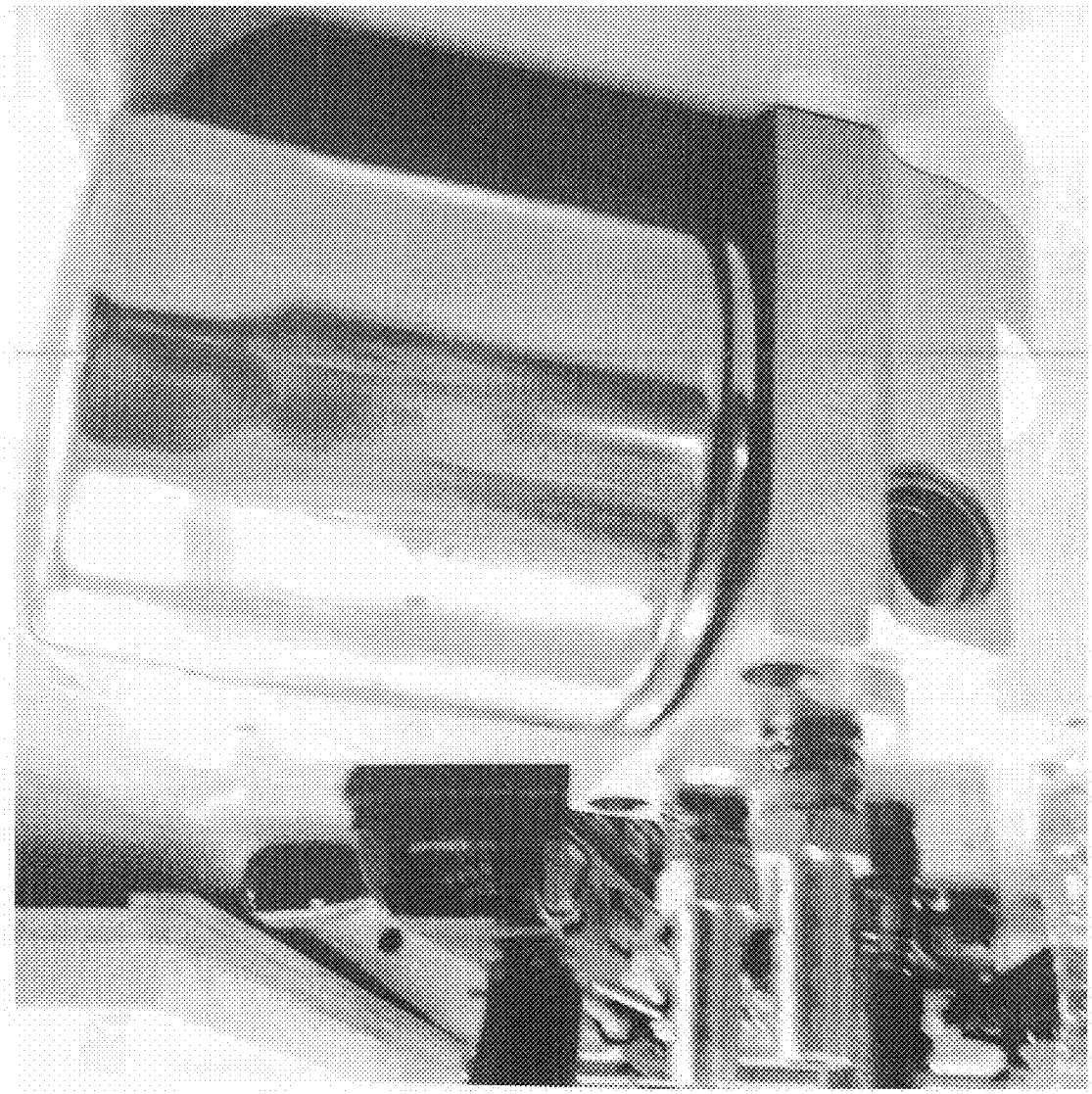
FIG. 23 is a photograph of a perspective view of an exemplary embodiment of a system 23000.
Figure 24:
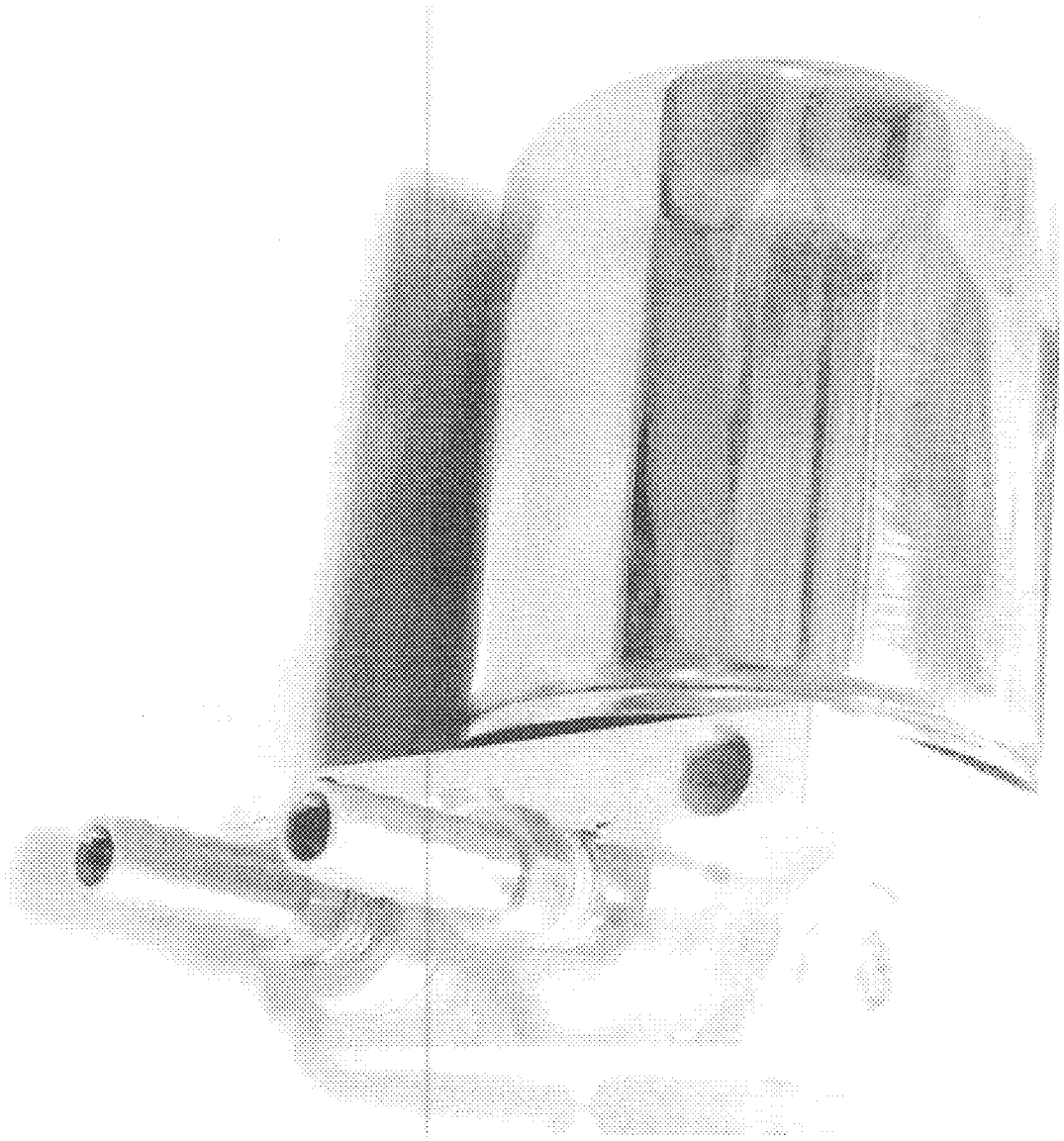
FIG. 24 is a photograph of a perspective view of an exemplary embodiment of a system 24000.
Figure 25:
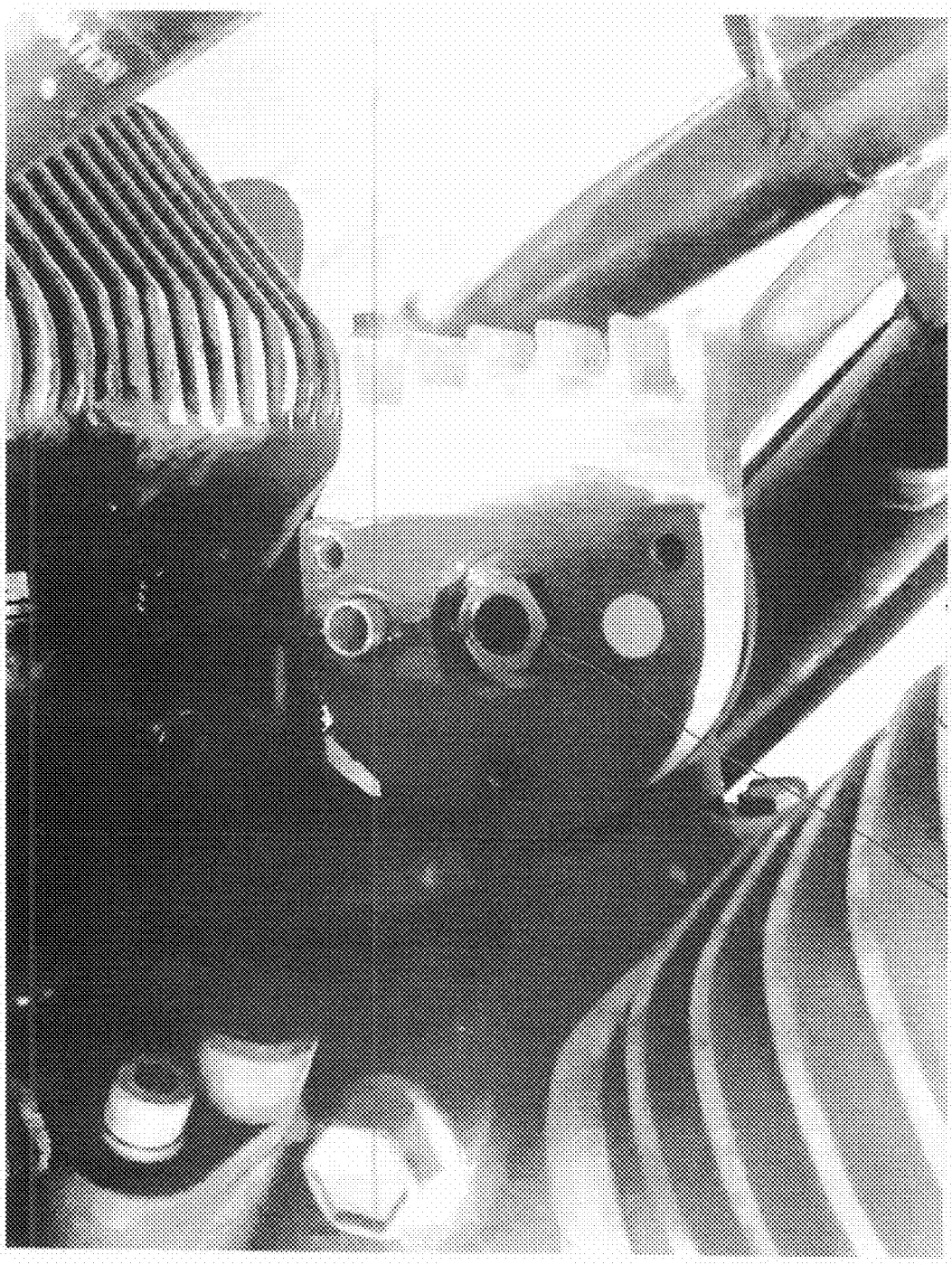
FIG. 25 is a photograph of a perspective view of an exemplary embodiment of a engine adapter plate 25000.
Figure 26:
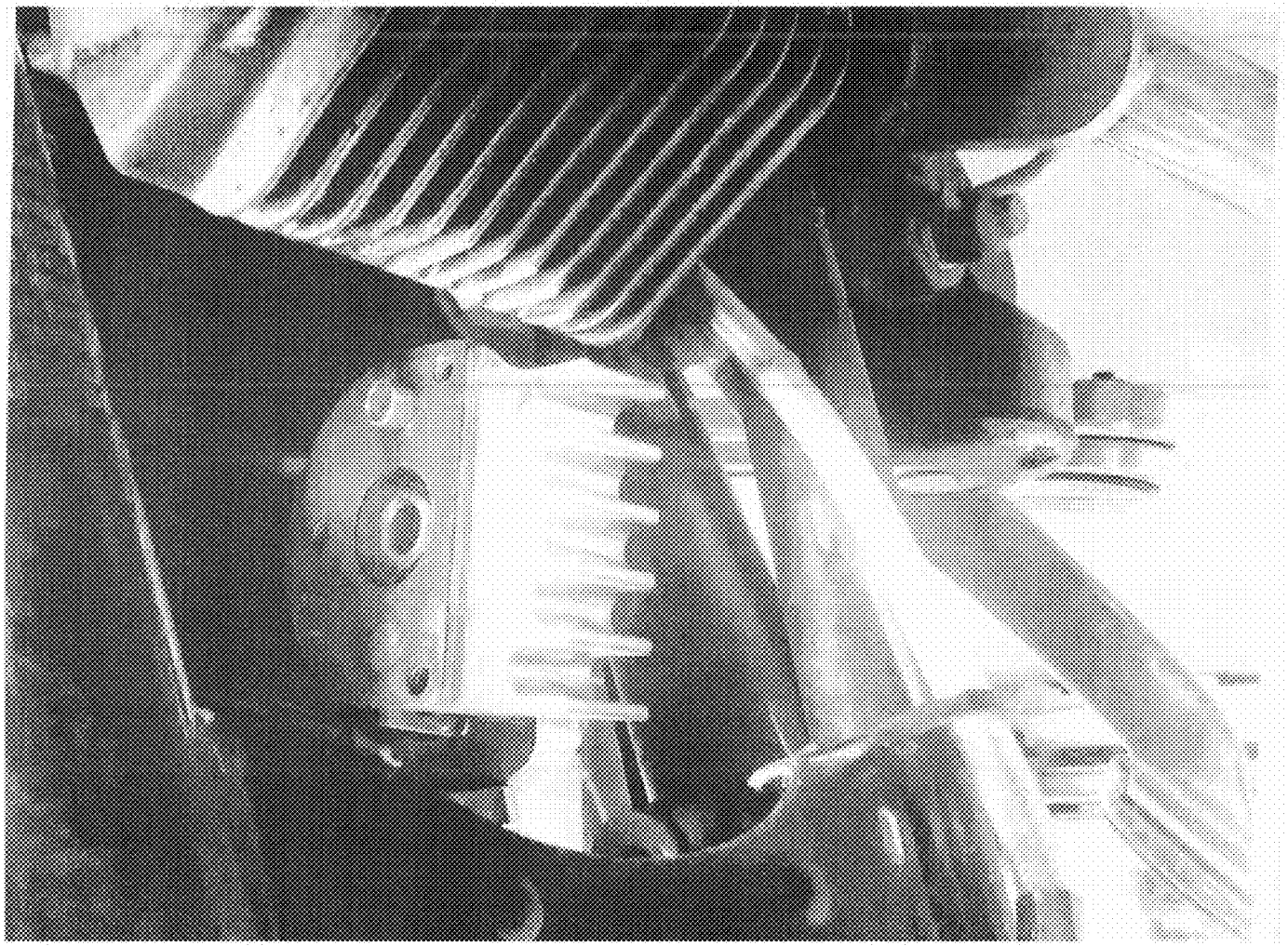
FIG. 26 is a photograph of a perspective view of an exemplary embodiment of a engine adapter plate 26000.
Figure 27:
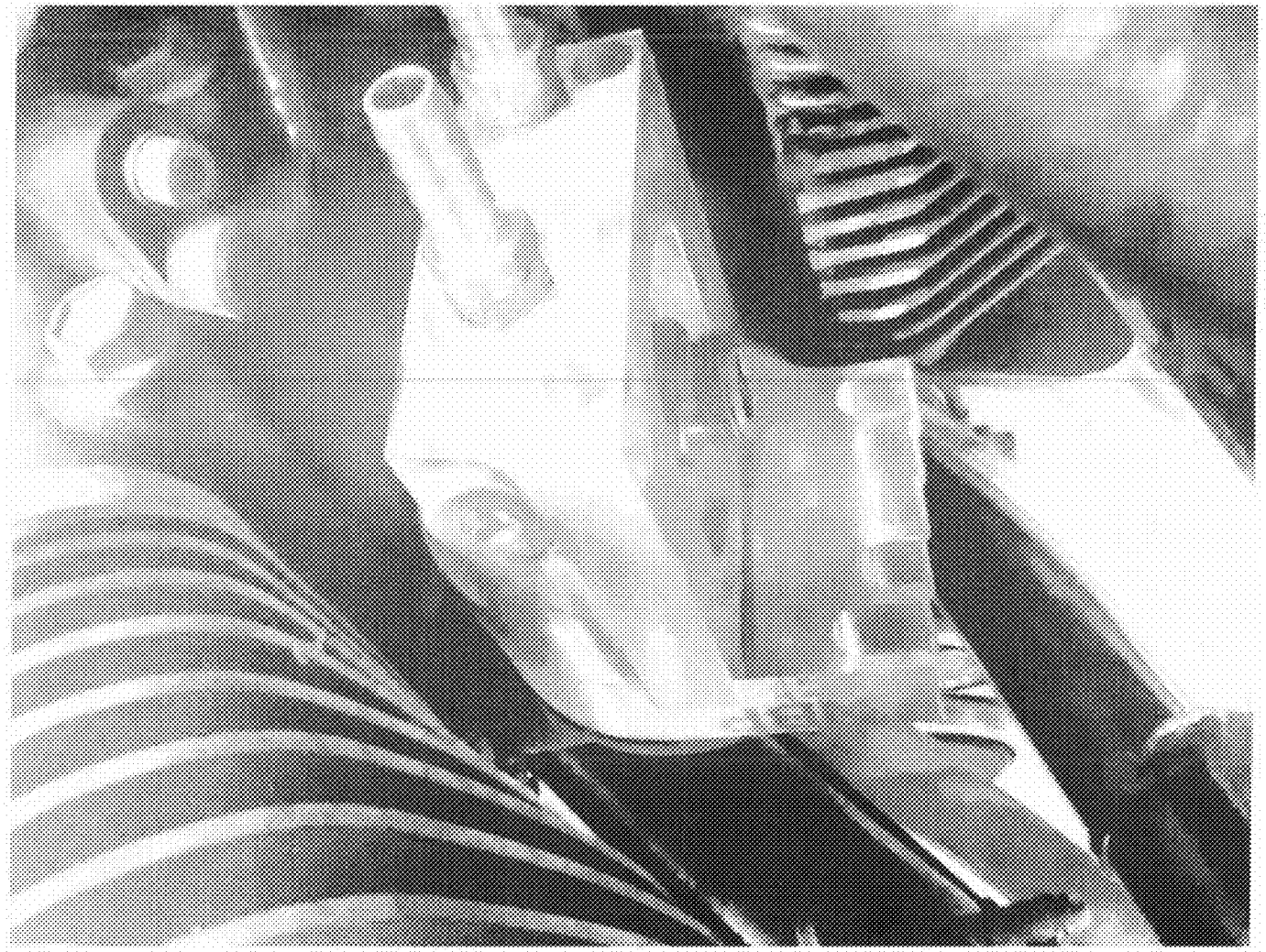
FIG. 27 is a photograph of a perspective view of an exemplary embodiment of a system 27000.
Figure 28:
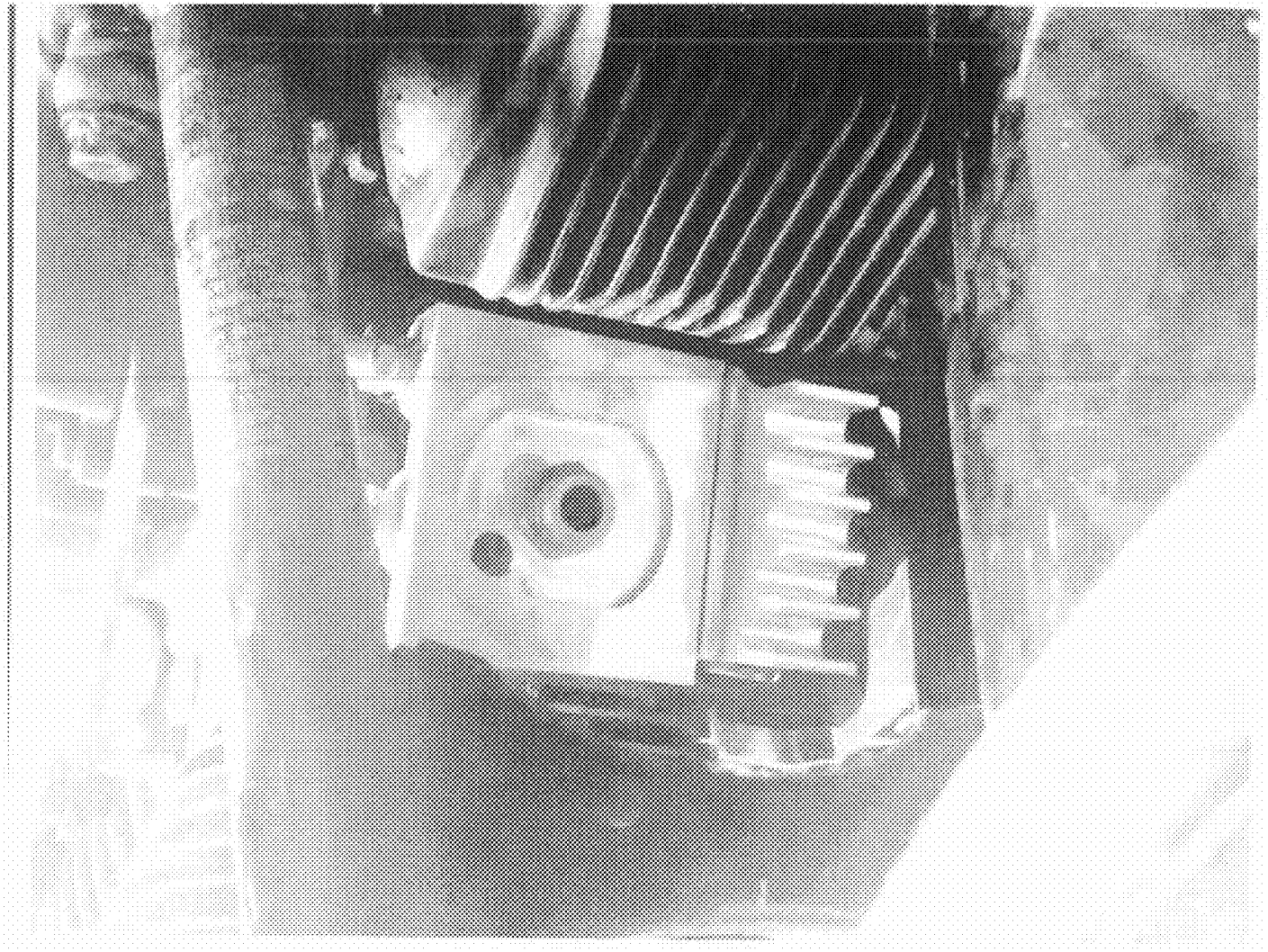
FIG. 28 is a photograph of a perspective view of an exemplary embodiment of a system 28000.

FIG. 22 is a photograph of a perspective view of an exemplary embodiment of a system 22000, which comprises an oil filter 22100 and an adapter 22200 that comprises a double tap bushing 22250. FIG. 23 is a photograph of a perspective view of an exemplary embodiment of a system 23000. FIG. 24 is a photograph of a perspective view of an exemplary embodiment of a system 24000. FIG. 25 is a photograph of a perspective view of an exemplary embodiment of a engine adapter plate 25000, which is mounted to an engine. FIG. 26 is a photograph of a perspective view of an exemplary embodiment of a engine adapter plate 26000, which is mounted to an engine. FIG. 27 is a photograph of a perspective view of an exemplary embodiment of a system 27000, which illustrates a 90-degree oil filter adapter mounted to an adapter plate. FIG. 28 is a photograph of a perspective view of an exemplary embodiment of a system 28000, which illustrates a 90-degree oil filter adapter mounted to an adapter plate.

Figure 29:
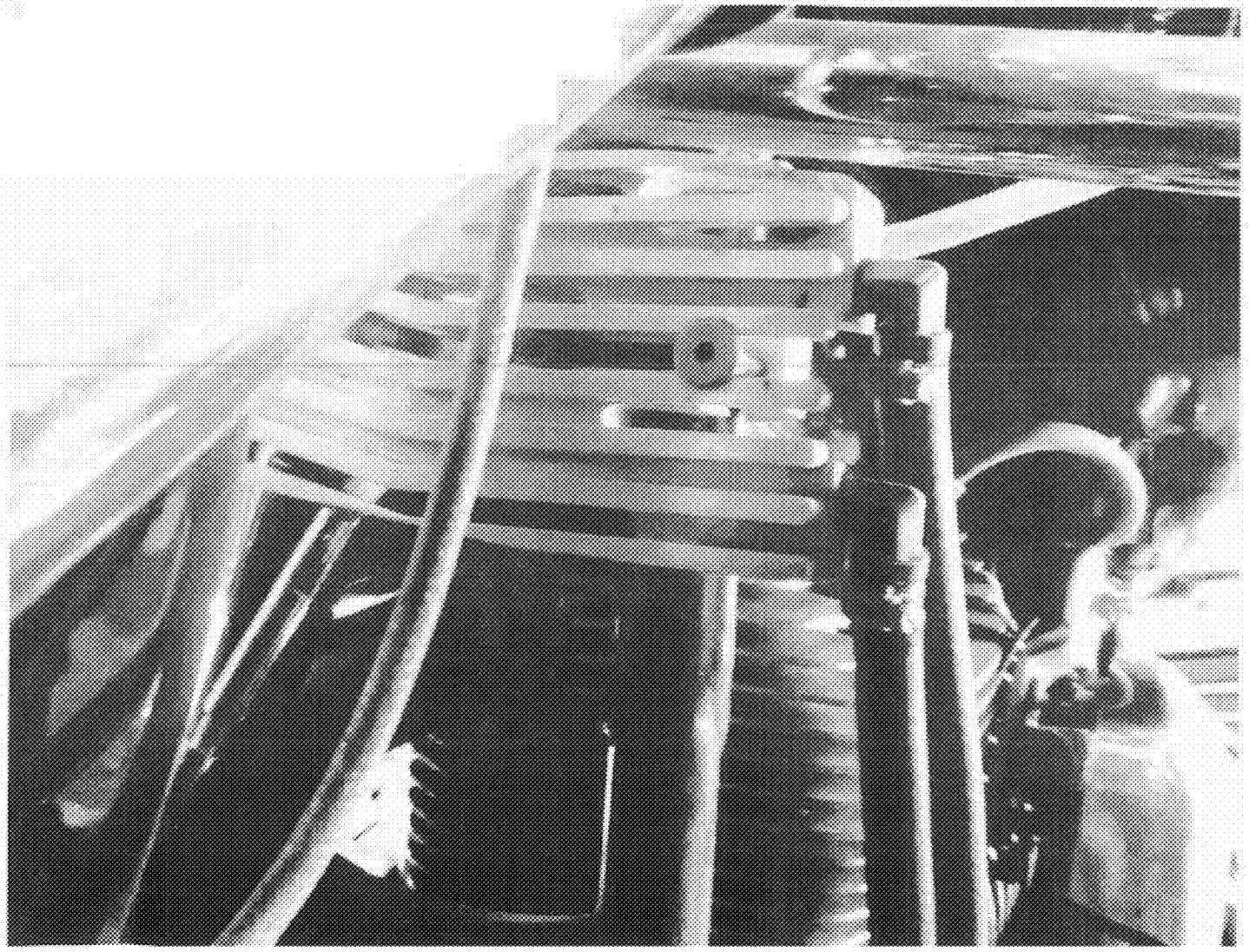
FIG. 29 is a photograph of a perspective view of an exemplary embodiment of a system 29000.
Figure 30:
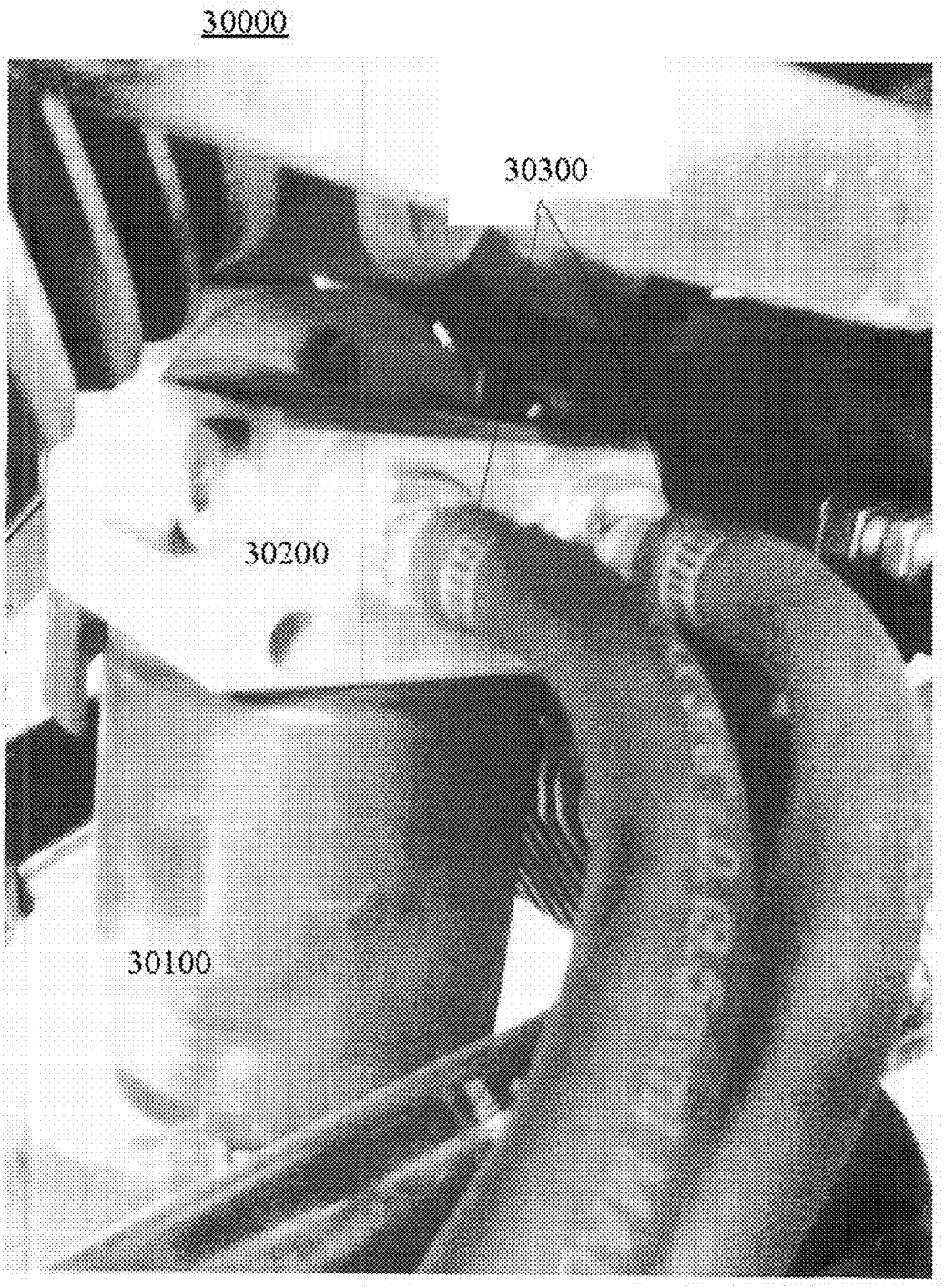
FIG. 30 is a photograph of a perspective view of an exemplary embodiment of a system 30000.
Figure 31:
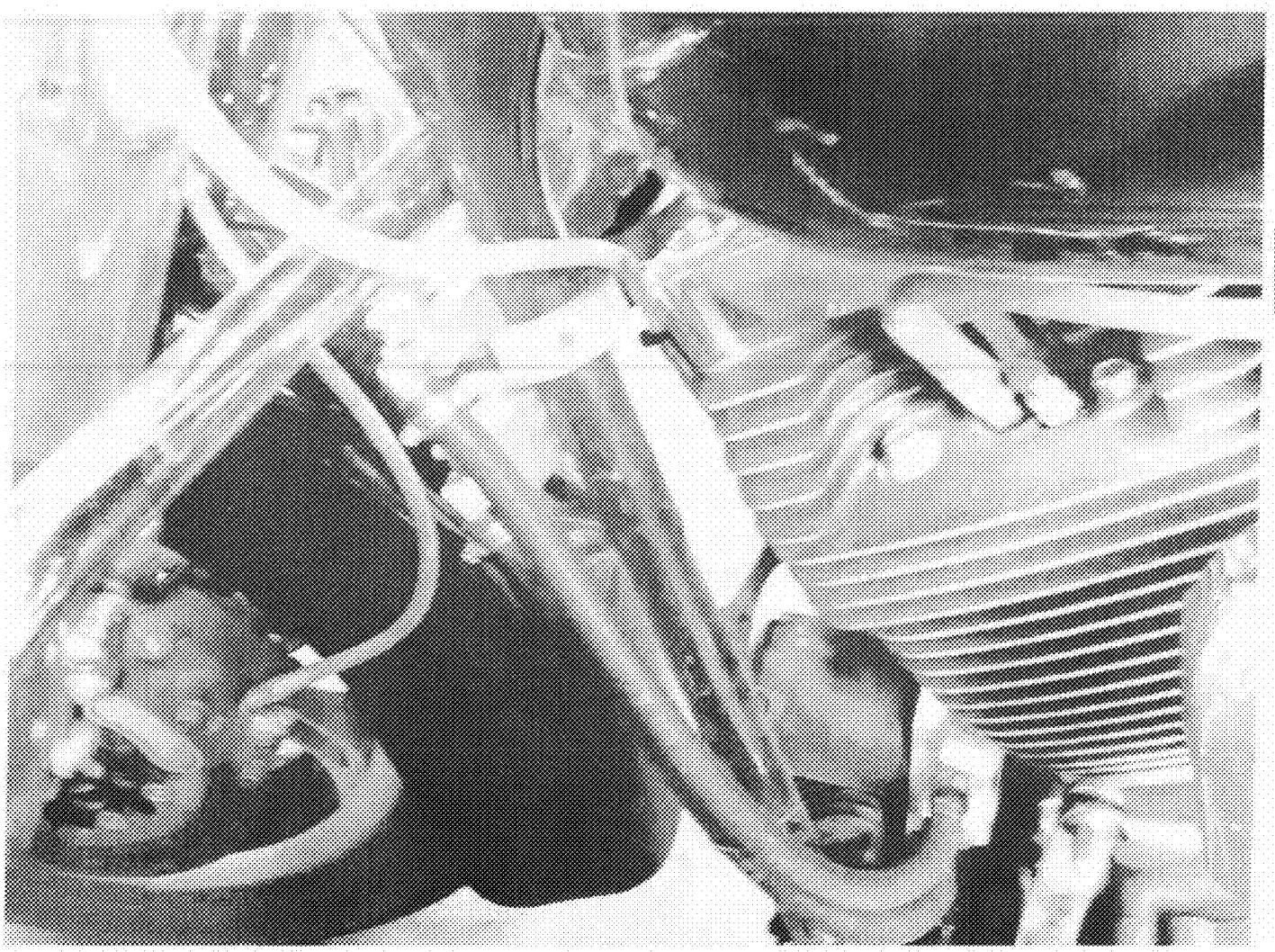
FIG. 31 is a photograph of a perspective view of an exemplary embodiment of a system 31000.
Figure 32:
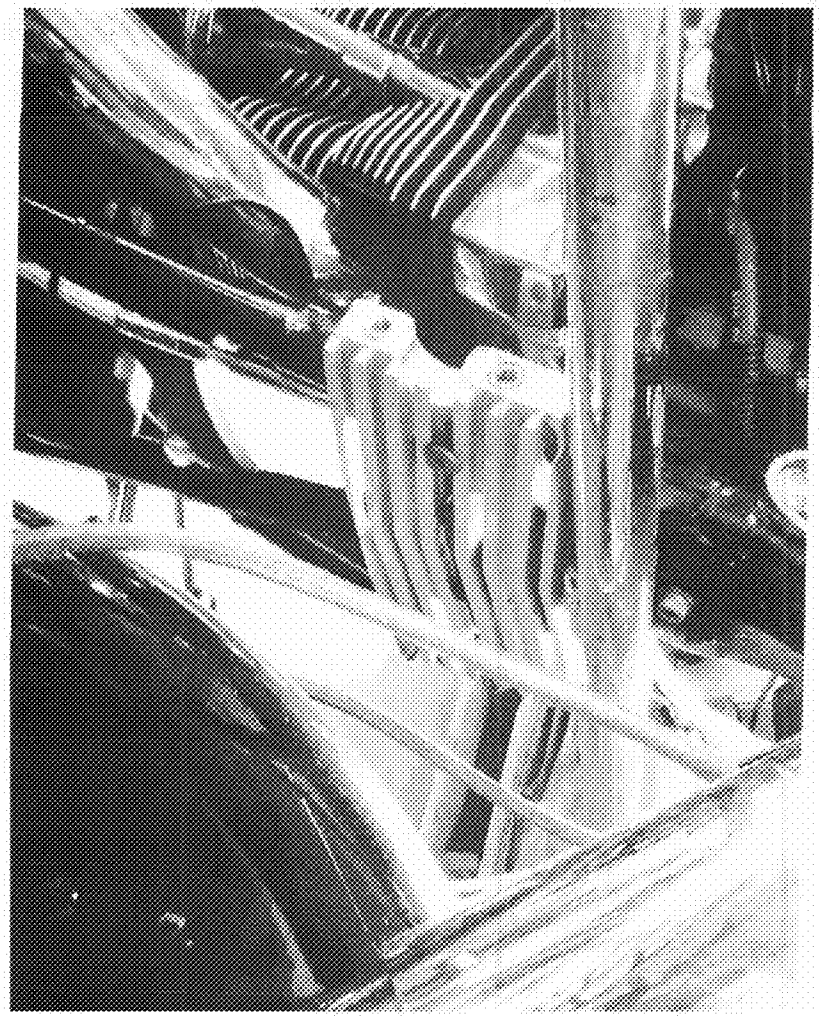
FIG. 32 is a photograph of a perspective view of an exemplary embodiment of a system 32000.
Figure 33:
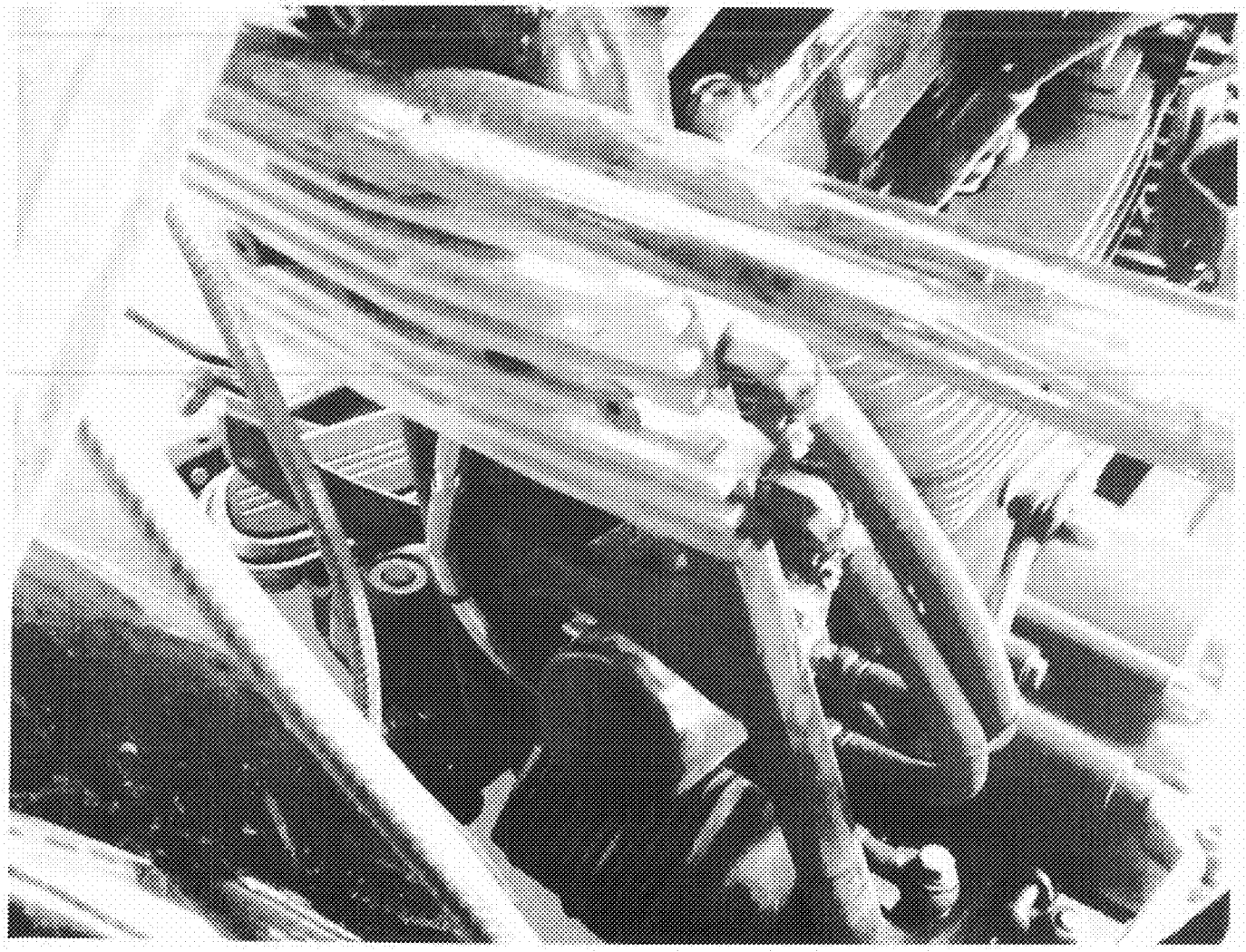
FIG. 33 is a photograph of a perspective view of an exemplary embodiment of a system 33000.
Figure 34:
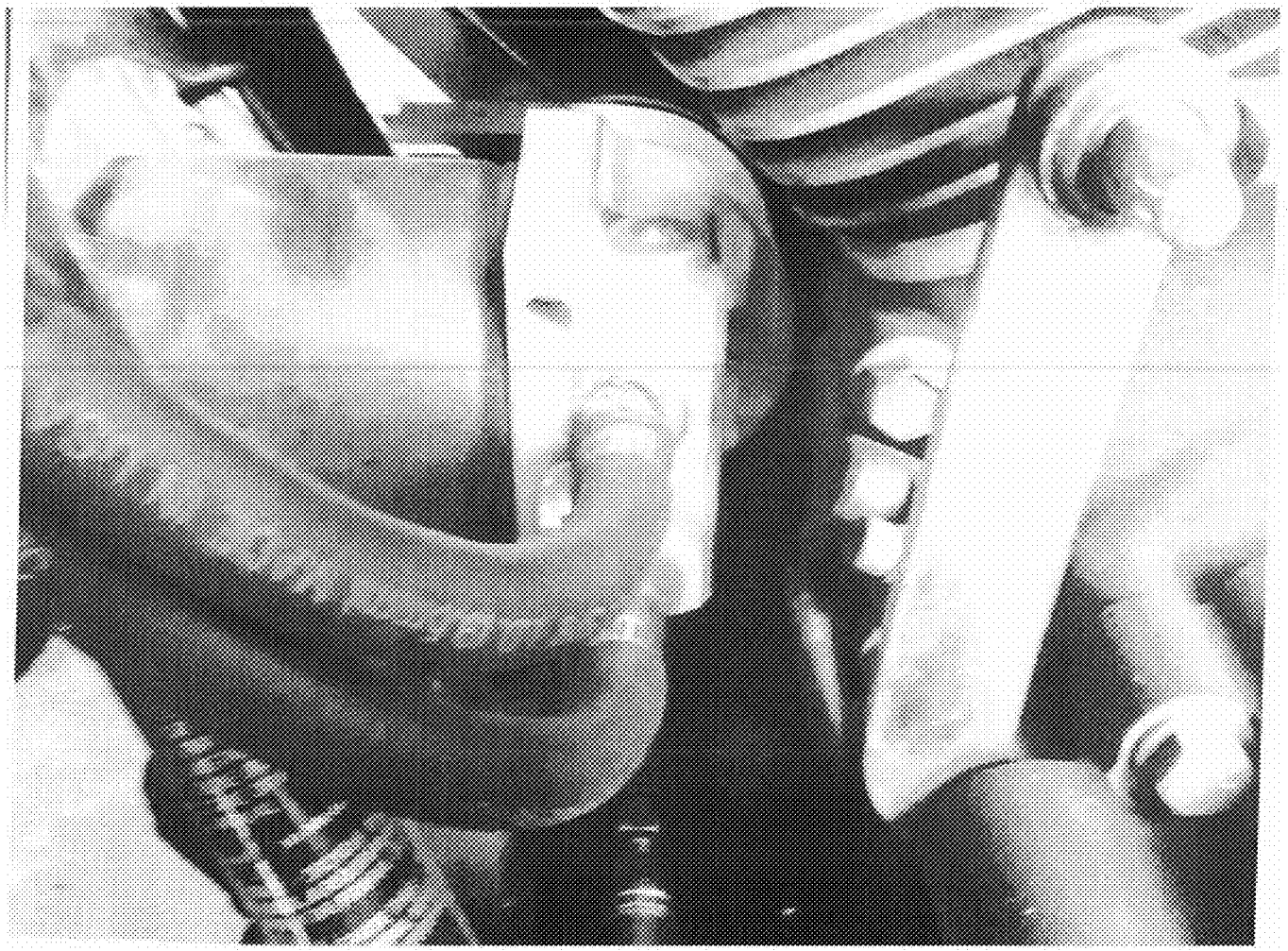
FIG. 34 is a photograph of a perspective view of an exemplary embodiment of a system 34000.
Figure 35:
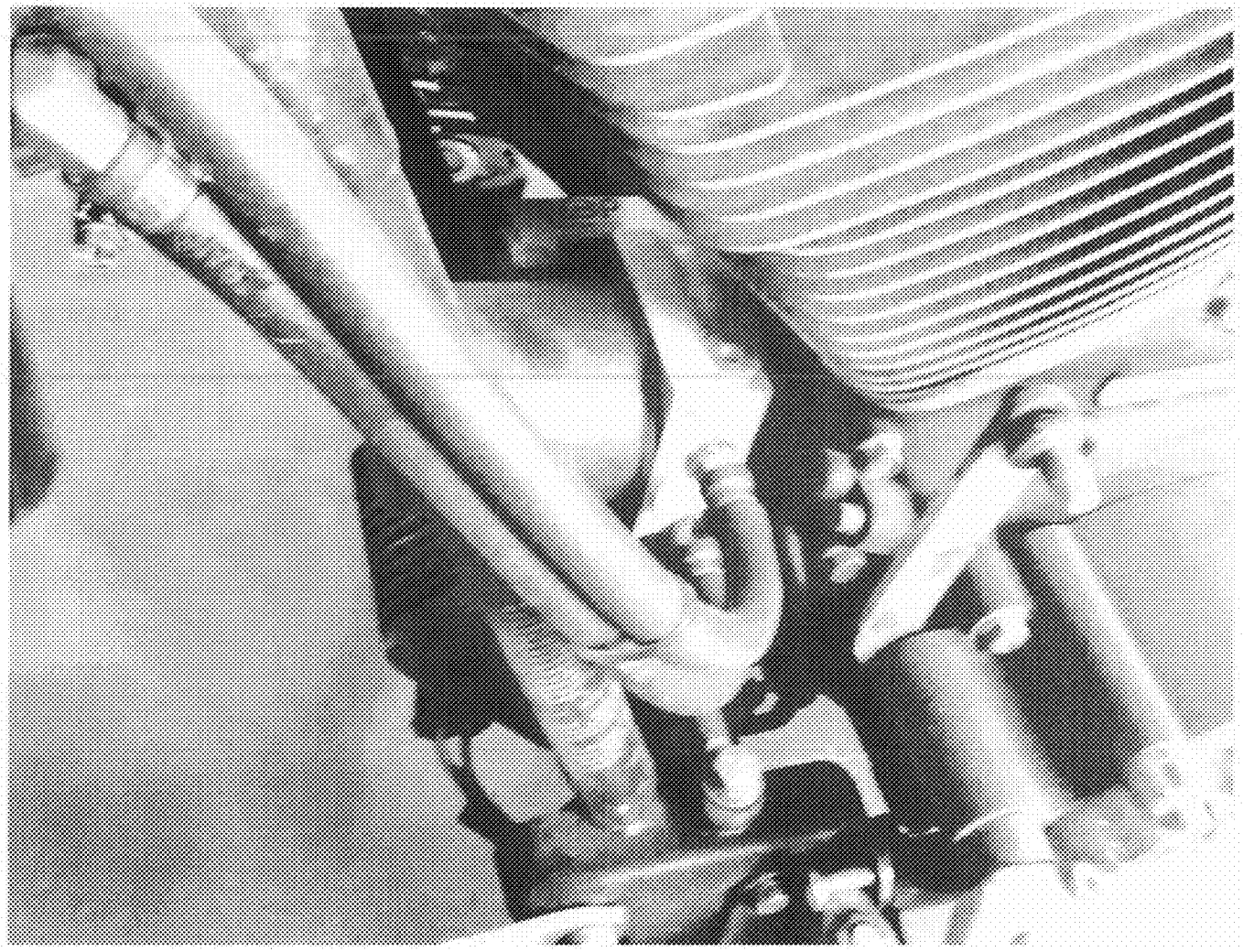
FIG. 35 is a photograph of a perspective view of an exemplary embodiment of a system 35000.
Figure 36:
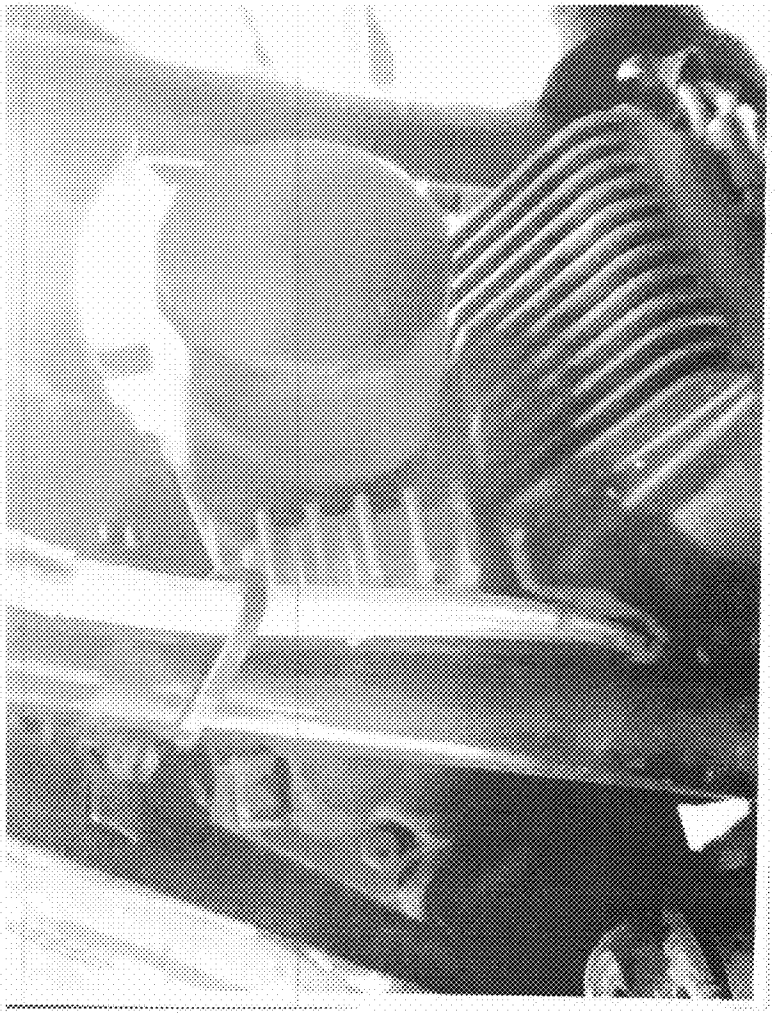
FIG. 36 is a photograph of a perspective view of an exemplary embodiment of a system 36000.

FIG. 29 is a photograph of a perspective view of an exemplary embodiment of a system 29000, which comprises a heat exchanger mounted to a motorcycle frame and oil lines coupled from a 90-degree oil filter adapter. FIG. 30 is a photograph of a perspective view of an exemplary embodiment of a system 30000, which comprises an oil filter 30100 mounted to a 90-degree oil filter adapter 30200. Oil filter adapter 30200 is coupled to two oil lines 30300, which are coupled to a heat exchanger. FIG. 31 is a photograph of a perspective view of an exemplary embodiment of a system 31000. FIG. 32 is a photograph of a perspective view of an exemplary embodiment of a system 32000, which comprises a heat exchanger mounted to a motorcycle frame. FIG. 33 is a photograph of a perspective view of an exemplary embodiment of a system 33000. FIG. 34 is a photograph of a perspective view of an exemplary embodiment of a system 34000. FIG. 35 is a photograph of a perspective view of an exemplary embodiment of a system 35000. FIG. 36 is a photograph of a perspective view of an exemplary embodiment of a system 36000.

Figure 37:
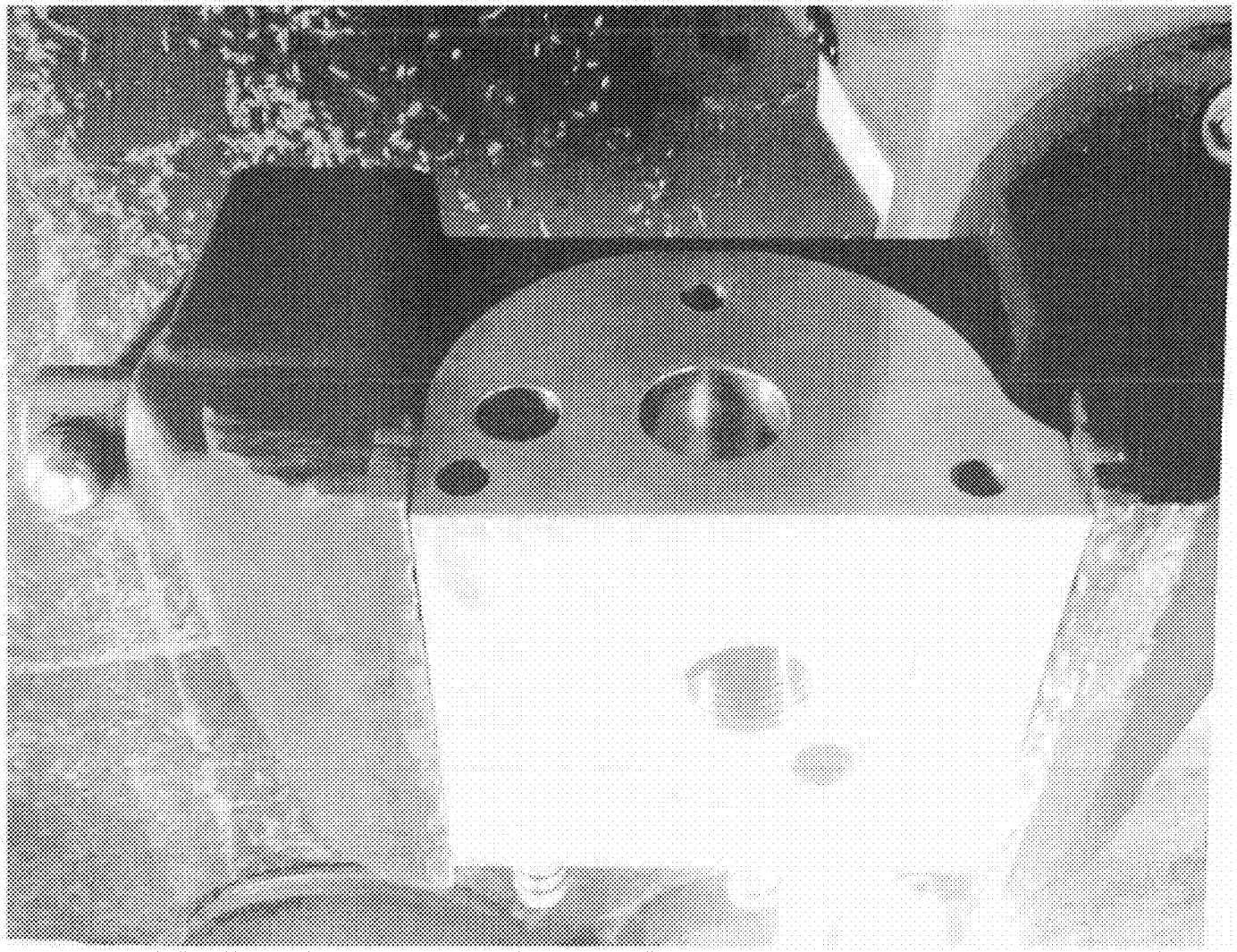
FIG. 37 is a photograph of a perspective view of an exemplary embodiment of a system 37000.
Figure 38:
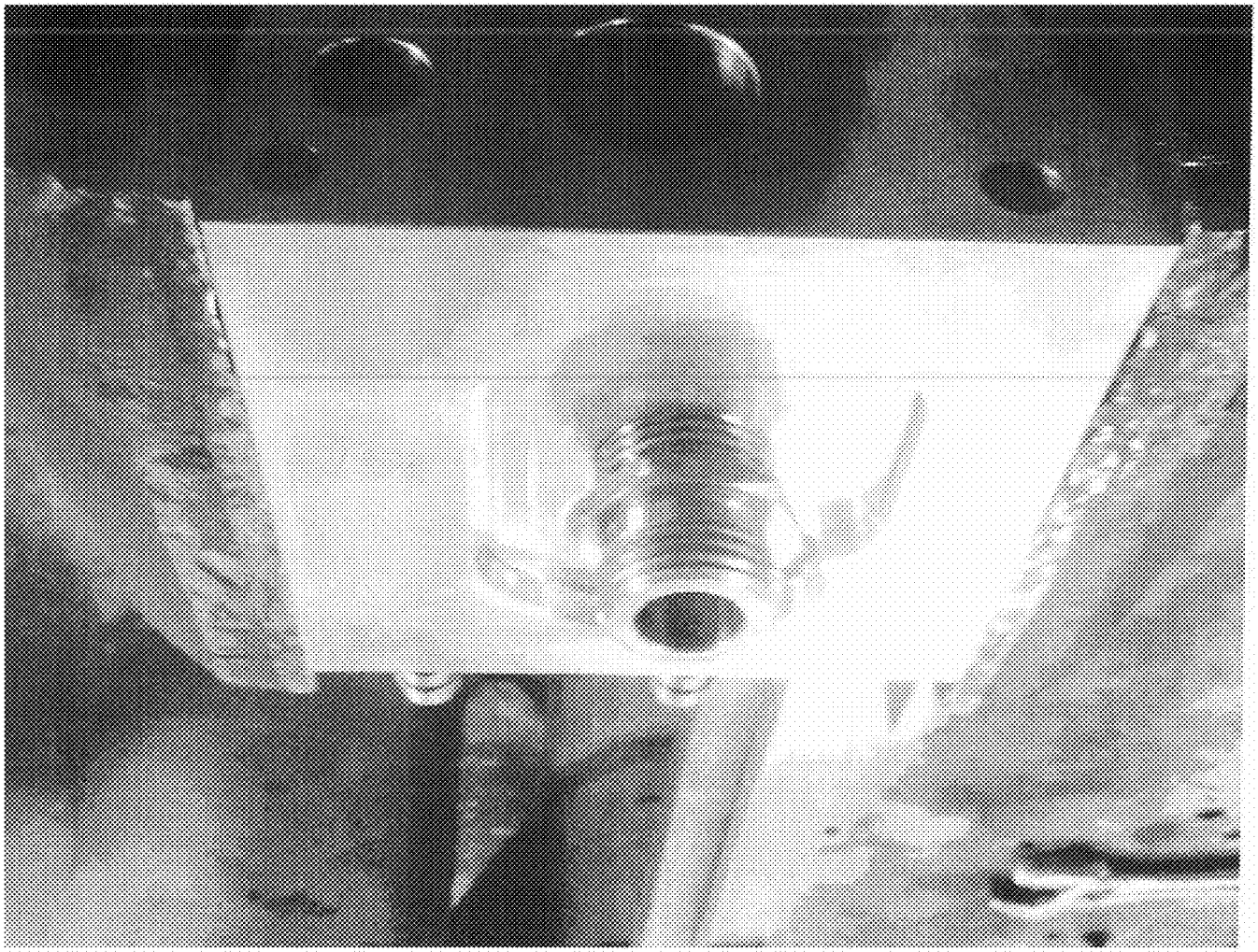
FIG. 38 is a photograph of a perspective view of an exemplary embodiment of a double tap bushing 38000 for an oil filter mount.
Figure 39:
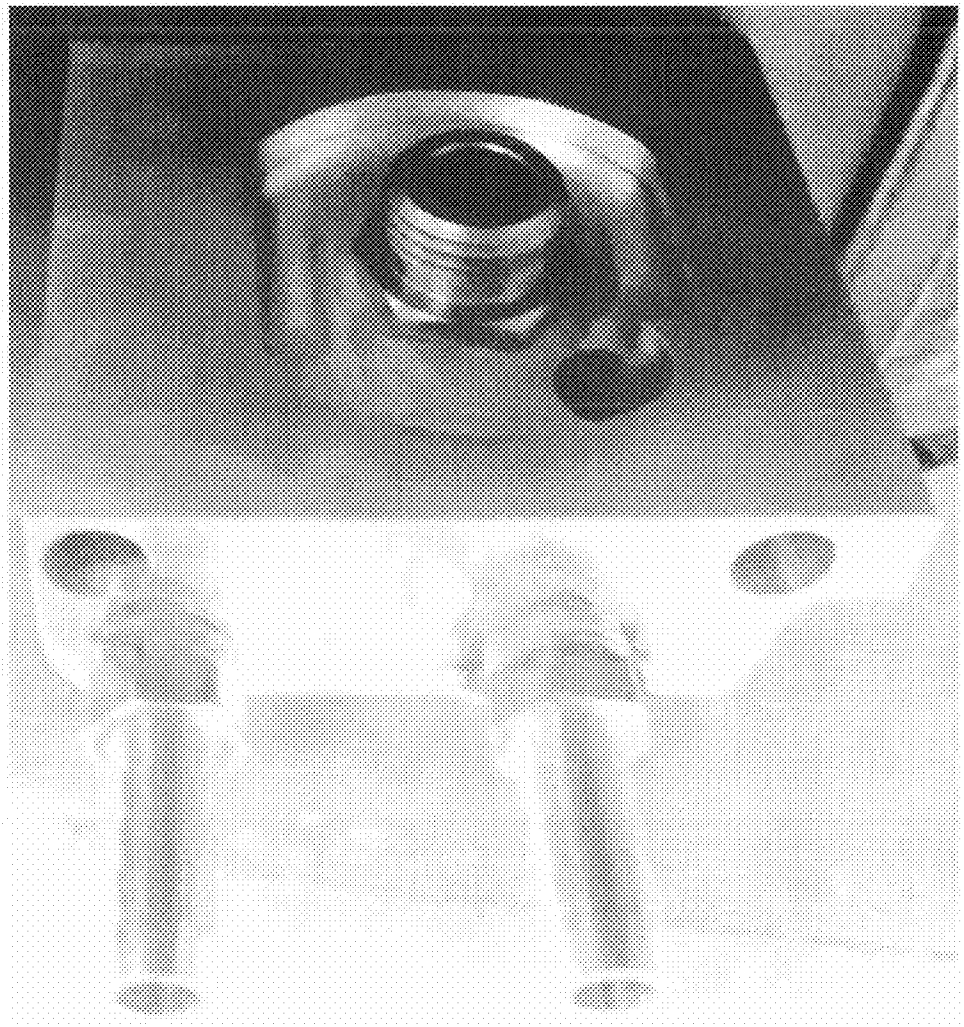
FIG. 39 is a photograph of a perspective view of an exemplary embodiment of a system 39000.
Figure 40:
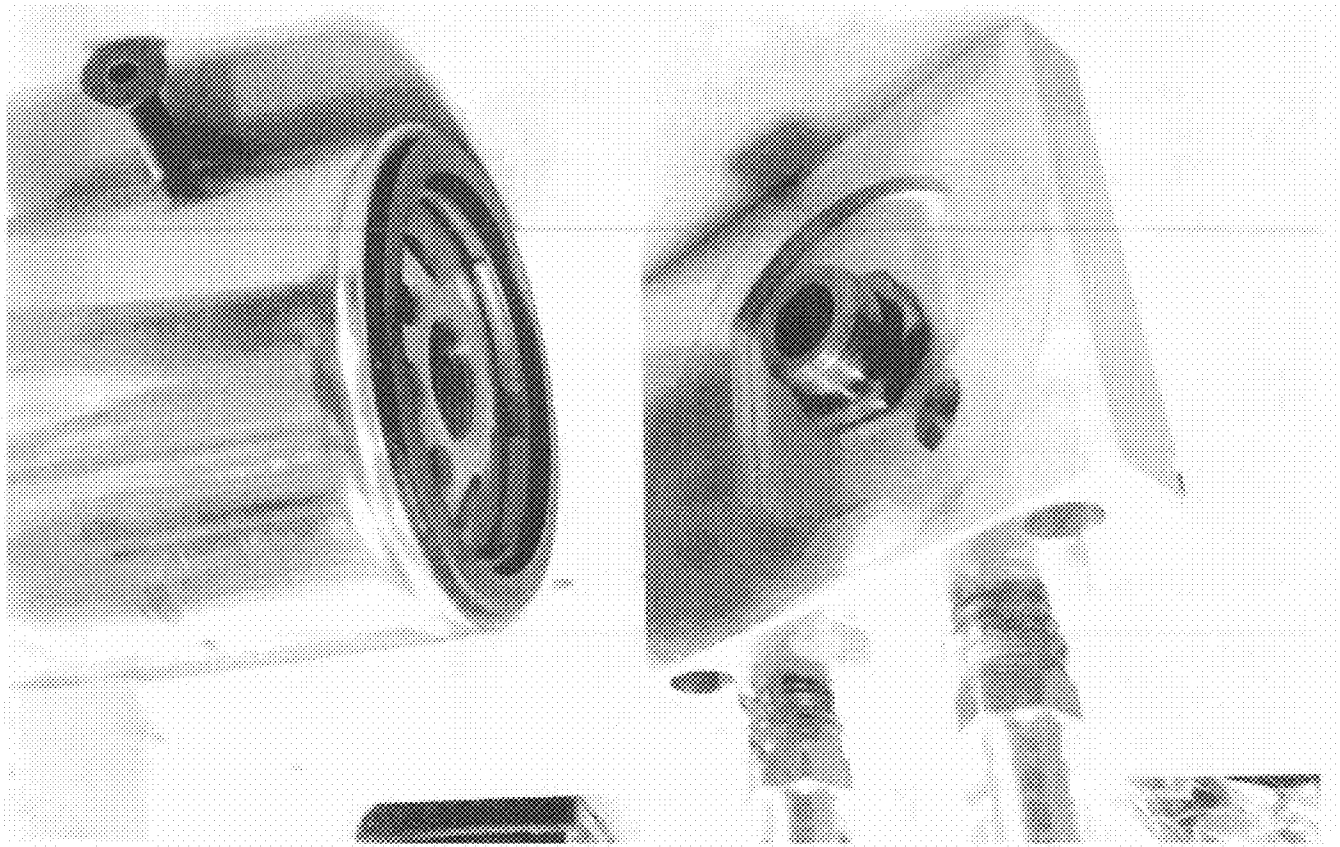
FIG. 40 is a photograph of a perspective view of an exemplary embodiment of a system 40000.

FIG. 37 is a photograph of a perspective view of an exemplary embodiment of a system 37000. FIG. 38 is a photograph of a perspective view of an exemplary embodiment of a double tap bushing 38000 for an oil filter mount. FIG. 39 is a photograph of a perspective view of an exemplary embodiment of a system 39000. FIG. 40 is a photograph of a perspective view of an exemplary embodiment of a system 40000.

Figure 41:
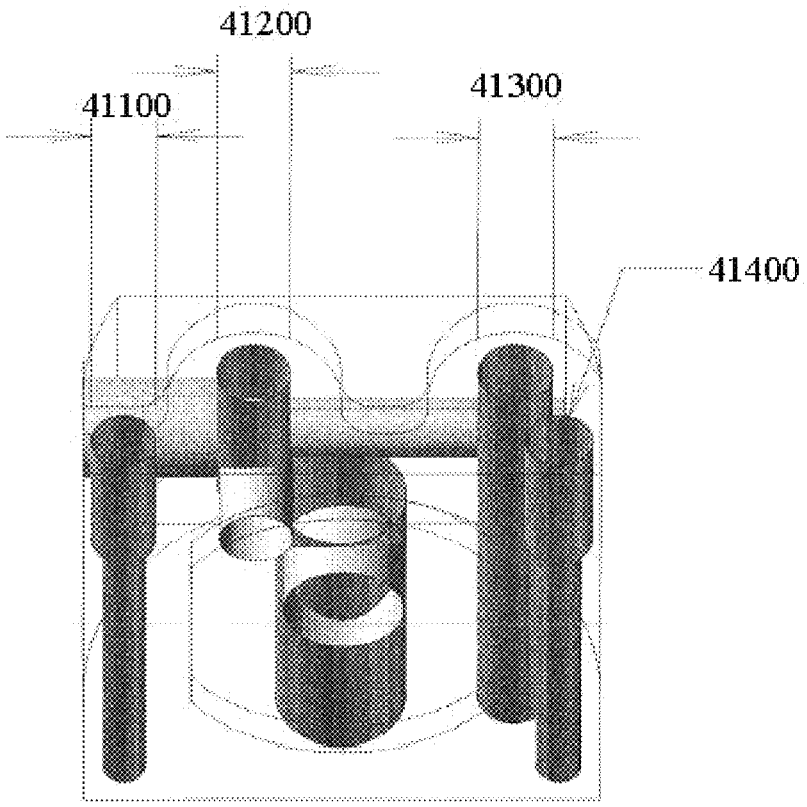
FIG. 41 is a perspective view of an exemplary embodiment of a 90-degree oil filter adapter 41000.

FIG. 41 is a perspective view of an exemplary embodiment of a 90-degree oil filter adapter 41000, which shows a set of dimensions for an exemplary embodiment. The set of dimensions comprises a first dimension 41100, a second dimension 41200, a third dimension 41300, and a fourth dimension 41400. The illustrated dimensions can be any dimensions appropriate for a particular motorcycle 90-degree oil filter adapter. For example, in certain exemplary embodiments:

first dimension 41100 can be approximately 0.375 inches;
second dimension 41200 can be approximately 0.422 inches;
third dimension 41300 can be approximately 0.422 inches; and/or
fourth dimension 41400 can be approximately 0.375 inches.

Figure 42:
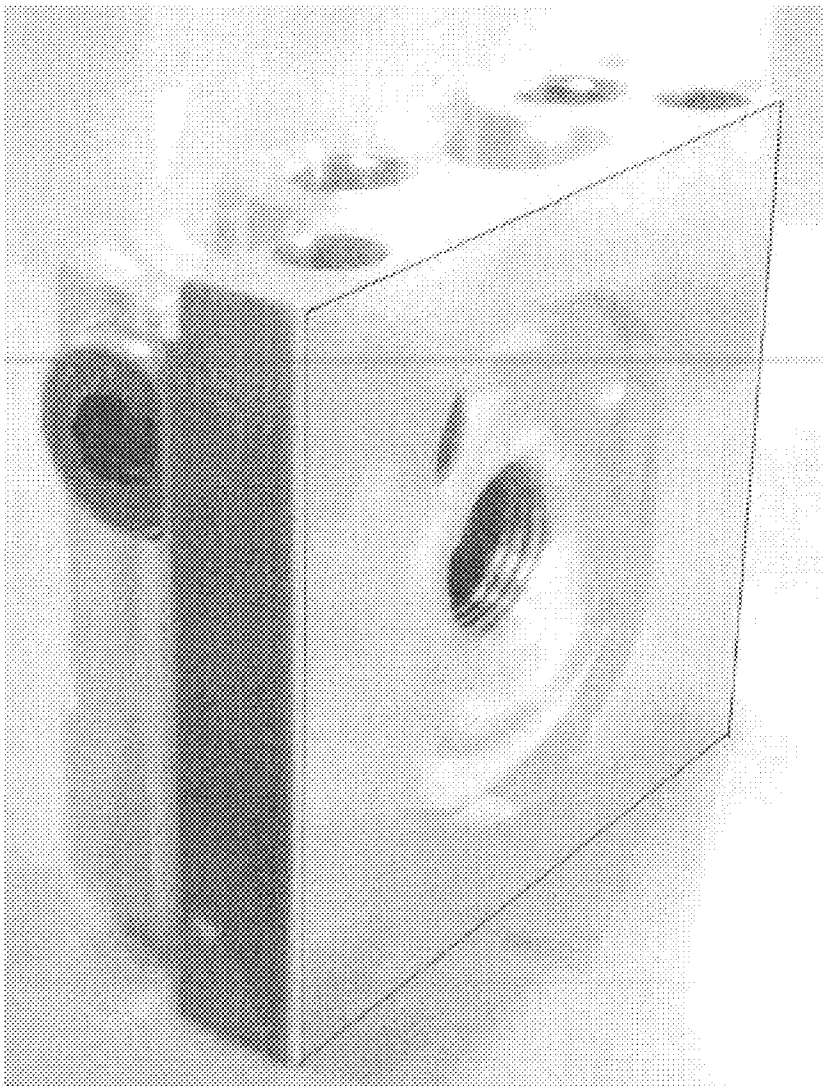
FIG. 42 is a photograph of a perspective view of an exemplary embodiment of a system 42000.
Figure 43:
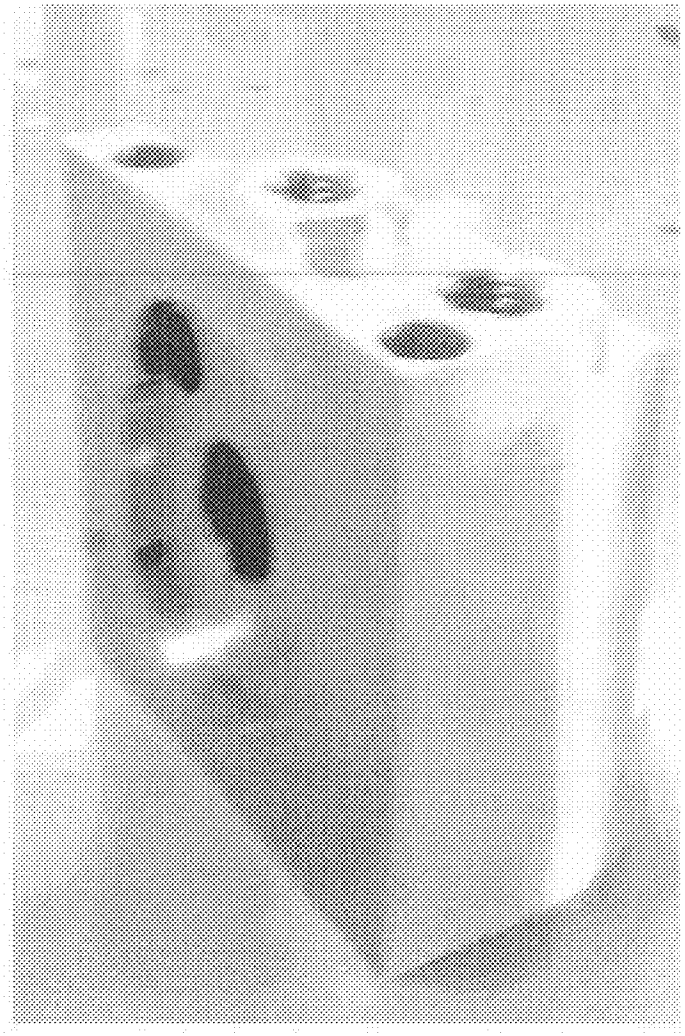
FIG. 43 is a photograph of a perspective view of an exemplary embodiment of a system 43000.
Figure 44:
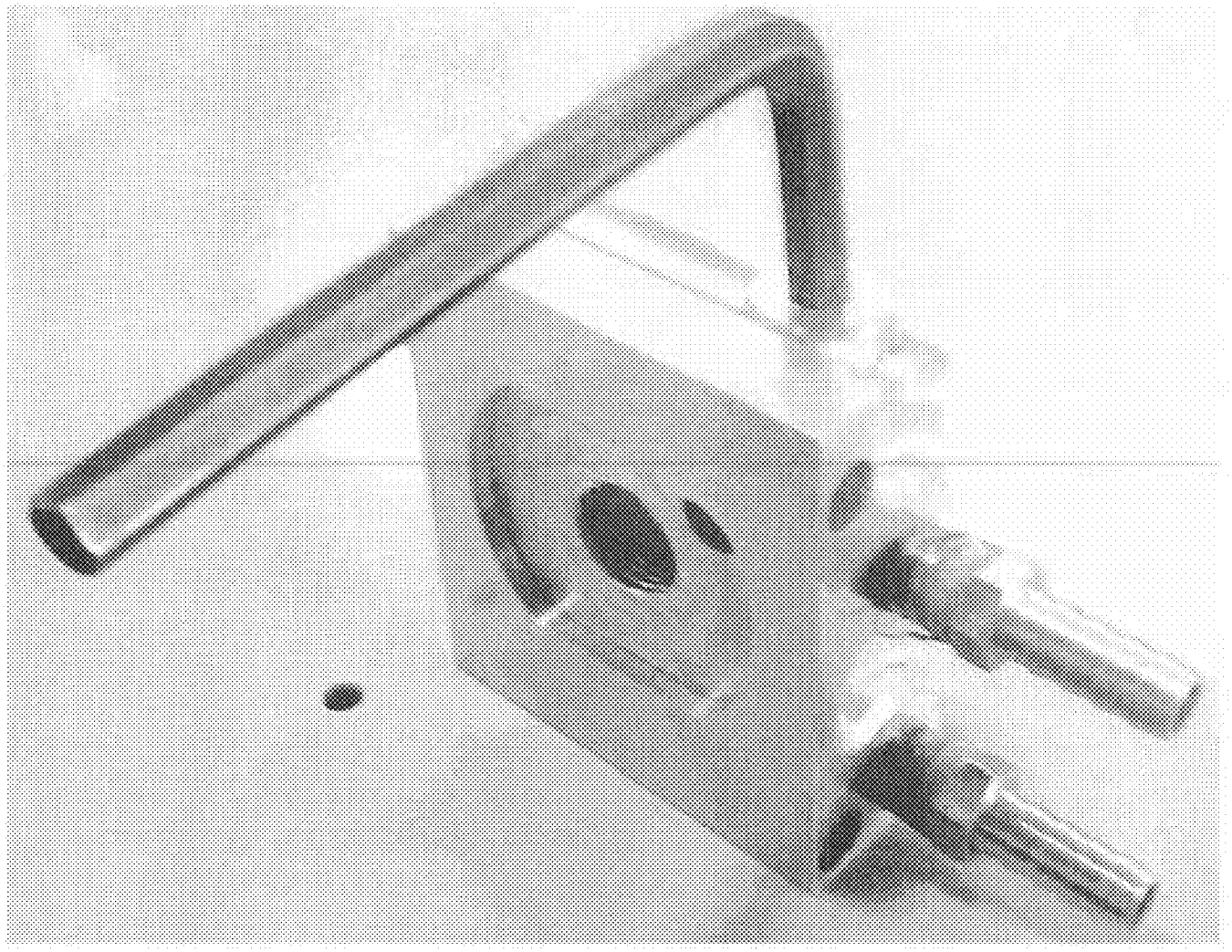
FIG. 44 is a photograph of a perspective view of an exemplary embodiment of a system 44000.
Figure 45:
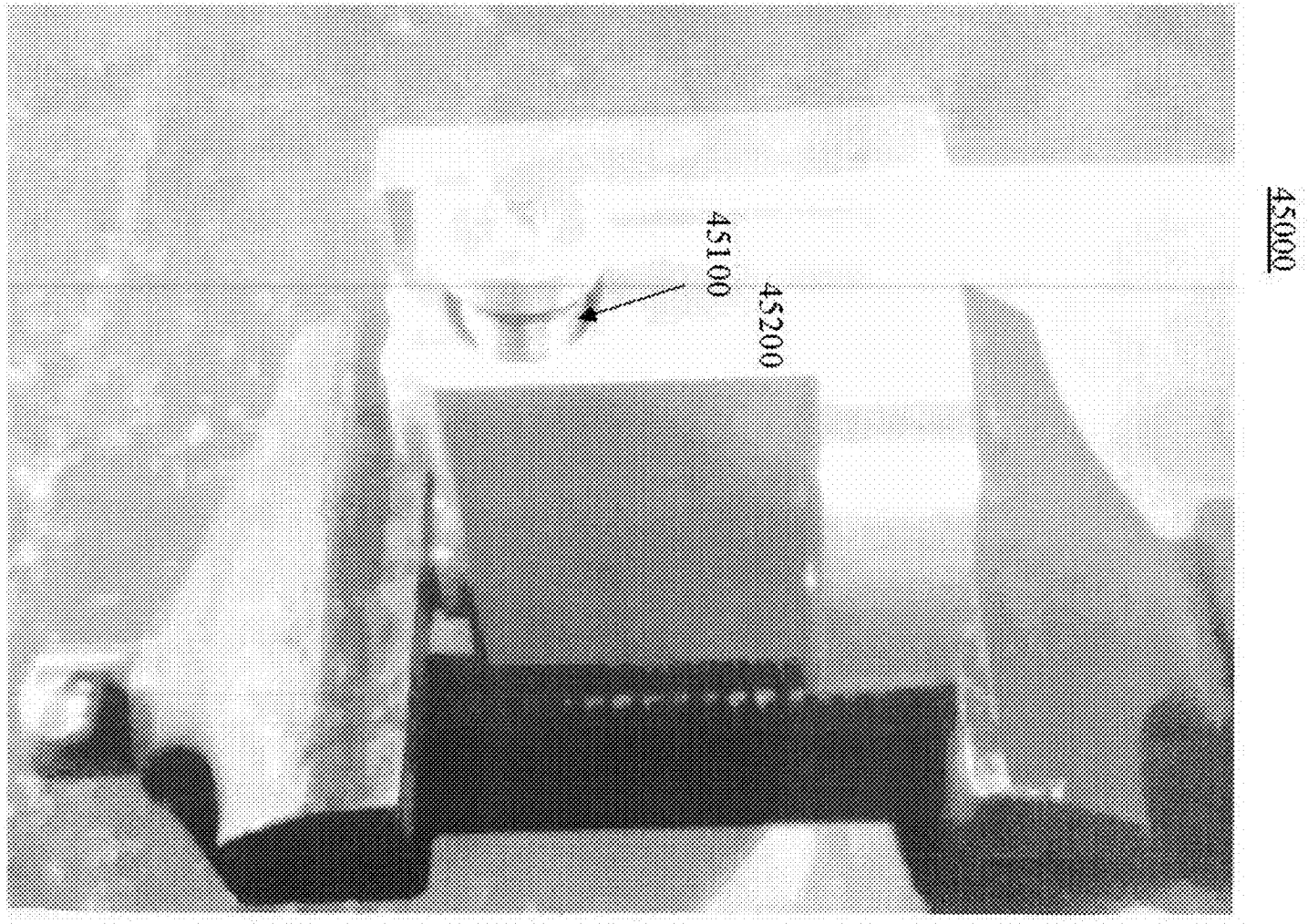
FIG. 45 is a photograph of a perspective view of an exemplary embodiment of a thermostat system 45000.
Figure 46:
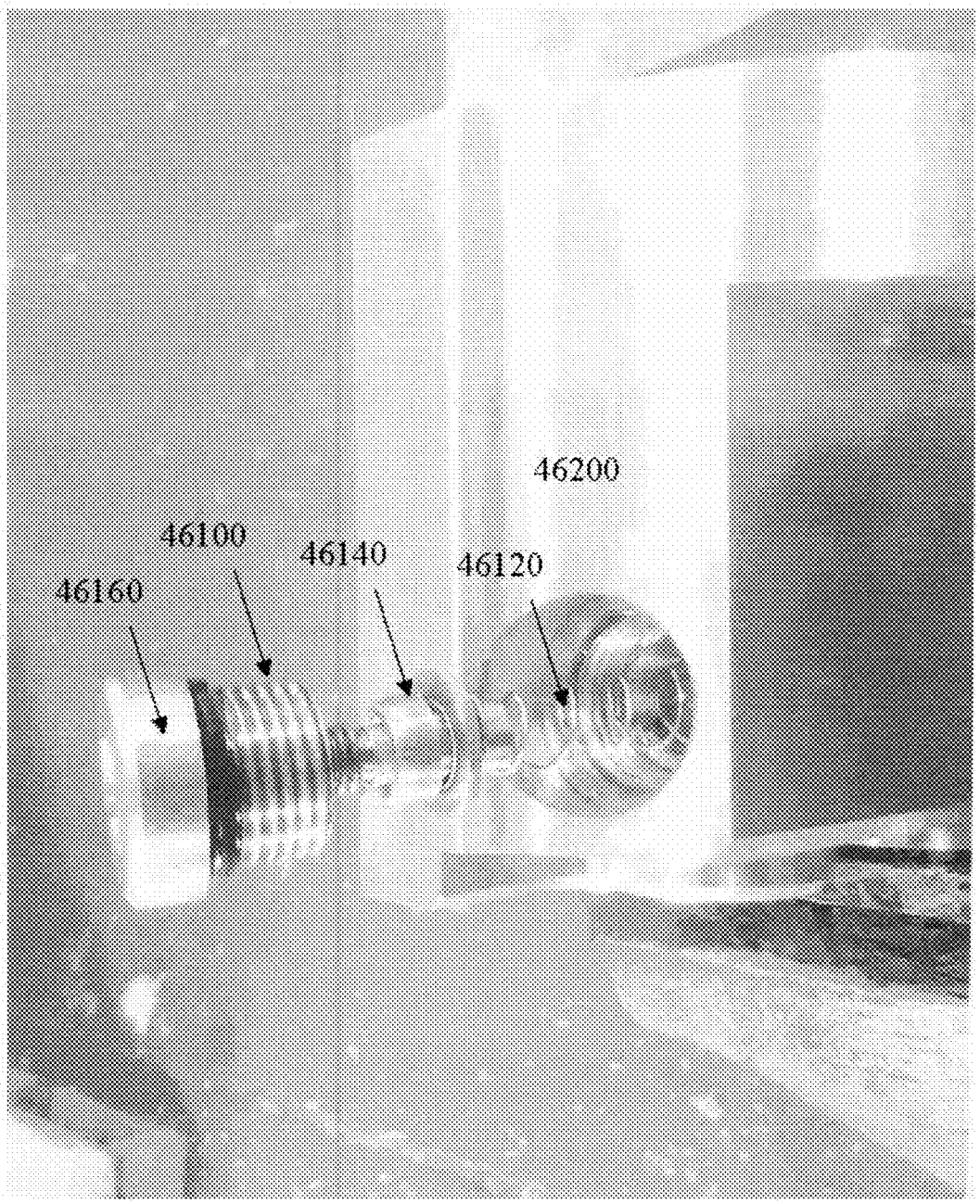
FIG. 46 is a photograph of a perspective view of an exemplary embodiment of a thermostat system 46000.
Figure 47:
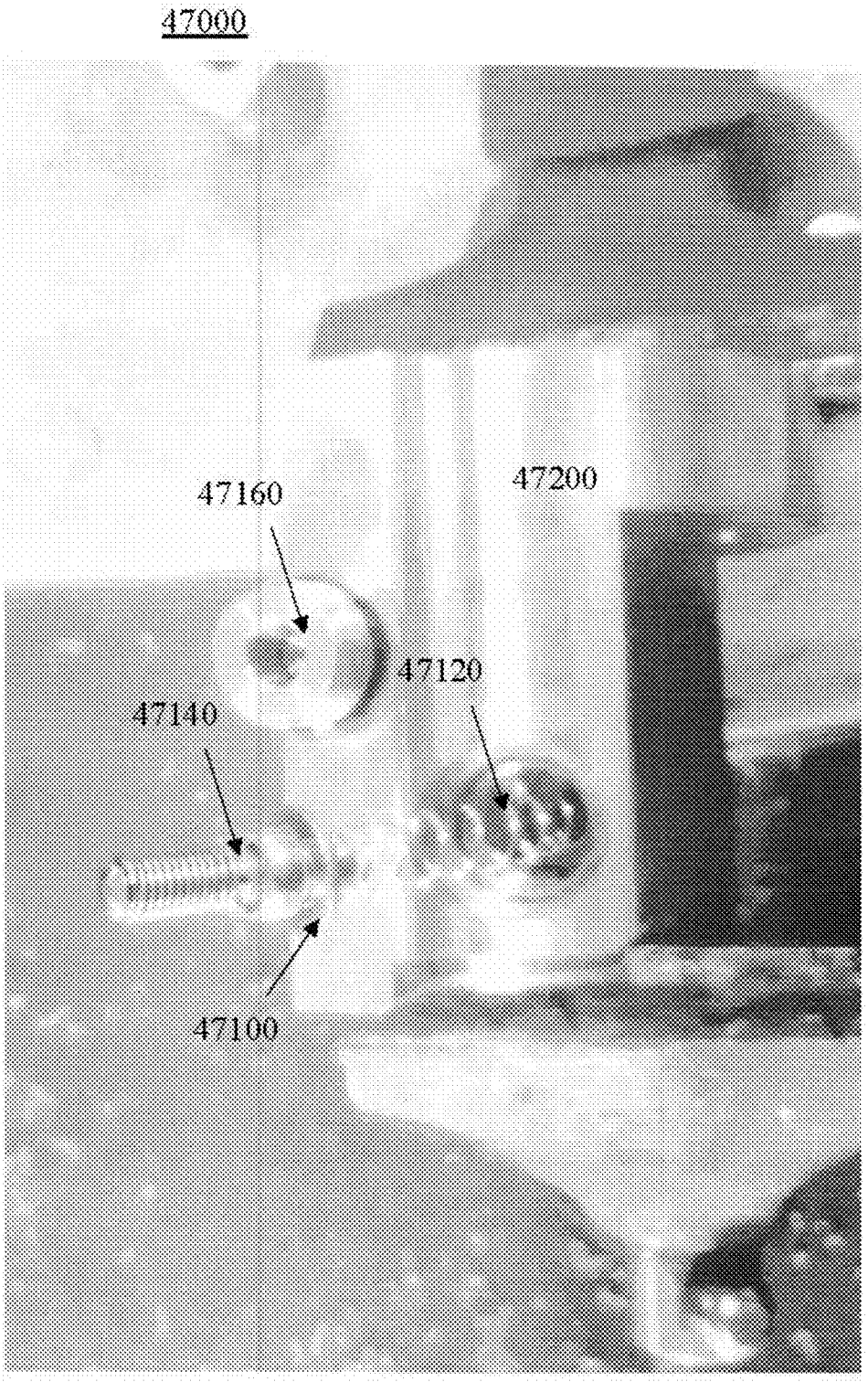
FIG. 47 is a photograph of a perspective view of an exemplary embodiment of a thermostat system 47000.
Figure 48:
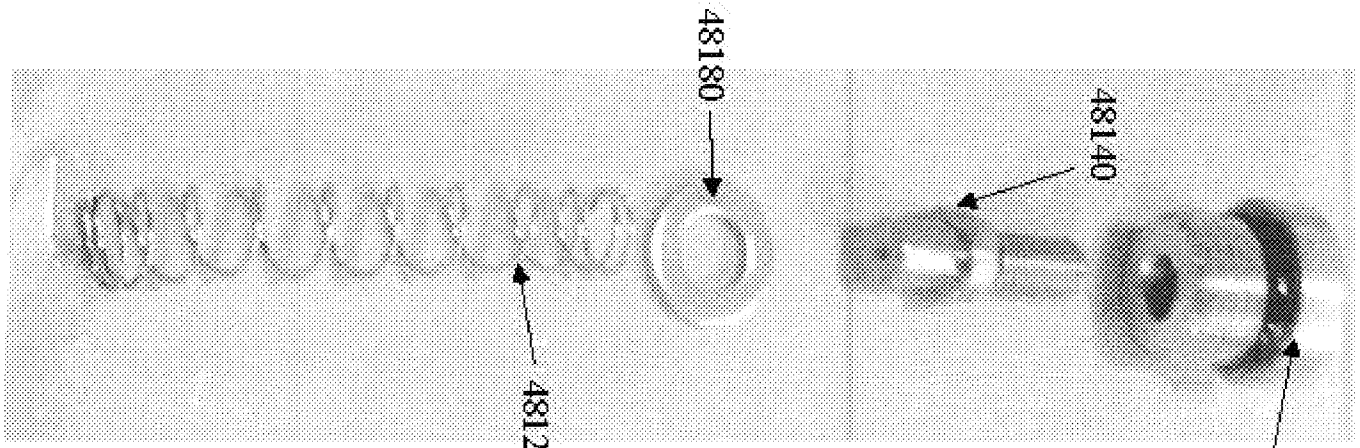
FIG. 48 is a photograph of an exploded view of an exemplary embodiment of an uncoupled thermostat assembly 48000.
Figure 49:
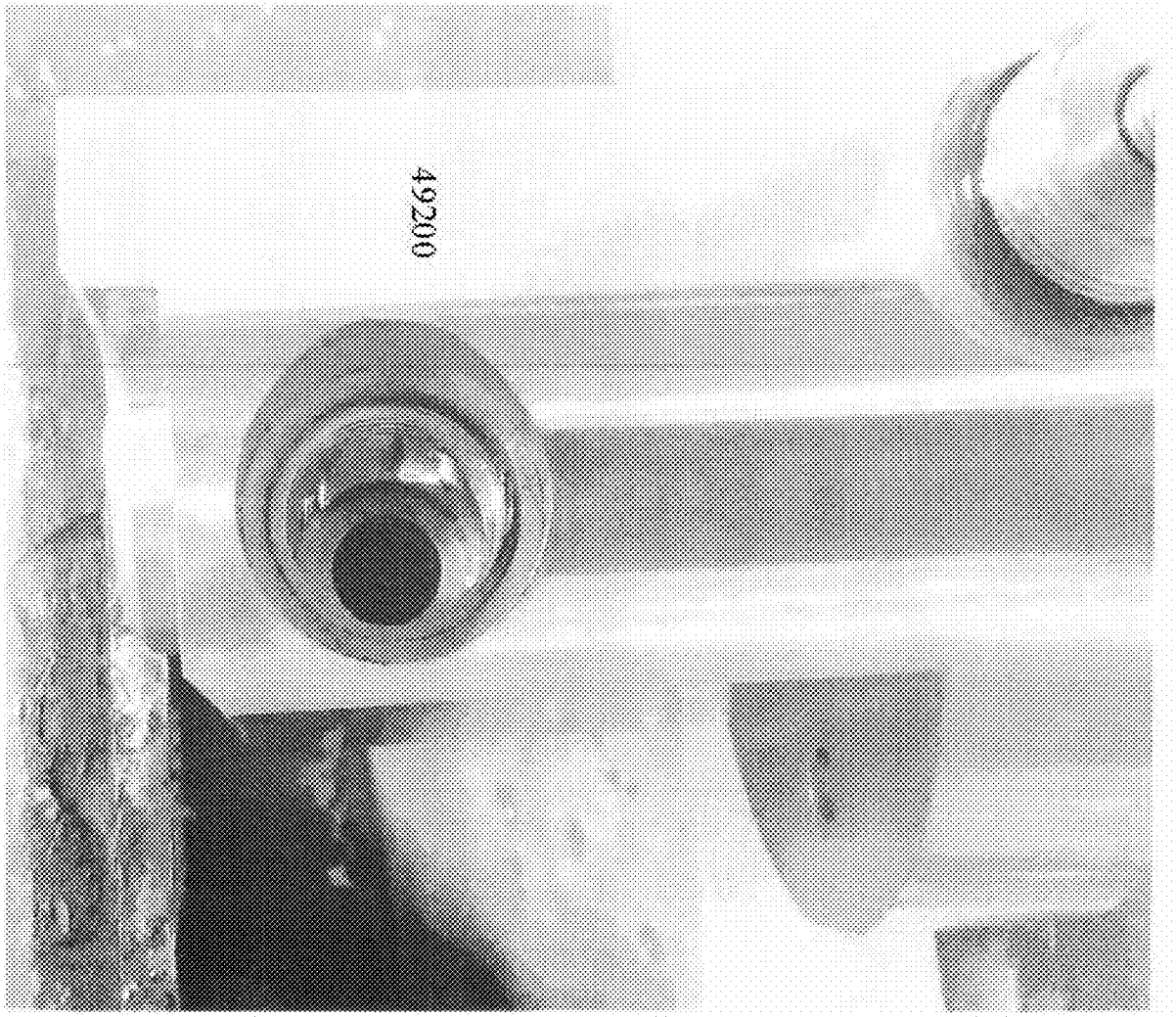
FIG. 49 is a photograph of a perspective view of an exemplary embodiment of a thermostat system 49000.
Figure 50:
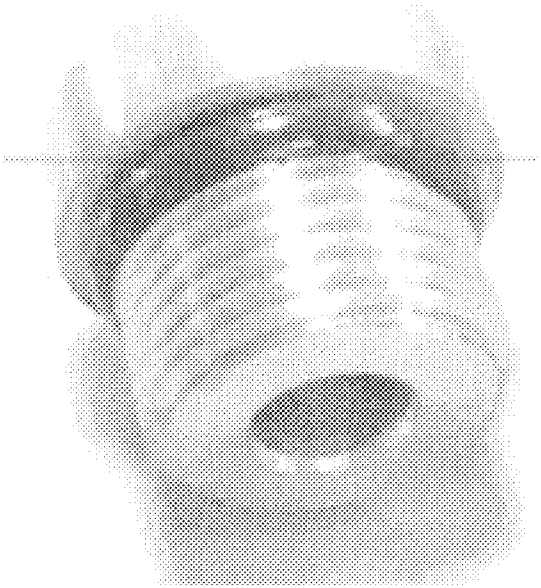
FIG. 50 is a photograph of a perspective view of an exemplary embodiment of a threaded plug 50000.

FIG. 42 is a photograph of a perspective view of an exemplary embodiment of a system 42000. FIG. 43 is a photograph of a perspective view of an exemplary embodiment of a system 43000. FIG. 44 is a photograph of a perspective view of an exemplary embodiment of a system 44000, which illustrates an embodiment in which a thermostat is removed. FIG. 45 is a photograph of a perspective view of an exemplary embodiment of a thermostat system 45000. A thermostat assembly 45100 is coupled to a housing 45200. The thermostat is used to monitor a temperature of a fluid in an engine of a motorcycle. In the illustrated embodiment, thermostat assembly 45200 can be removed from housing 45200 via an Allen wrench. FIG. 46 is a photograph of a perspective view of an exemplary embodiment of a thermostat system 46000. A thermostat assembly 46100 is in the process of being uncoupled from a housing 46200. Thermostat assembly 46100 comprises a spring 46120, a thermostat 46140, and a plug 46160. The thermostat is used to monitor a temperature of a fluid in an engine of a motorcycle. In the illustrated embodiment, thermostat assembly 46200 can be removed from housing 46200. FIG. 47 is a photograph of a perspective view of an exemplary embodiment of a thermostat system 47000. A thermostat assembly 47100 is shown mostly uncoupled coupled to a housing 47200. Thermostat assembly 47100 comprises a spring 47120, a thermostat 47140, and a plug 47160. The thermostat is used to monitor a temperature of a fluid in an engine of a motorcycle. In the illustrated embodiment, thermostat assembly 46200 can be removed from housing 46200. FIG. 48 is a photograph of an exploded view of an exemplary embodiment of an uncoupled thermostat assembly 48000, which comprises a spring 48120, a thermostat 48140, a plug 48160, and a washer 48180. FIG. 49 is a photograph of a perspective view of an exemplary embodiment of a thermostat system 49000, which comprises a housing 49200. A thermostat assembly can be coupled to housing 49200 via a threaded plug. FIG. 50 is a photograph of a perspective view of an exemplary embodiment of a threaded plug 50000, which can be comprised by a thermostat assembly.

Figure 51:
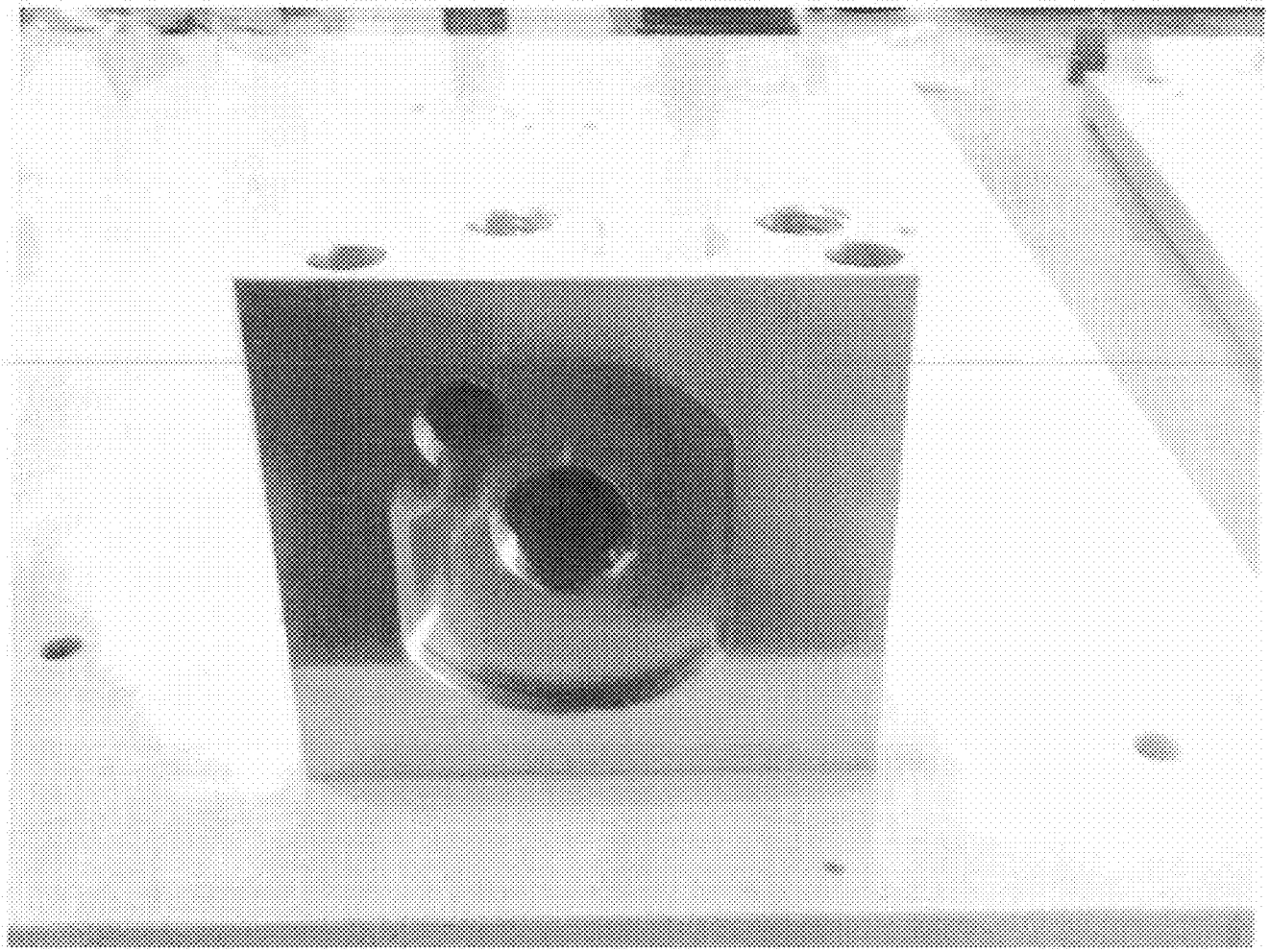
FIG. 51 is a photograph of a perspective view of an exemplary embodiment of a system 51000.
Figure 52:
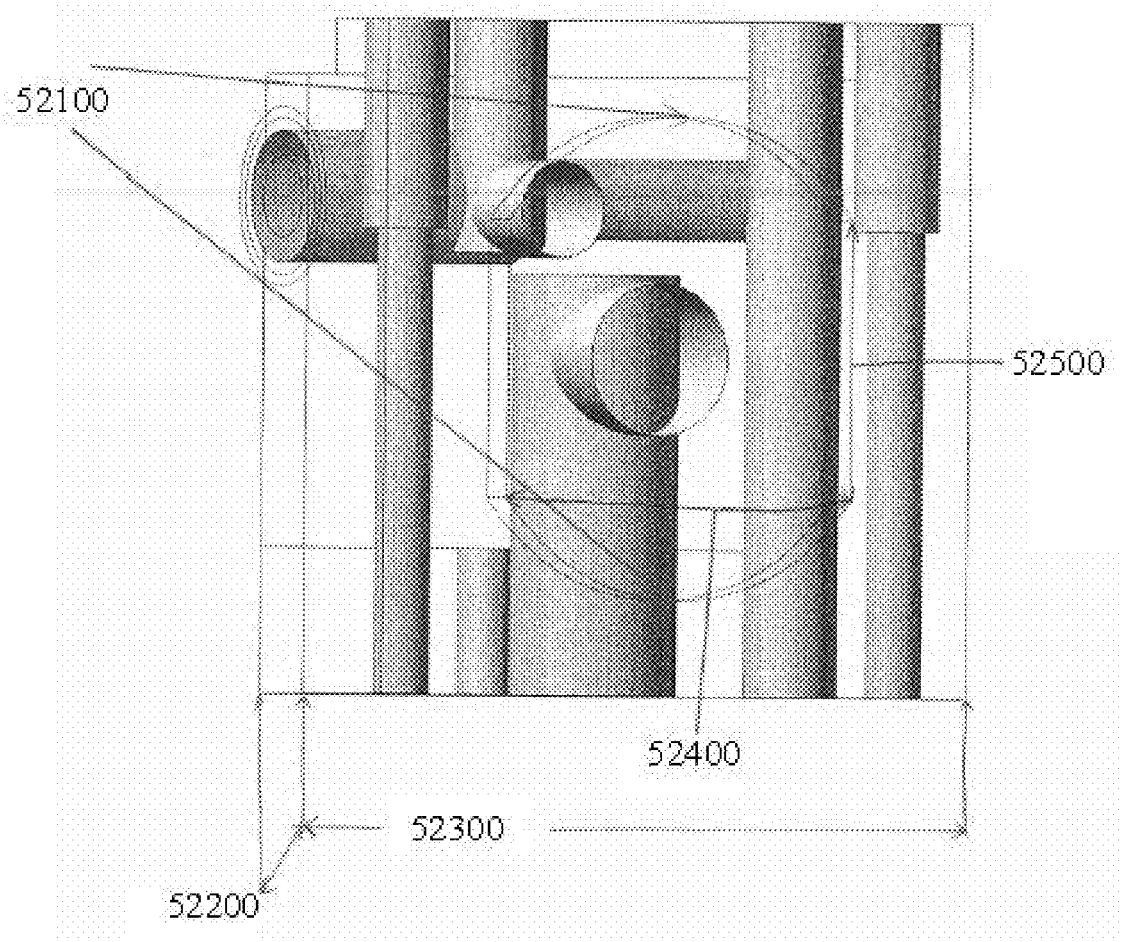
FIG. 52 is a photograph of a perspective view of an exemplary embodiment of a system 52000.

FIG. 51 is a photograph of a perspective view of an exemplary embodiment of a system 51000. FIG. 52 is a photograph of a perspective view of an exemplary embodiment of a system 52000, which shows a set of dimensions for an exemplary embodiment. The set of dimensions comprises a first dimension 52100, a second dimension 52200, a third dimension 52300, a fourth dimension 52400, and a fifth dimension 52500. The illustrated dimensions can be any dimensions appropriate for a particular motorcycle 90-degree oil filter adapter with thermostat channels. For example, in certain exemplary embodiments:

first dimension 52100 can be approximately 2.140 inches;
second dimension 52200 can be approximately 0.510 inches;
third dimension 52300 can be approximately 3.230 inches;
fourth dimension 52400 can be approximately 1.745 inches; and/or
fifth dimension 52500 can be approximately 1.250 inches.

Figure 53:
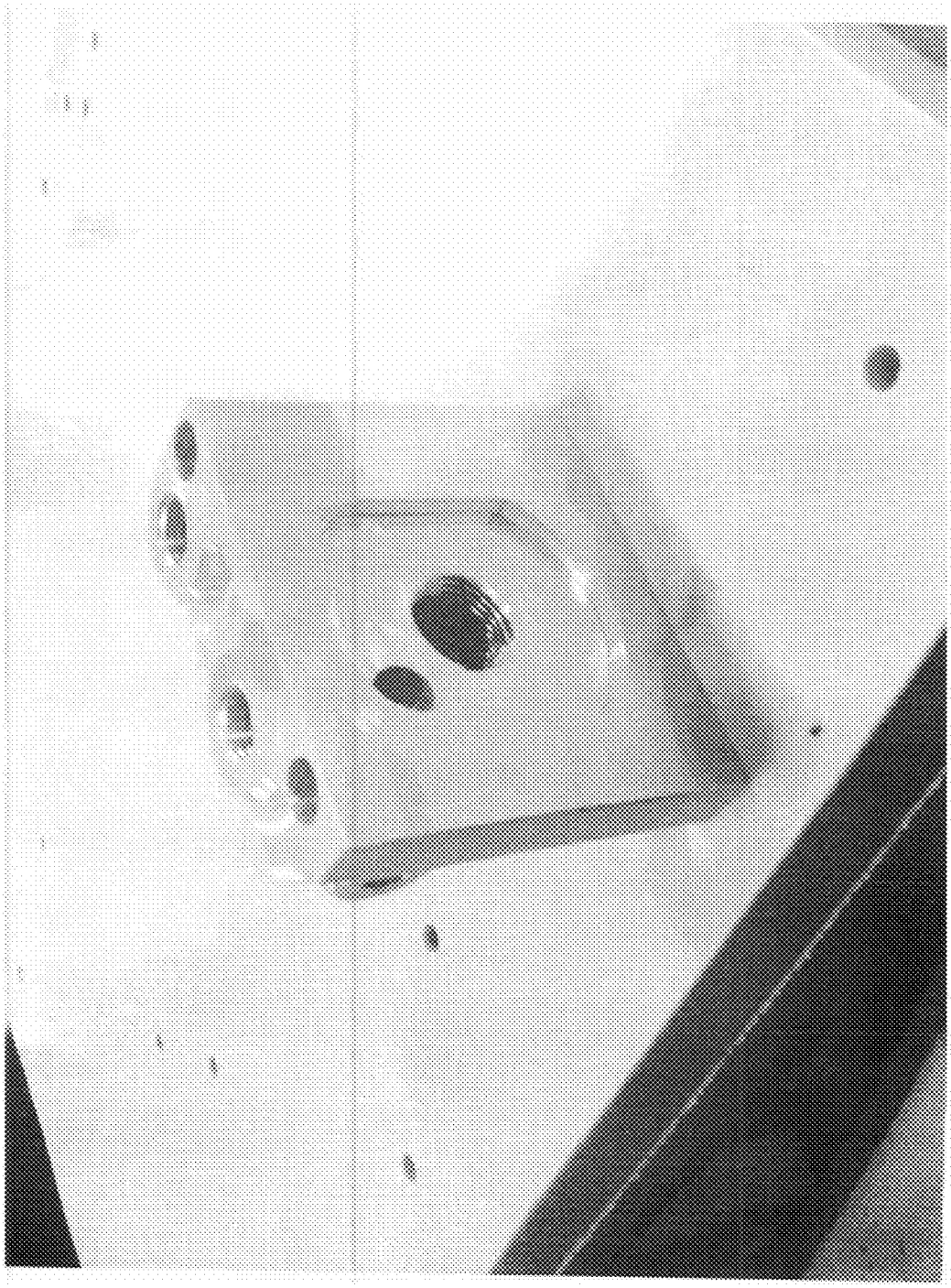
FIG. 53 is a photograph of a perspective view of an exemplary embodiment of a system 53000.
Figure 54:
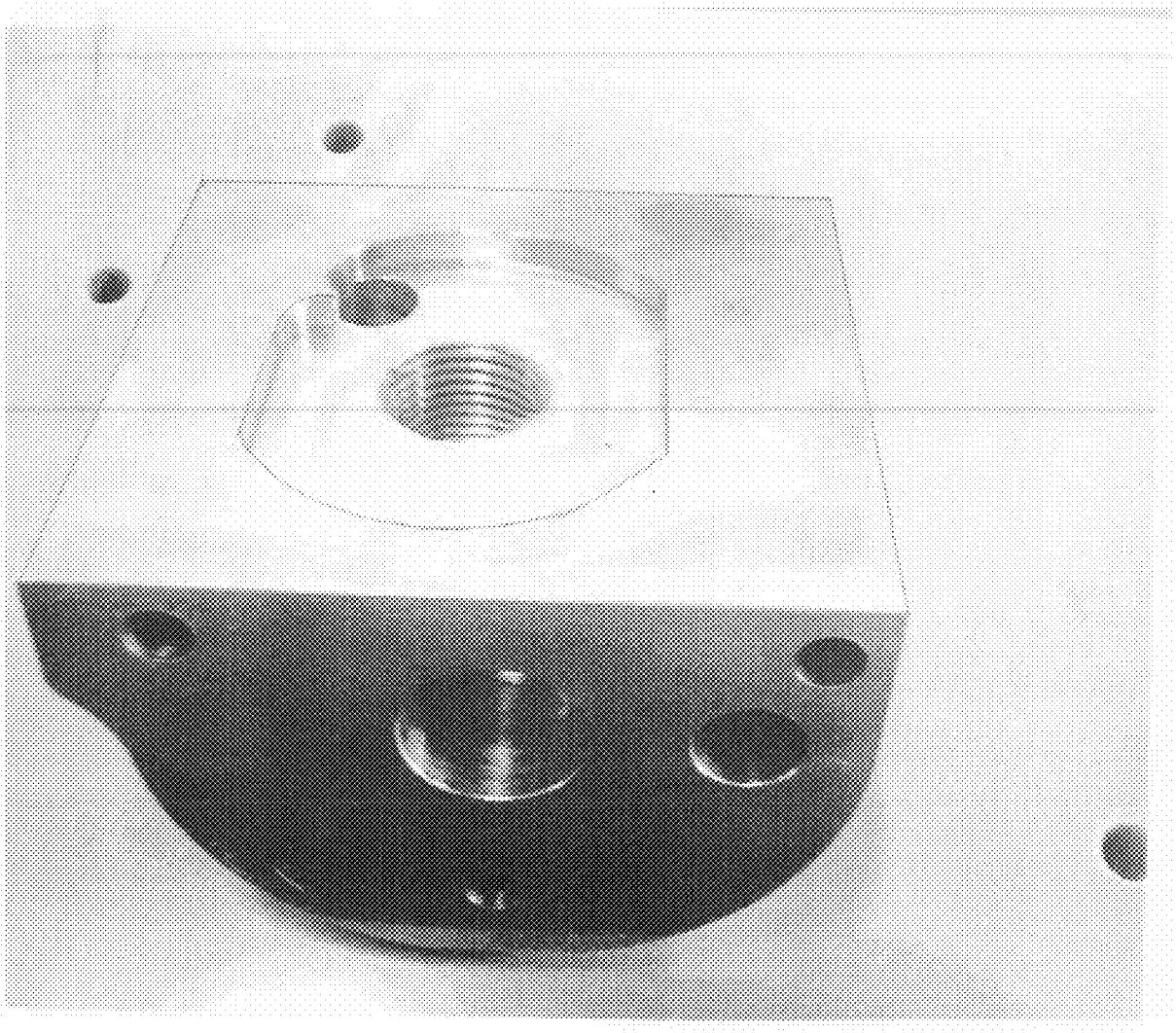
FIG. 54 is a photograph of a perspective view of an exemplary embodiment of a system 54000.

FIG. 53 is a photograph of a perspective view of an exemplary embodiment of a system 53000. FIG. 54 is a photograph of a perspective view of an exemplary embodiment of a system 54000.

Figure 55:
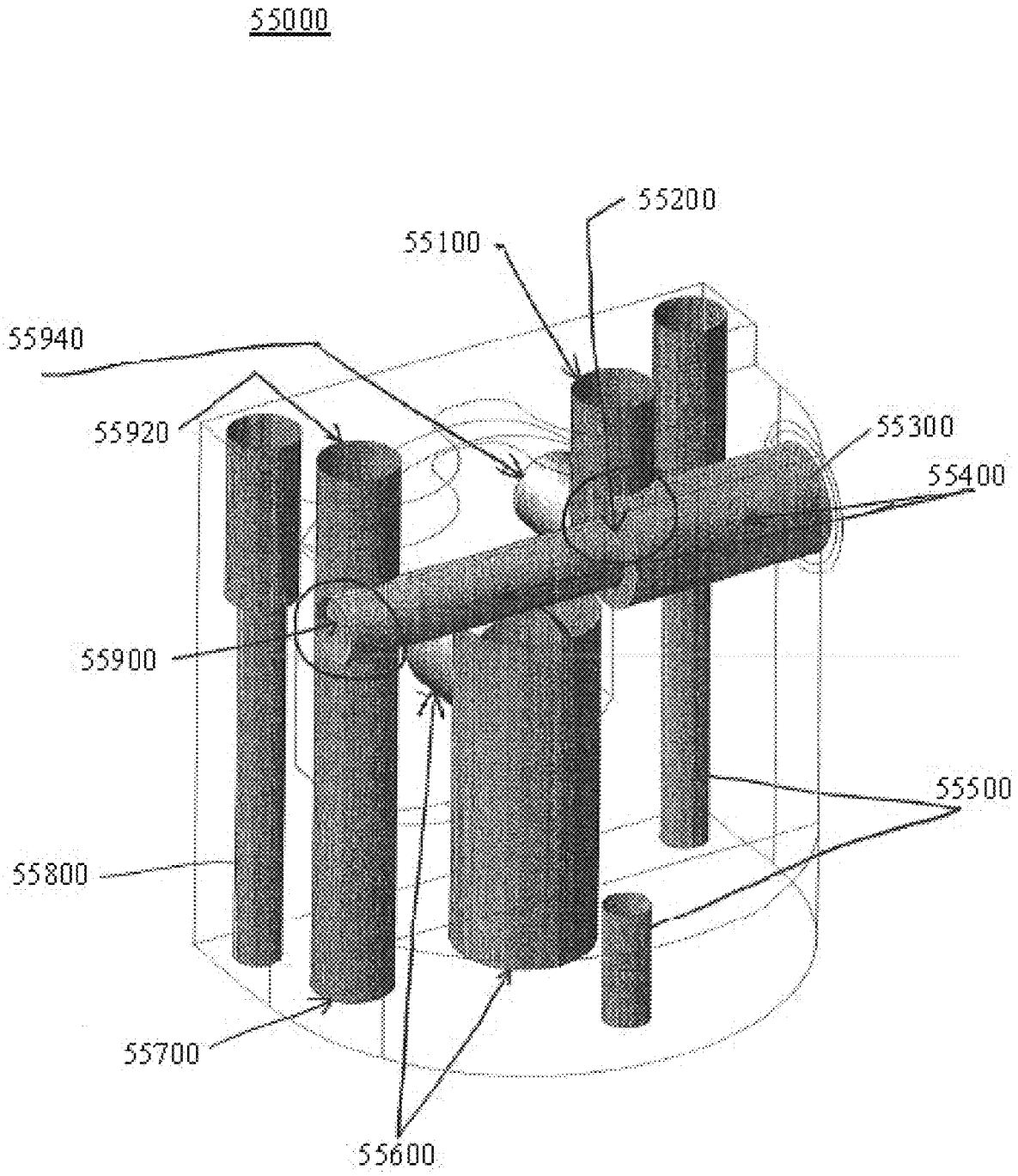
FIG. 55 is a photograph of a perspective view of an exemplary embodiment of a system 55000.

FIG. 55 is a photograph of a perspective view of an exemplary embodiment of a system 55000, which illustrates a view of an exemplary heat exchanger structure comprising:

a return oil channel 55100 from a heat exchanger;
a thermostat routing chamber 55200, which is open at operating temperatures below approximately 180 degrees Fahrenheit and closed at temperatures above approximately 180 degrees Fahrenheit;
a thermostat holding chamber 55300;
a thermostat channel 55400;
mounting channels 55500;
a return channel 55600 from an oil filter to an engine of a motorcycle;
an oil pressure channel 55700 from the engine of the motorcycle;
a mounting channel 55800;
a routing connection 55900 from oil pressure channel 55700 to thermostat channel 55400;
an oil pressure channel 55920 to heat exchanger; and
a return oil channel 55940 from the heat exchanger to the oil filter.

Figure 56:
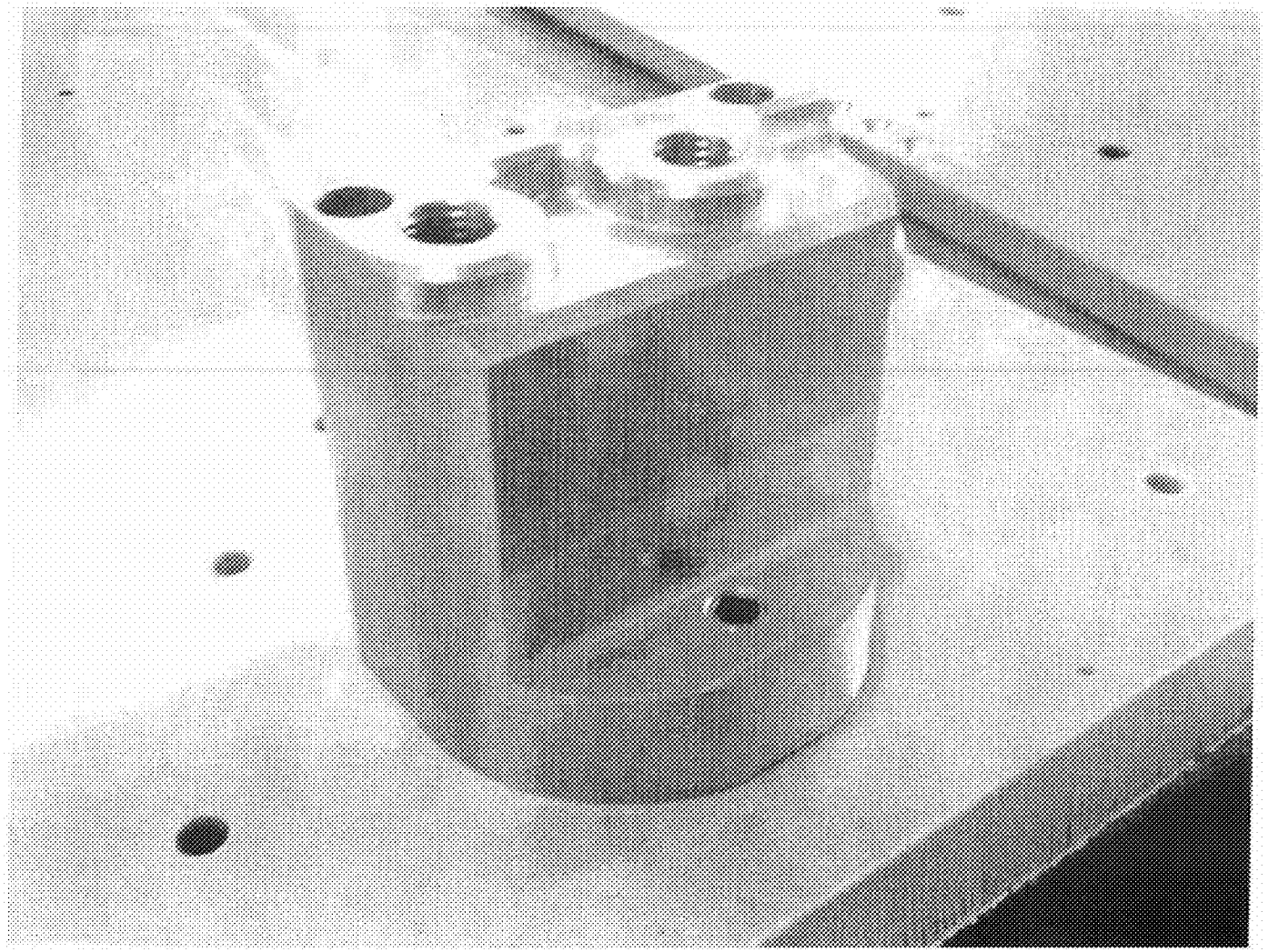
FIG. 56 is a photograph of a perspective view of an exemplary embodiment of a system 56000.
Figure 57:
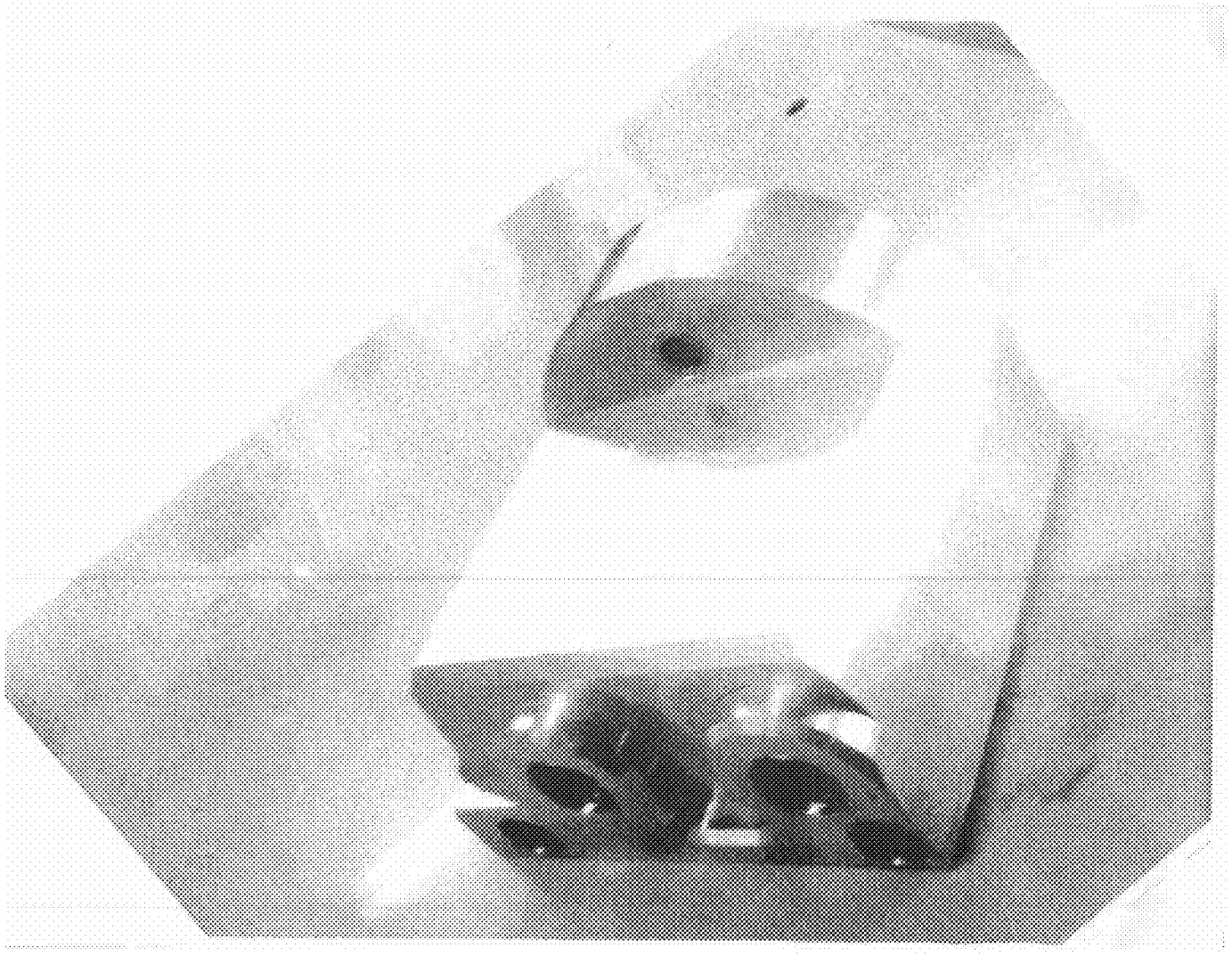
FIG. 57 is a photograph of a perspective view of an exemplary embodiment of a system 57000.
Figure 58:
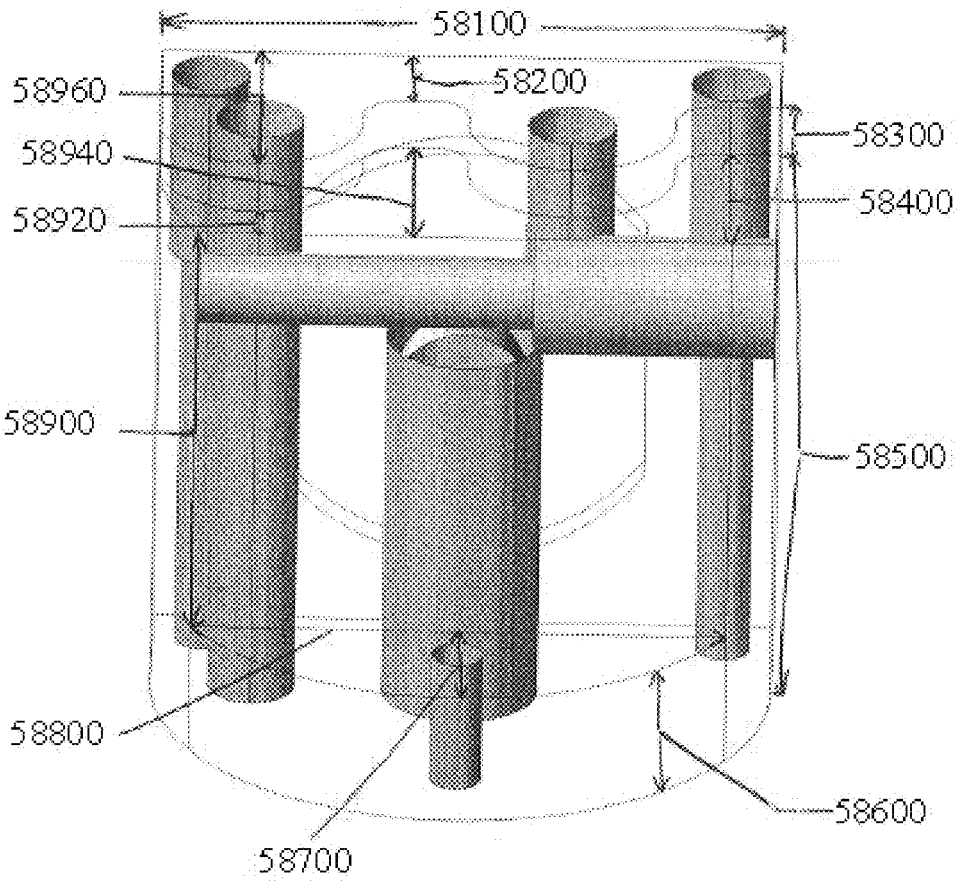
FIG. 58 is a photograph of a perspective view of an exemplary embodiment of a system 58000.

FIG. 56 is a photograph of a perspective view of an exemplary embodiment of a system 56000. FIG. 57 is a photograph of a perspective view of an exemplary embodiment of a system 57000. FIG. 58 is a photograph of a perspective view of an exemplary embodiment of a system 58000, which shows a set of dimensions for an exemplary embodiment. The set of dimensions comprises a first dimension 58100, a second dimension 58200, a third dimension 58300, a fourth dimension 58400, a fifth dimension 58500, a sixth dimension 58600, a seventh dimension 58700, an eighth dimension 58800, a ninth dimension 58900, a tenth dimension 58920, an eleventh dimension 58940, and a twelfth dimension 58960. The illustrated dimensions can be any dimensions appropriate for a particular motorcycle heat exchanger. For example, in certain exemplary embodiments:

first dimension 58100 can be approximately 3.23 inches;
second dimension 58200 can be approximately 0.262 inches;
third dimension 58300 can be approximately 0.24 inches;
fourth dimension 58400 can be approximately 0.990 inches;
fifth dimension 58500 can be approximately 2.740 inches;
sixth dimension 58600 can be approximately 0.745 inches;
seventh dimension 58700 can be approximately 0.750 inches;
eighth dimension 58800 can be approximately 2.600 inches;
ninth dimension 58900 can be approximately 2.000 inches;
tenth dimension 58920 can be approximately 0.248 inches;
eleventh dimension 58940 can be approximately 1.240 inches; and/or
twelfth dimension 58960 can be approximately 1.254 inches.

Figure 59:
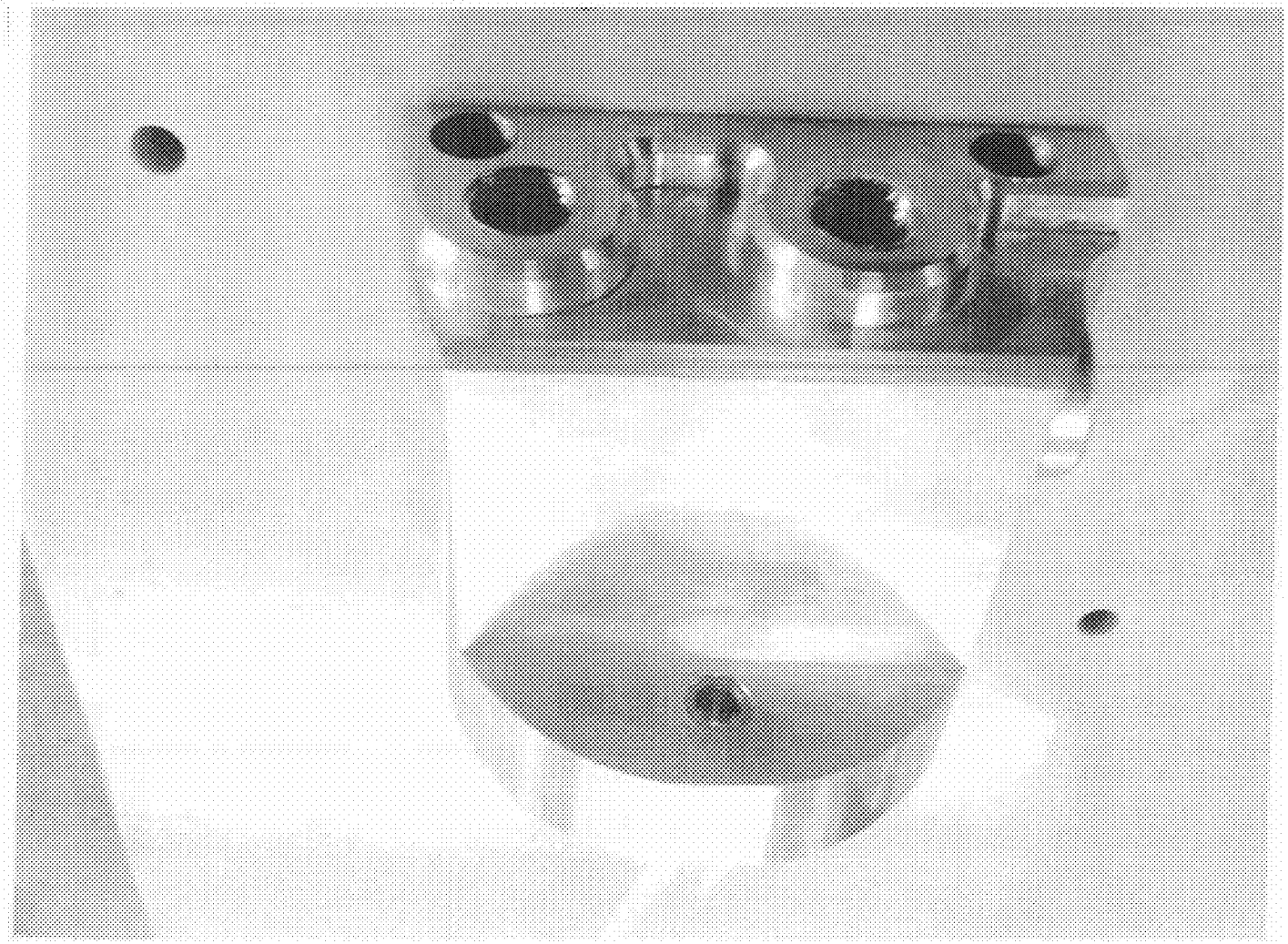
FIG. 59 is a photograph of a perspective view of an exemplary embodiment of a system 59000.
Figure 60:
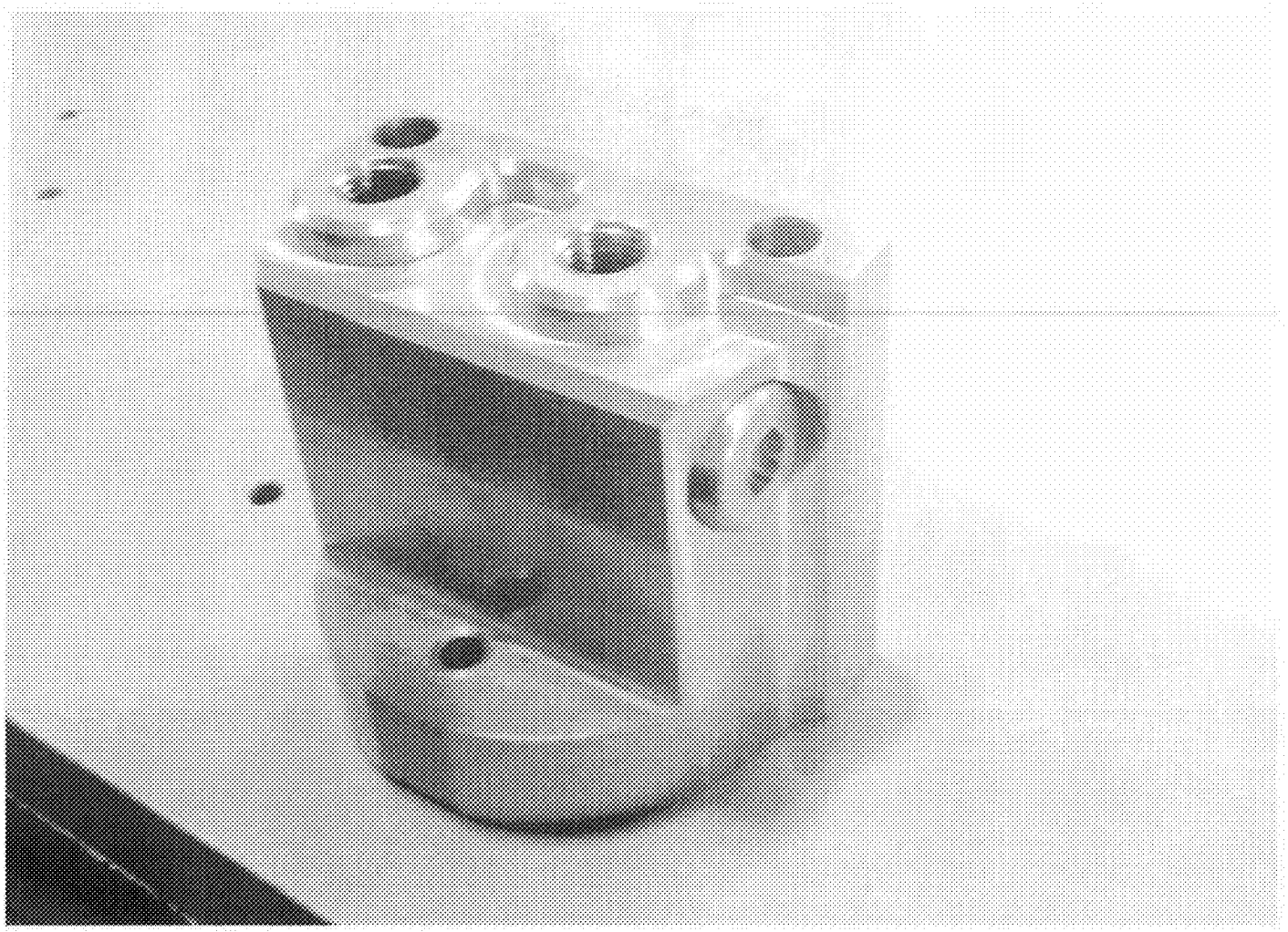
FIG. 60 is a photograph of a perspective view of an exemplary embodiment of a system 60000.
Figure 61:
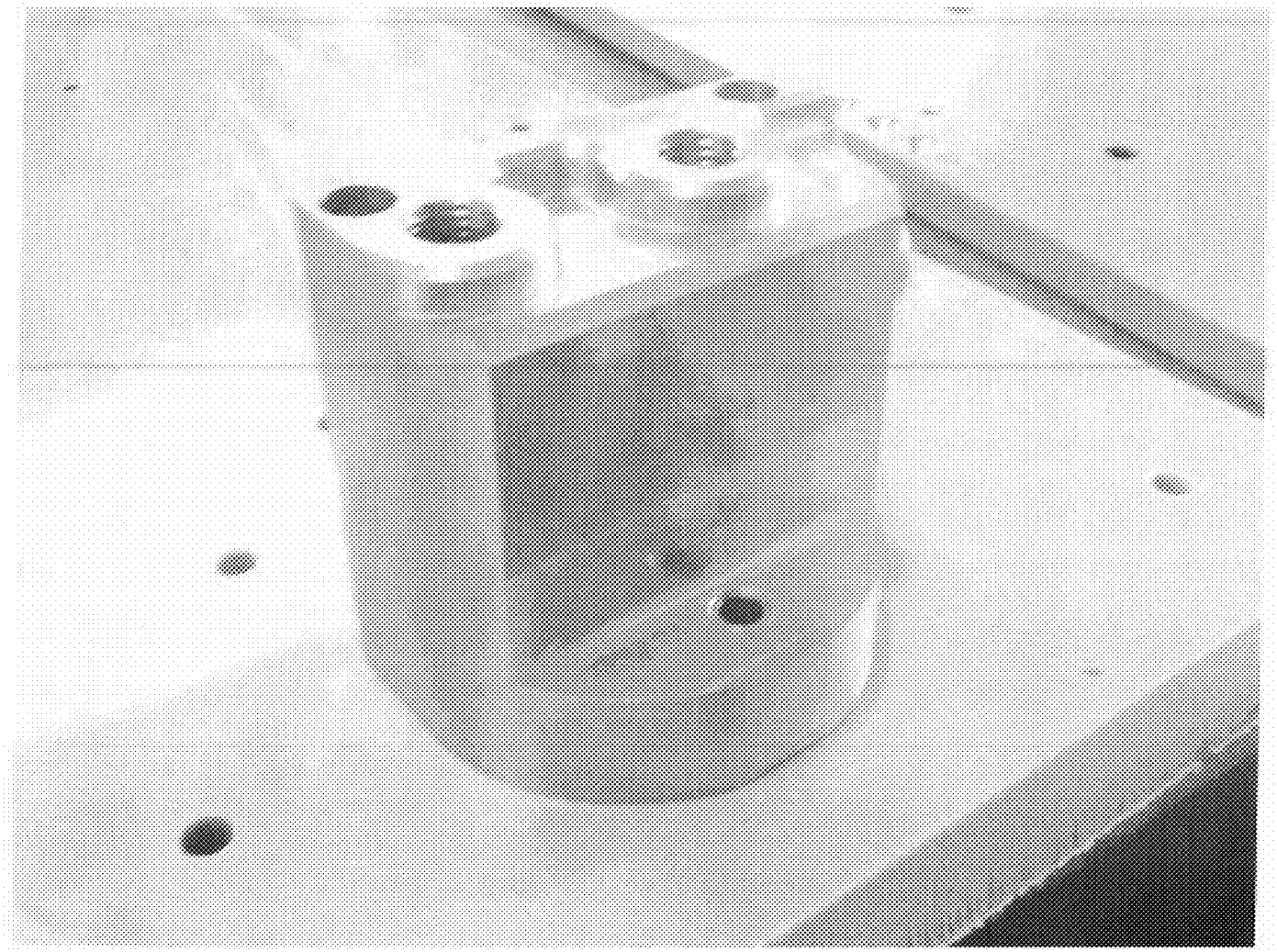
FIG. 61 is a photograph of a perspective view of an exemplary embodiment of a system 61000.
Figure 62:
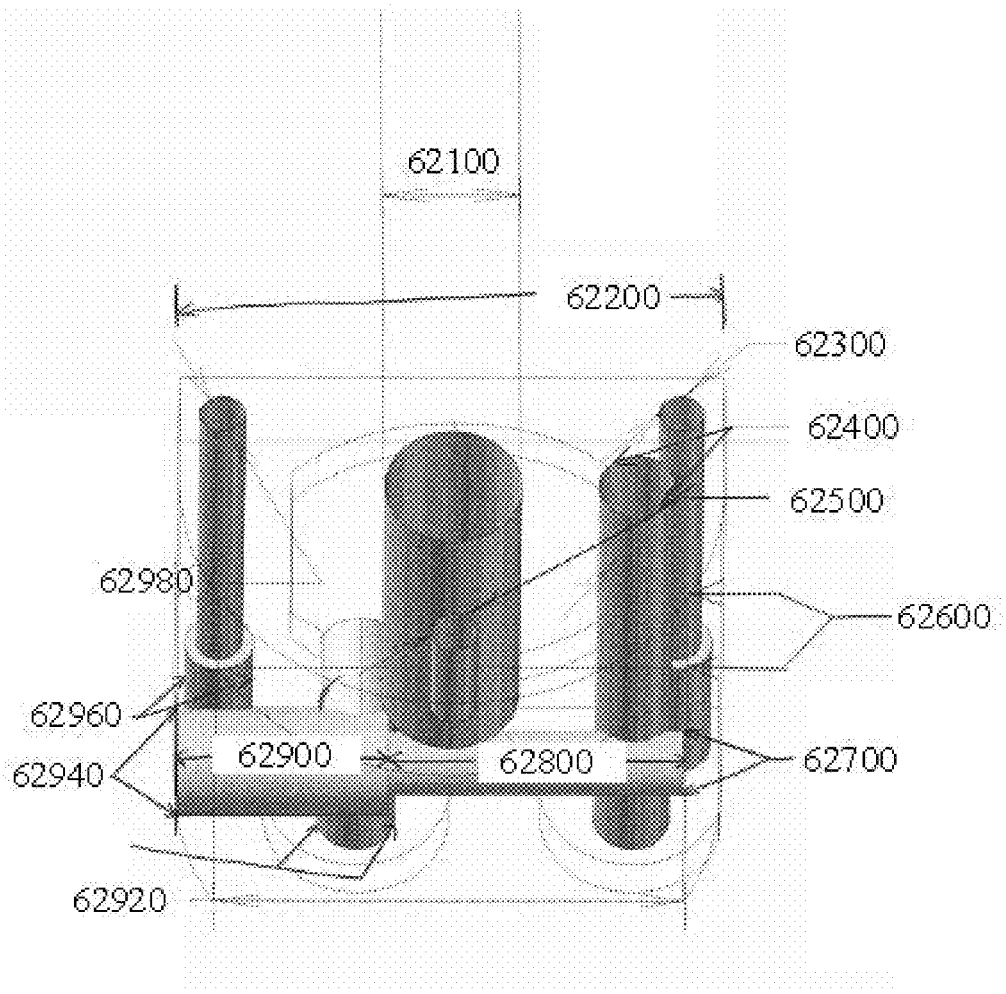
FIG. 62 is a photograph of a perspective view of an exemplary embodiment of a system 62000.

FIG. 59 is a photograph of a perspective view of an exemplary embodiment of a system 59000. FIG. 60 is a photograph of a perspective view of an exemplary embodiment of a system 60000. FIG. 61 is a photograph of a perspective view of an exemplary embodiment of a system 61000. FIG. 62 is a photograph of a perspective view of an exemplary embodiment of a system 62000, which shows a set of dimensions for an exemplary embodiment. The set of dimensions comprises a first dimension 62100, a second dimension 62200, a third dimension 62300, a fourth dimension 62400, a fifth dimension 62500, a sixth dimension 62600, a seventh dimension 62700, an eighth dimension 62800, a ninth dimension 62900, a tenth dimension 62920, an eleventh dimension 62940, a twelfth dimension 62960, thirteenth dimension 62940, and a fourteenth dimension 62960. The illustrated dimensions can be any dimensions appropriate for a particular motorcycle 90-degree oil filter adapter. For example, in certain exemplary embodiments:

- first dimension 62100 can be approximately 0.75 inches;
- second dimension 62200 can be approximately 3.230 inches;
- third dimension 62300 can be approximately 0.250 inches;
- fourth dimension 62400 can be approximately 0.422 inches;
- fifth dimension 62500 can be approximately 0.250 inches;
- sixth dimension 62600 can be approximately 0.745 inches;
- seventh dimension 62700 can be approximately 0.3125 inches;
- eighth dimension 62800 can be approximately 1.4460 inches;
- ninth dimension 62900 can be approximately 1.1585 inches;
- tenth dimension 62920 can be approximately 2.600 inches;
- eleventh dimension 62940 can be approximately 0.422 inches;
- twelfth dimension 62960 can be approximately 0.800 inches;
- thirteenth dimension 62940 can be approximately 0.378 inches; and/or
- fourteenth dimension 62960 can be approximately 0.250 inches.

Figure 63:
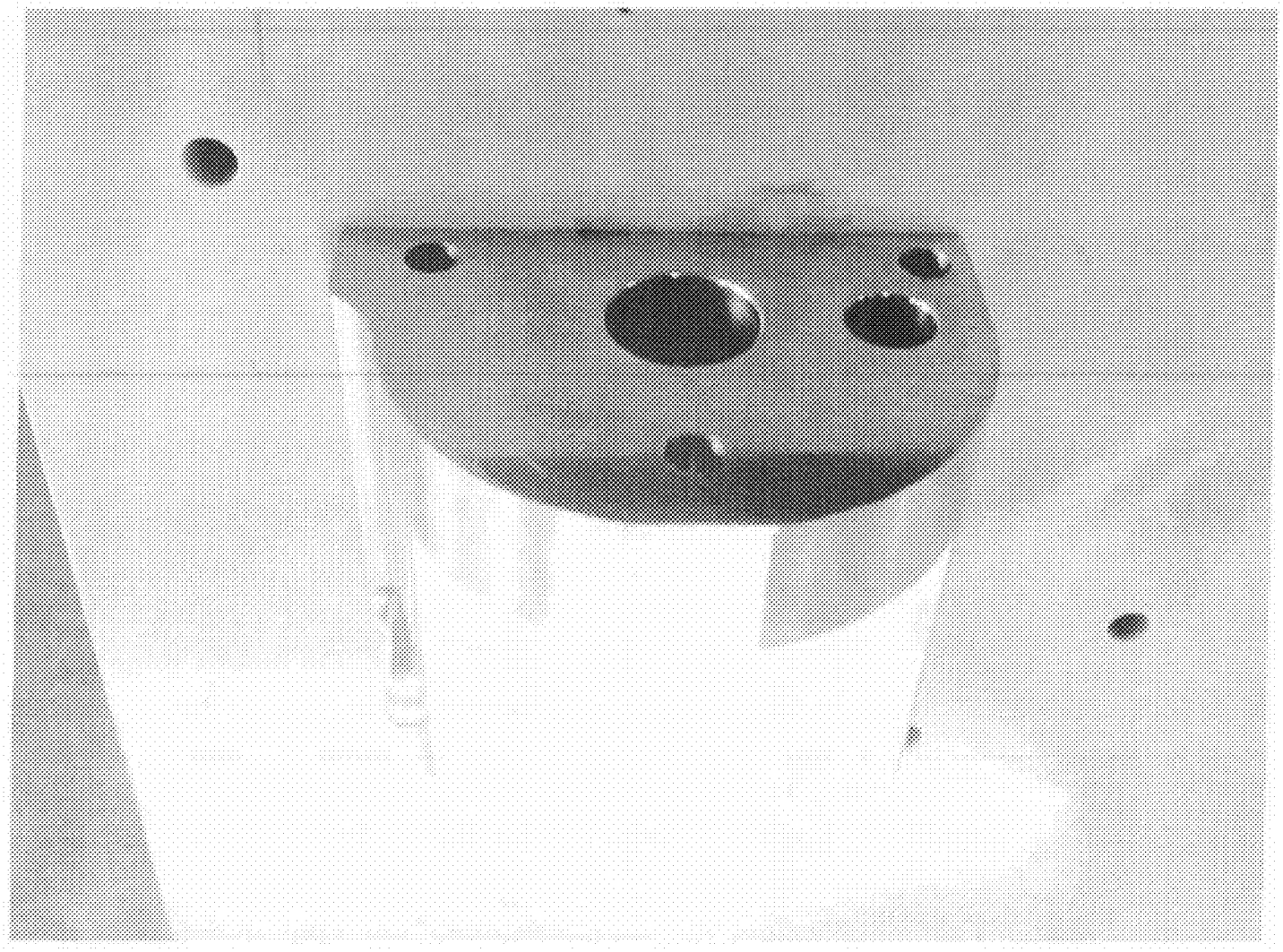
FIG. 63 is a photograph of a perspective view of an exemplary embodiment of a system 63000.
Figure 64:
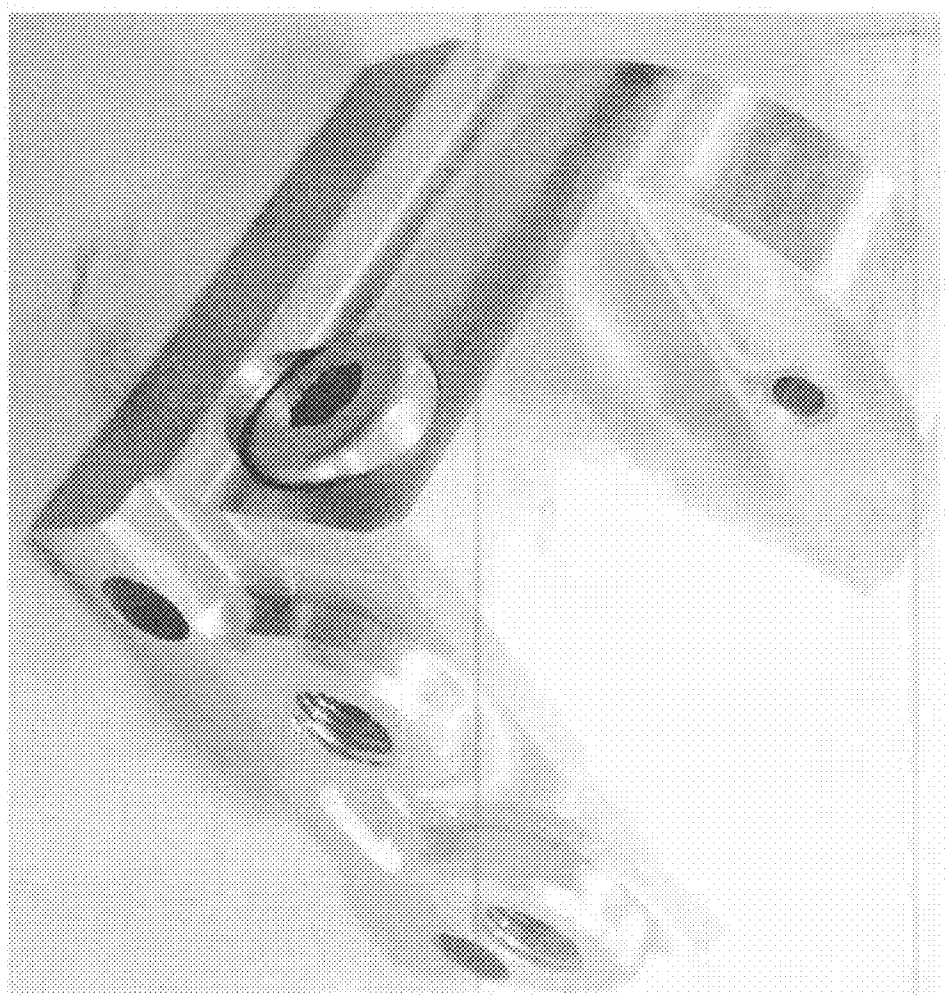
FIG. 64 is a photograph of a perspective view of an exemplary embodiment of a system 64000.
Figure 65:
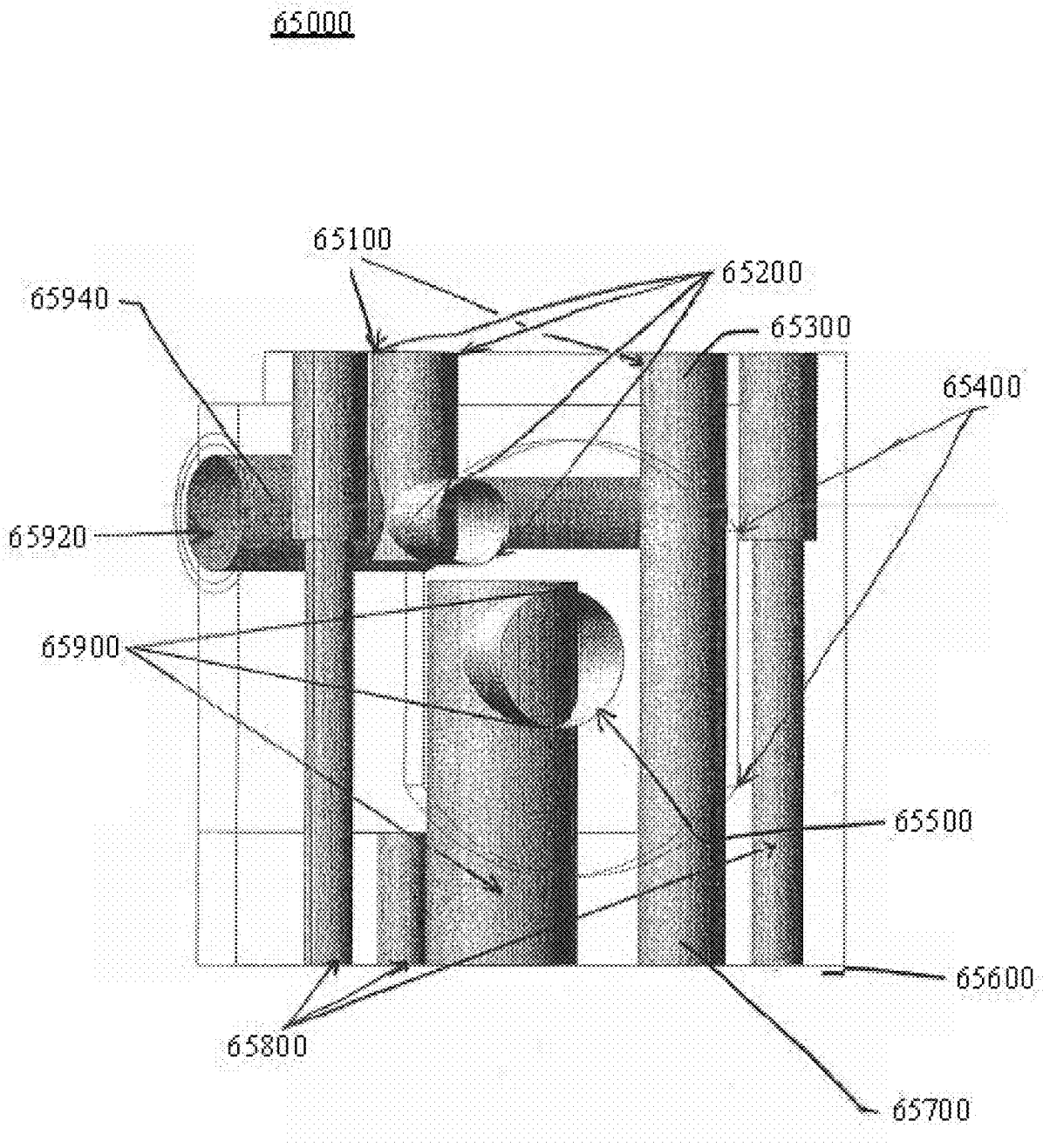
FIG. 65 is a photograph of a perspective view of an exemplary embodiment of a system 65000.

FIG. 63 is a photograph of a perspective view of an exemplary embodiment of a system 63000. FIG. 64 is a photograph of a perspective view of an exemplary embodiment of a system 64000. FIG. 65 is a photograph of a perspective view of an exemplary embodiment of a system 65000, which illustrates a view of an exemplary heat exchanger structure comprising:

- threaded holes 65100, which in the illustrated embodiment can be for a nominal ¼ inch national pipe thread fitting;
- a return oil channel 65200 from a heat exchanger or thermostat routing chamber depending on oil temperature;
- an oil pressure channel 65300 to the heat exchanger;
- an inlet bath 65400 to an oil filter;
- a threaded hole 65500 for the oil filter attachment, which can be a double tap bushing;
- an oil/heat resistant fiber gasket 65600;
- an oil pressure channel 65700 from the engine of the motorcycle;
- mounting channels 65800;
- a return channel 65900 from the oil filter to the engine of the motorcycle;
- an threaded hole 65920 for a thermostat chamber plug; and
- a thermostat holding chamber 65940.

Figure 66:
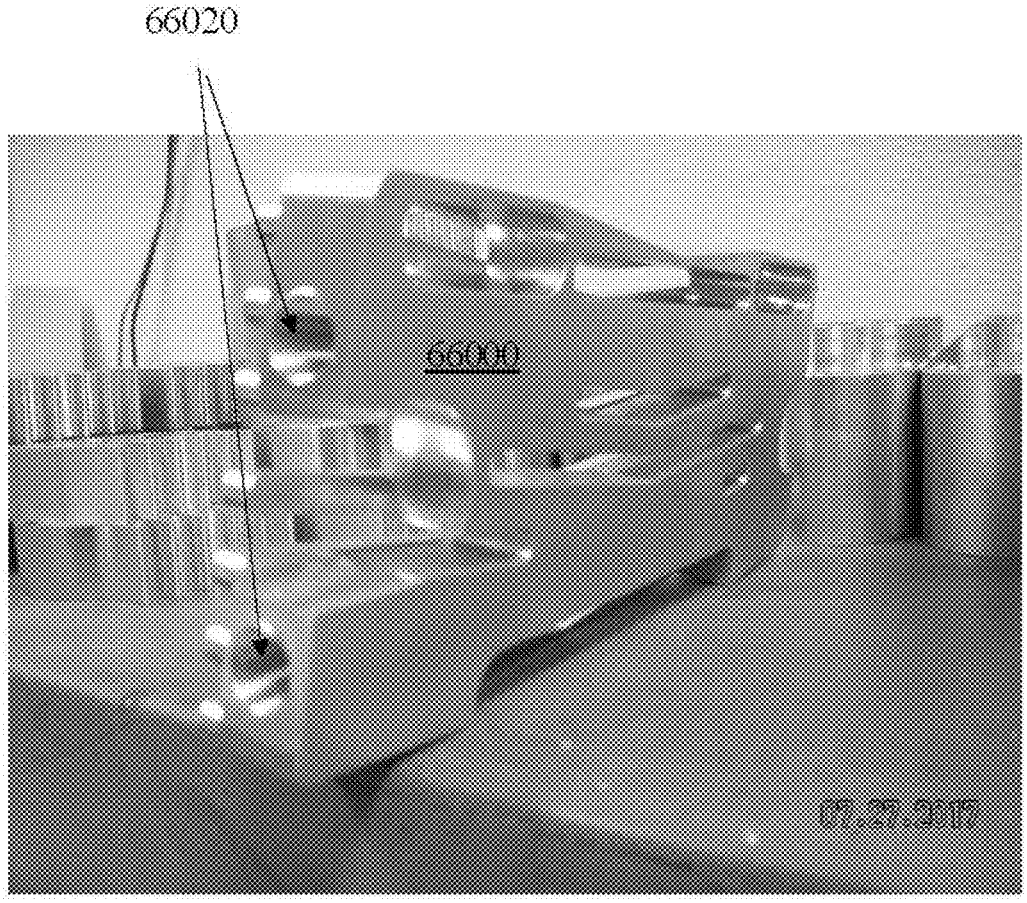

FIG. 66 is a photograph of a perspective view of an exemplary embodiment of a heat exchanger 66000, which is a heat exchanger constructed to be coupled to a motorcycle or slingshot motorcycle. Heat exchanger 66000 defines ports 66020 to which fluid lines (e.g., engine coolant and/or oil lines) from the motorcycle or slingshot motorcycle can be coupled. When operatively coupled to the motorcycle or slingshot motorcycle, heat exchanger 66000 provides conductive and convective heat transfer services that result in a reduced operating temperature for the motorcycle or slingshot motorcycle.

Figure 67:
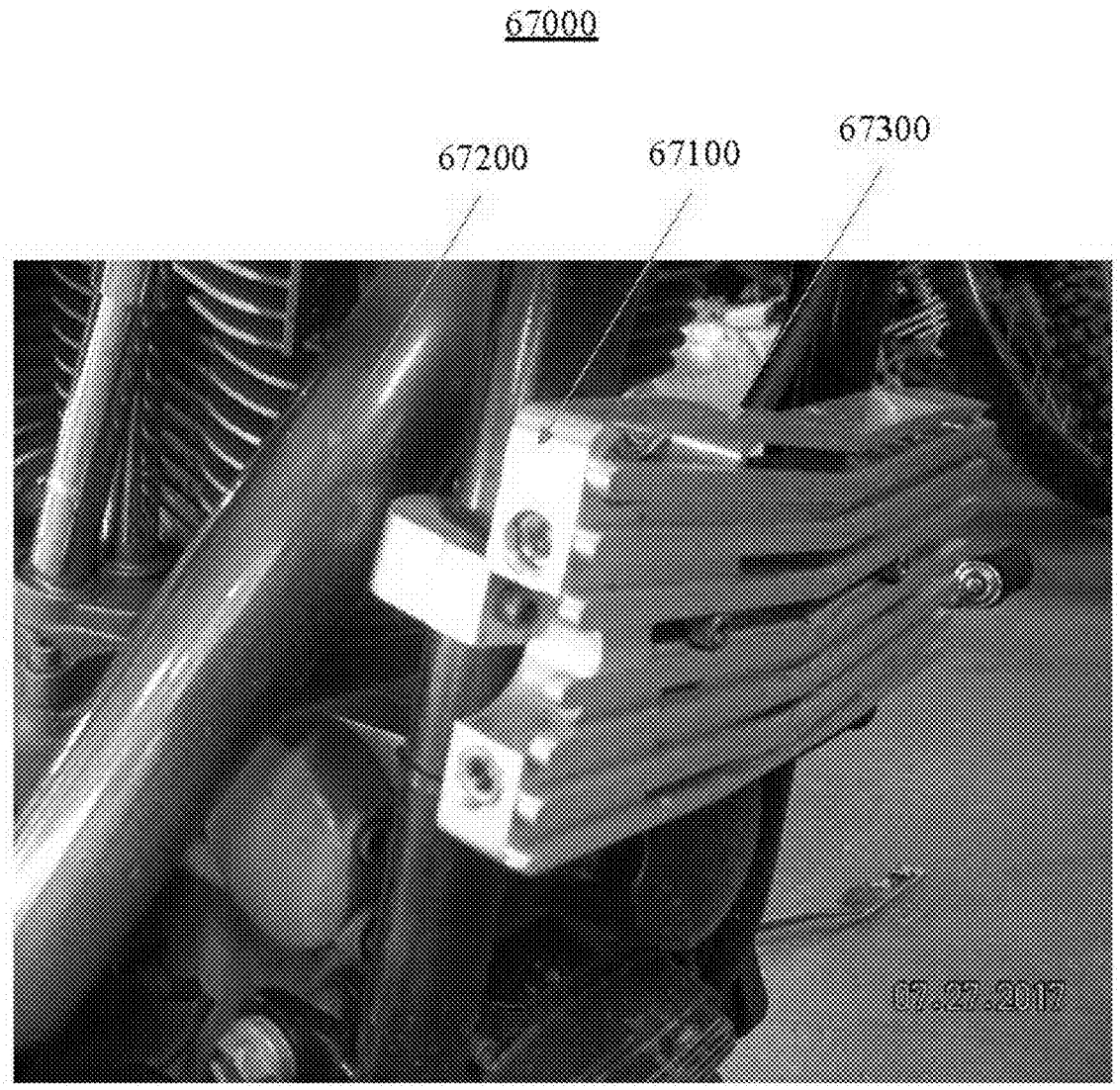

FIG. 67 is a photograph of a perspective view of an exemplary embodiment of a system 67000, which illustrates an exemplary heat exchanger 67100 coupled to an exemplary motorcycle frame. Heat exchanger 67100 receives heat from an engine of motorcycle 67200 primarily from conductive heat transfer and dissipates heat via heat exchange surfaces 67300 primarily via convection.

Figure 68:
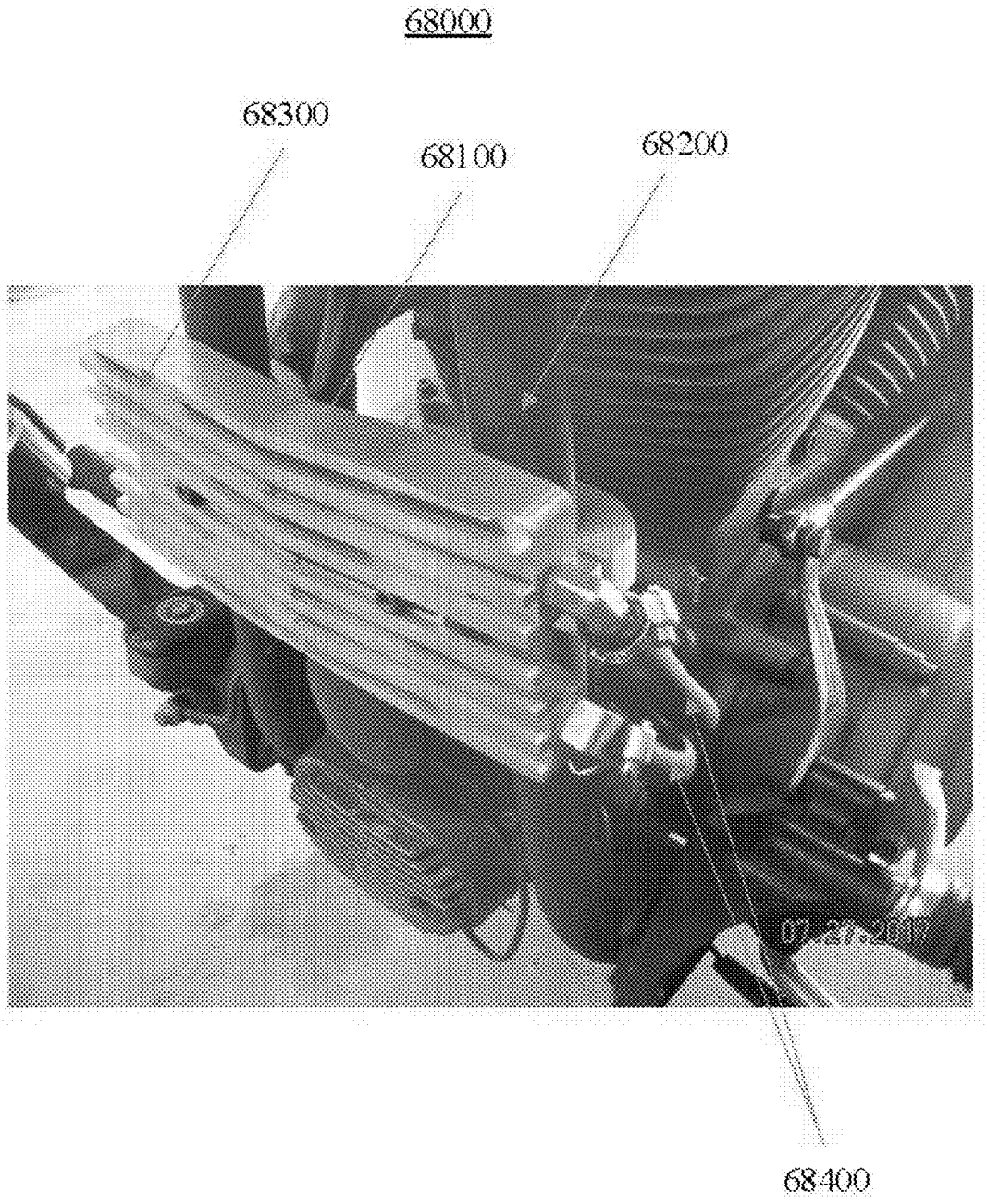

FIG. 68 is a photograph of a perspective view of an exemplary embodiment of a system 68000, which illustrates an exemplary heat exchanger 68100 coupled (via bolts) to a frame of an exemplary motorcycle 68200. As illustrated, fluid lines 68400 (e.g., engine coolant and/or oil lines) can be coupled to the heat exchanger. Fluid flows through passages defined by heat exchanger 68100 and thereby receives heat energy from an engine of motorcycle 68200. Surfaces of heat exchanger 68100 transfer the heat energy to air surrounding motorcycle 68200 primarily via convection through a plurality of fins 68300.

Figure 69:
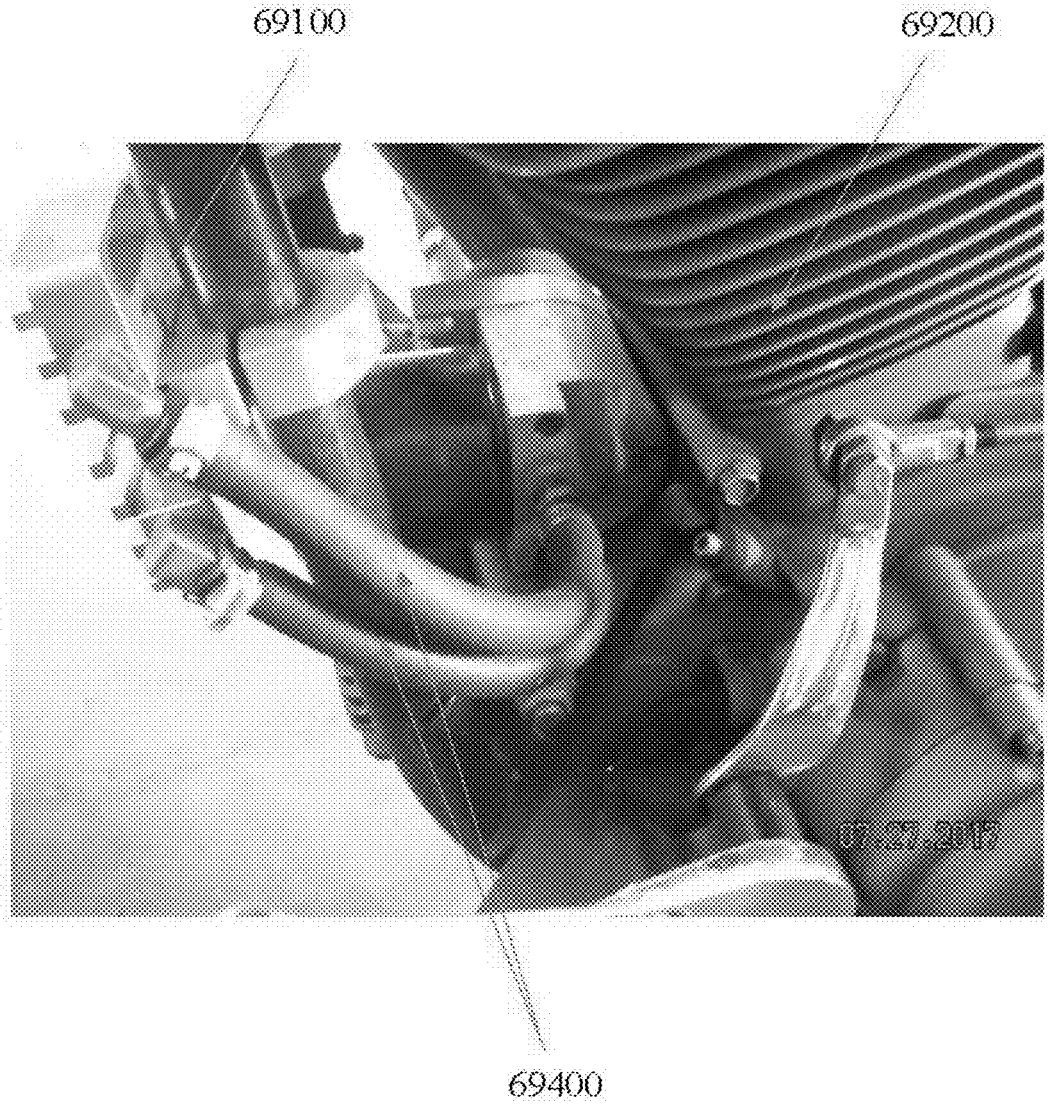

FIG. 69 is a photograph of a perspective view of an exemplary embodiment of a system 69000, which illustrates fluid lines 69400 coupled to a heat exchanger 69100. Heat exchanger 69100 dissipates heat generated from an engine of a motorcycle 69200.

Figure 70:
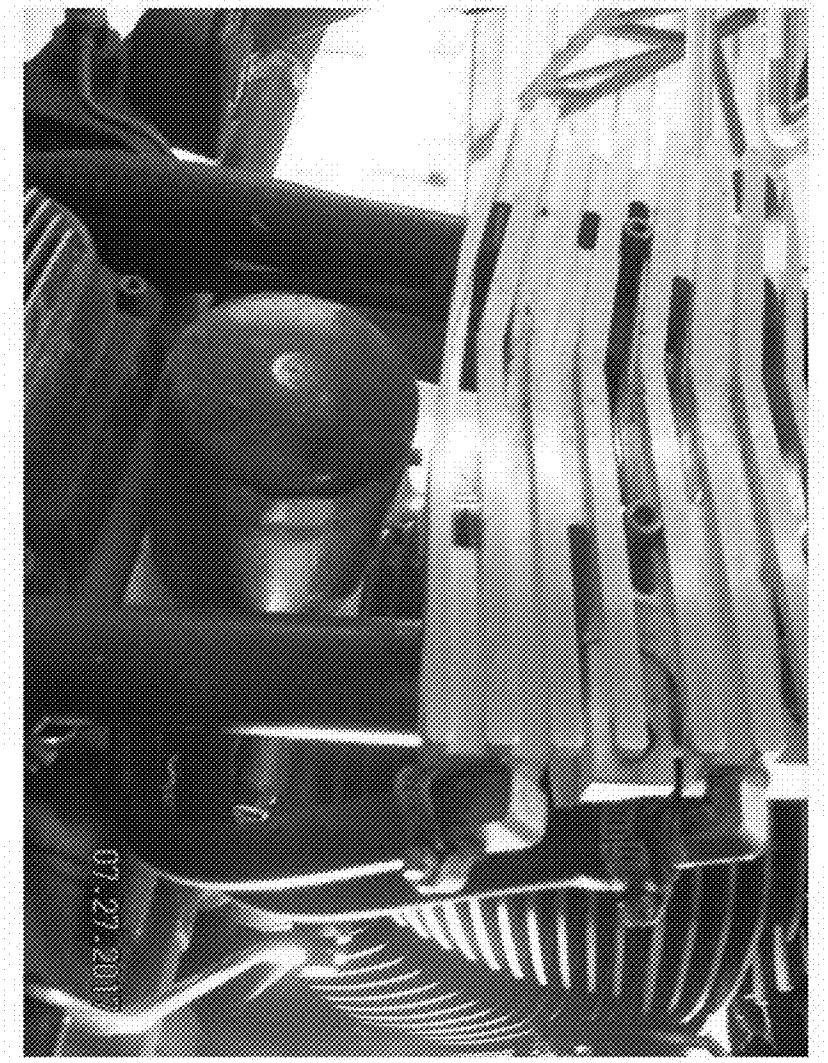

FIG. 70 is a photograph of a perspective view of an exemplary embodiment of a system 70000.

Figure 71:
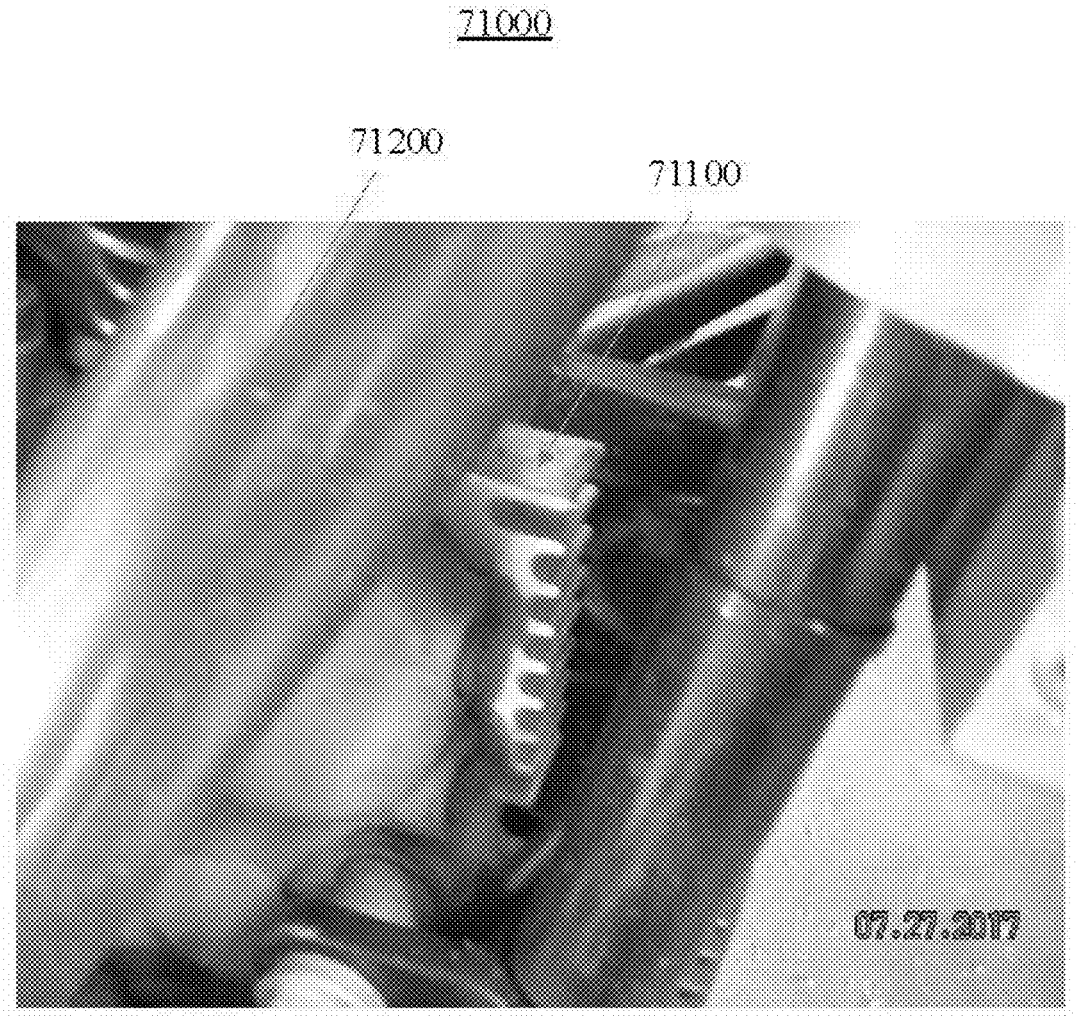

FIG. 71 is a photograph of a perspective view of an exemplary embodiment of a system 71000, which illustrates an exemplary engine adapter plate 71100 coupled to a motorcycle 71200.

Figure 72:
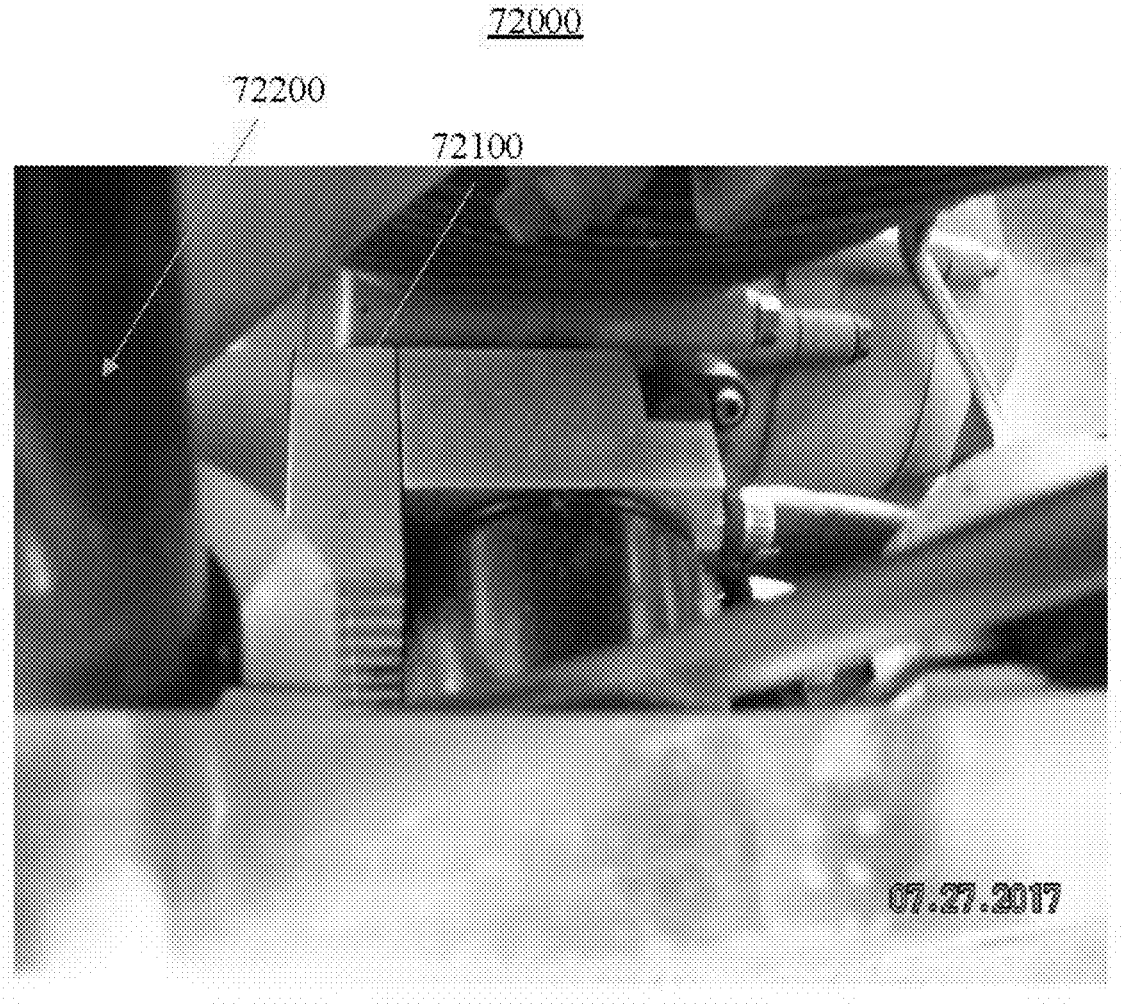

FIG. 72 is a photograph of a perspective view of an exemplary embodiment of a system 72000, which illustrates an exemplary engine adapter plate 72100 coupled to a motorcycle 72200.

Figure 73:
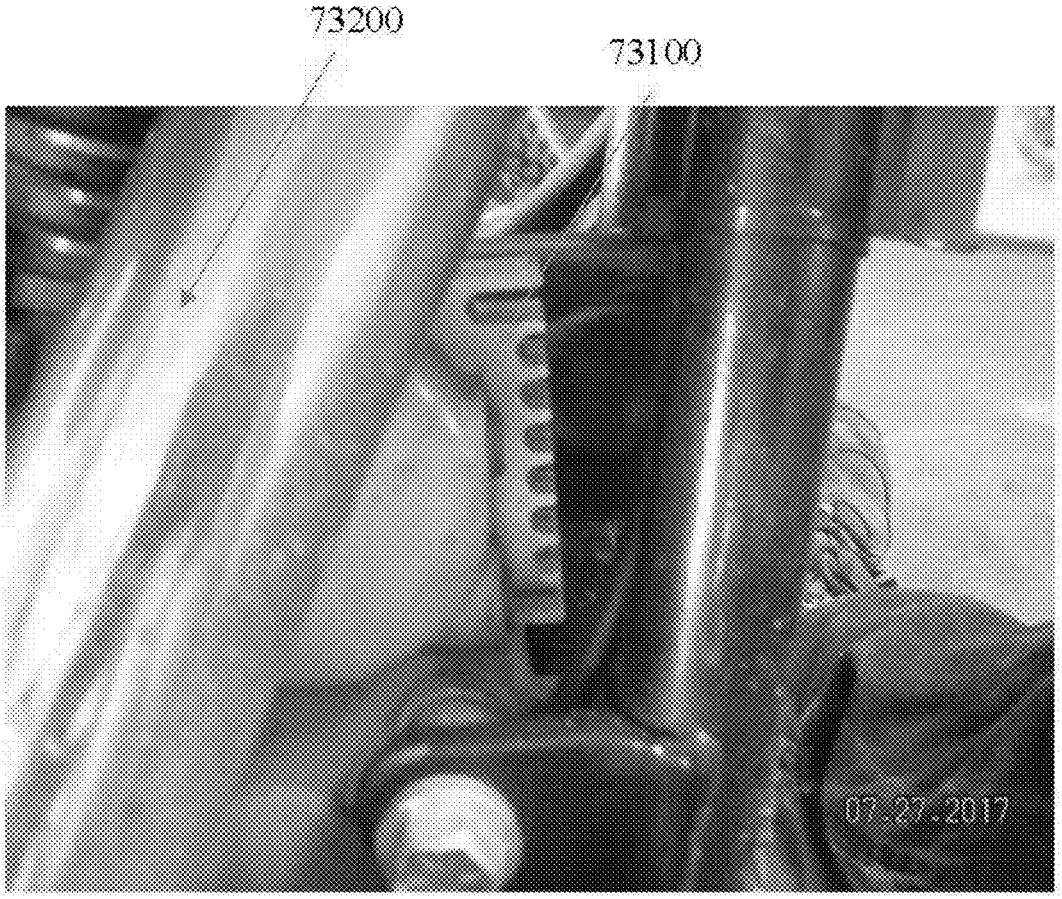

FIG. 73 is a photograph of a perspective view of an exemplary embodiment of a system 73000, which illustrates an exemplary engine adapter plate 73100 coupled to a motorcycle 73200.

Figure 74:
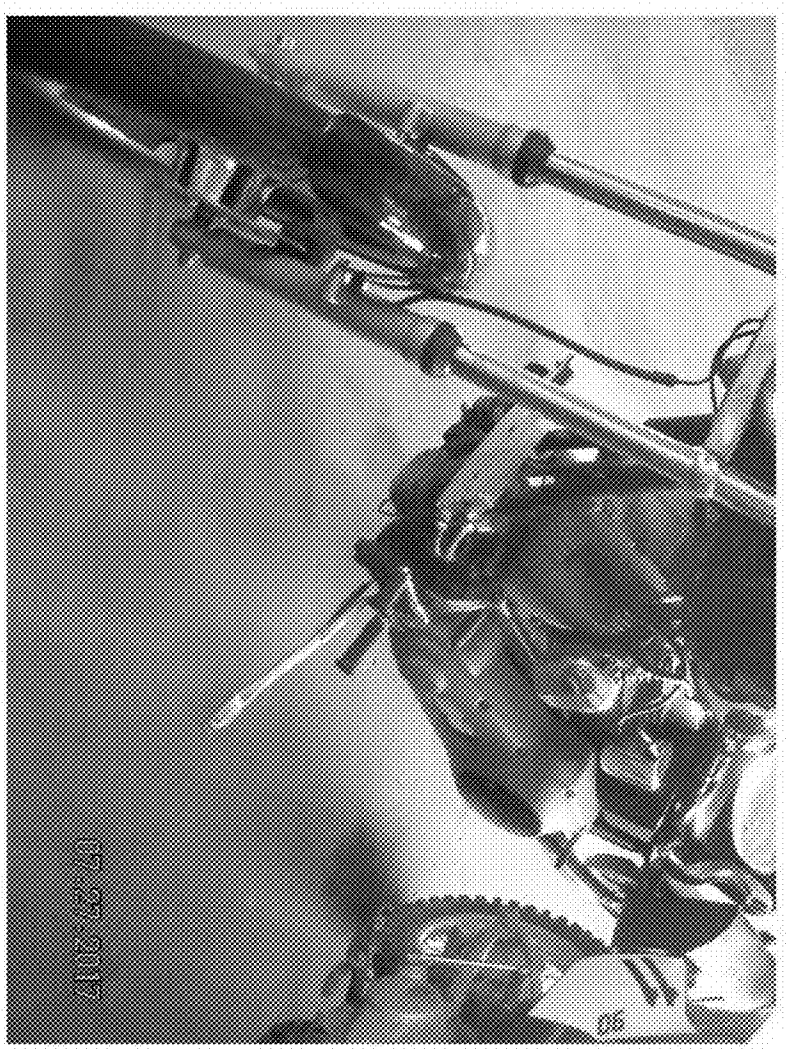

FIG. 74 is a photograph of a perspective view of an exemplary embodiment of a system 74000.

Figure 75:
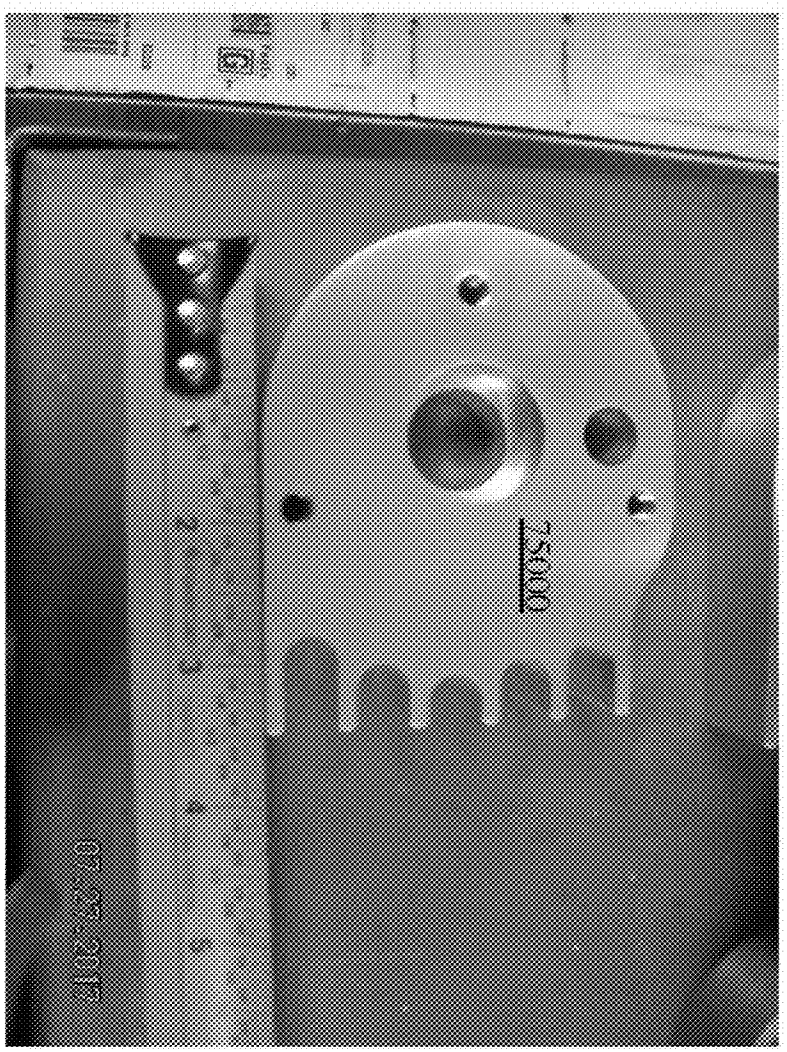

FIG. 75 is a photograph of a perspective view of an exemplary embodiment of a engine adapter plate 75000.

Figure 76:
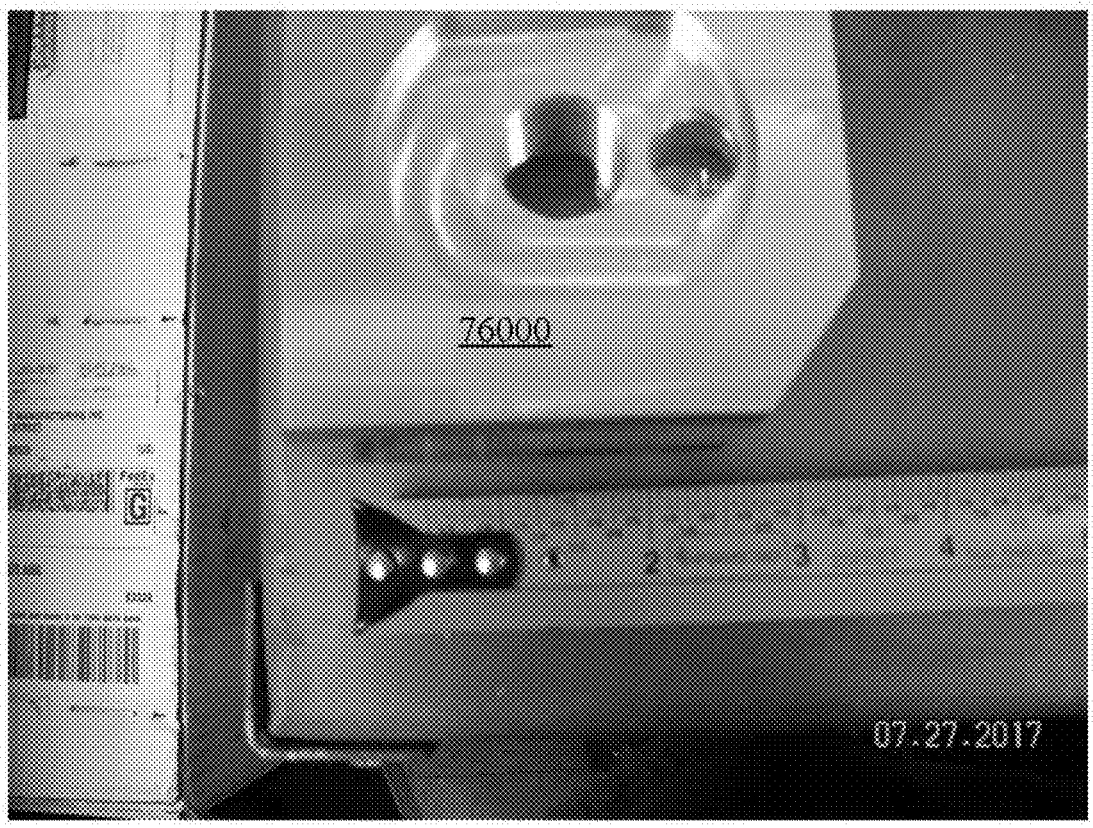

FIG. 76 is a photograph of a perspective view of an exemplary embodiment of a 90-degree oil filter adapter 76000.

Figure 77:
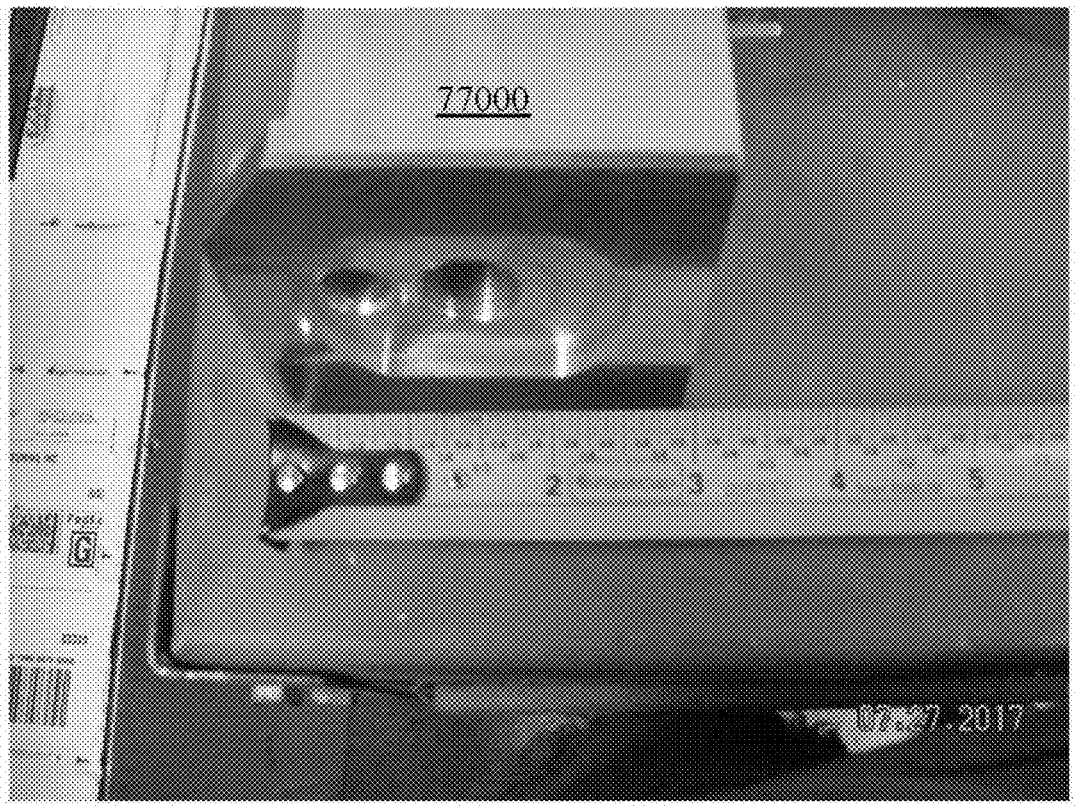

FIG. 77 is a photograph of a perspective view of an exemplary embodiment of a 90-degree oil filter adapter 77000.

Figure 78:
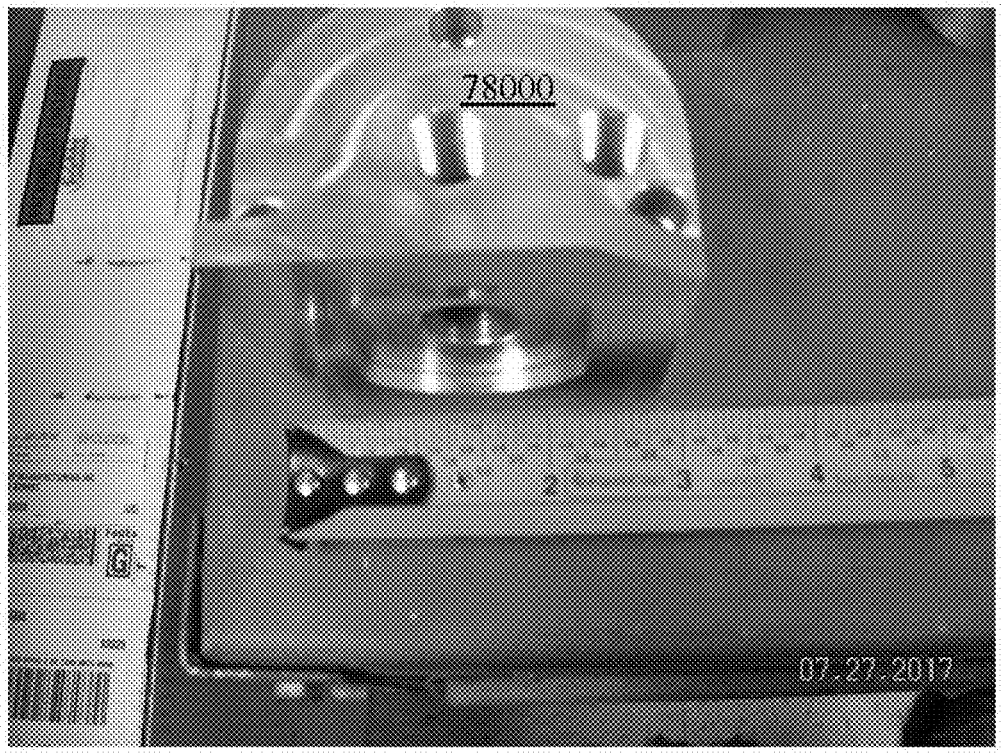

FIG. 78 is a photograph of a perspective view of an exemplary embodiment of a 90-degree oil filter adapter 78000.

Figure 79:
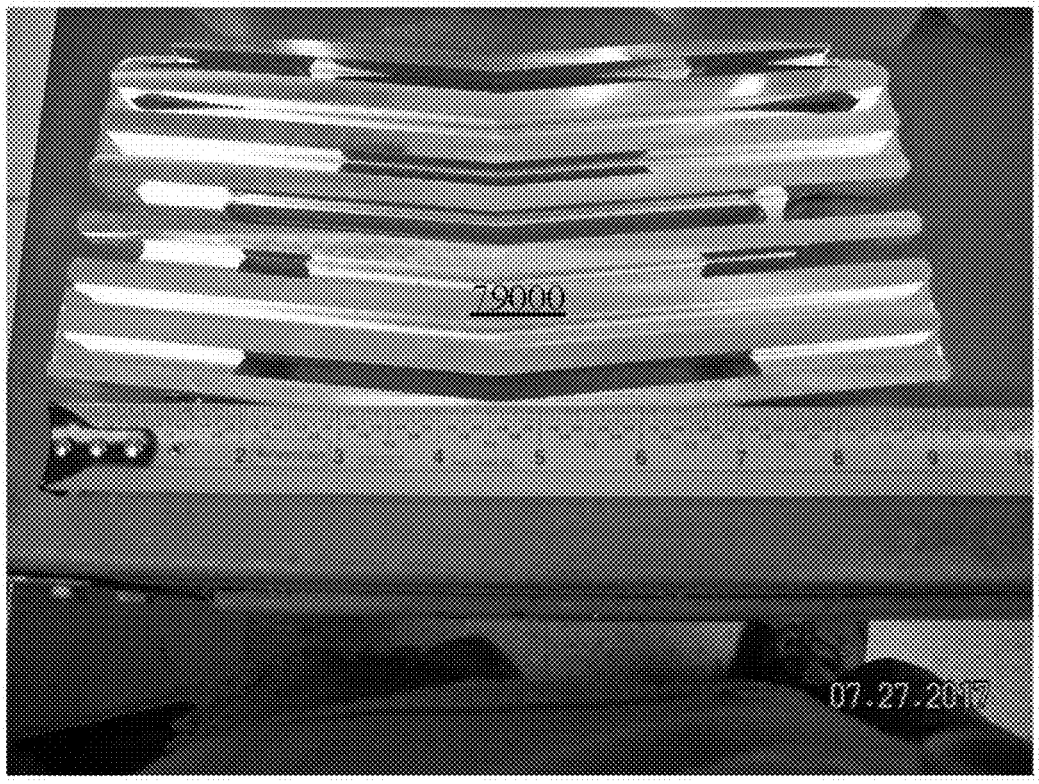

FIG. 79 is a photograph of a perspective view of an exemplary embodiment of a heat exchanger 79000.

Figure 80:
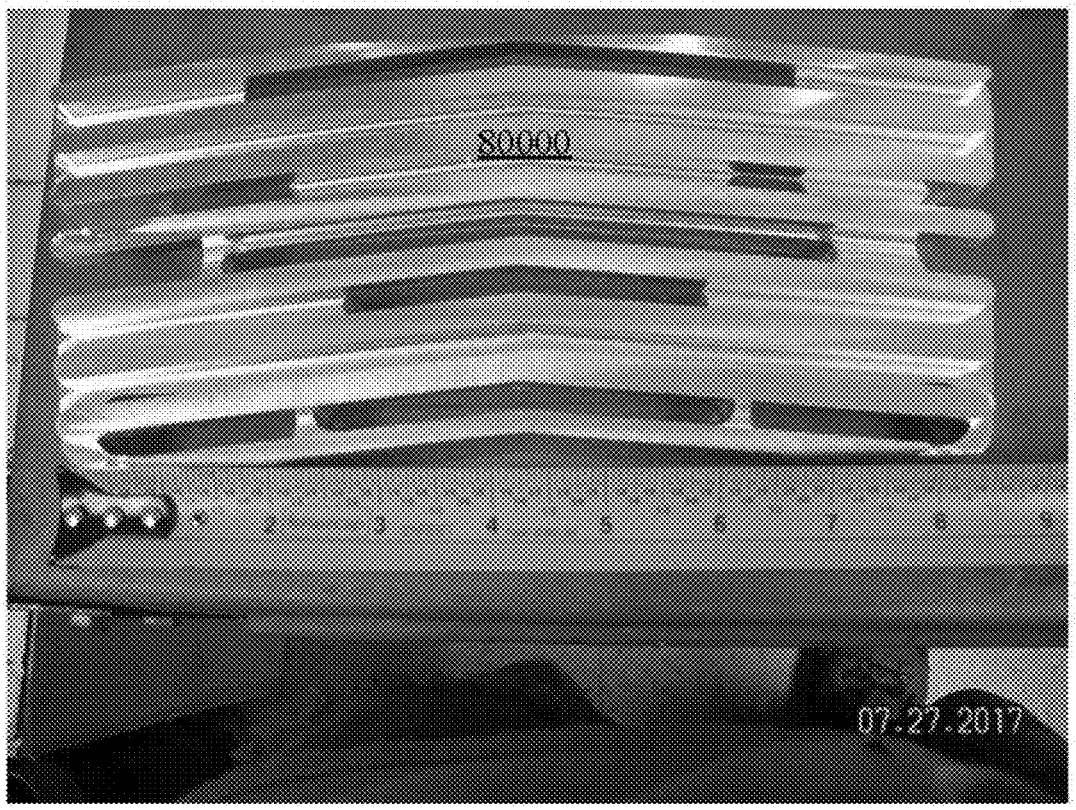

FIG. 80 is a photograph of a perspective view of an exemplary embodiment of a heat exchanger 80000.

Figure 81:
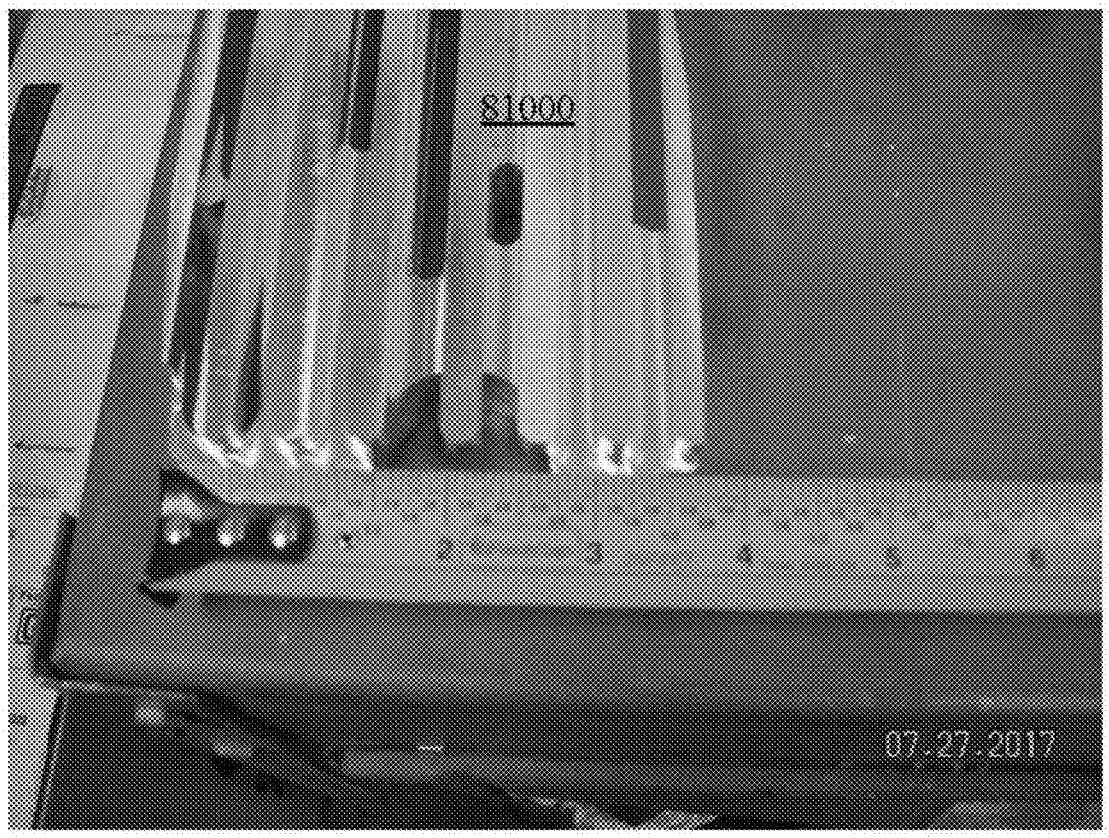

FIG. 81 is a photograph of a perspective view of an exemplary embodiment of a heat exchanger 81000.

Figure 82:
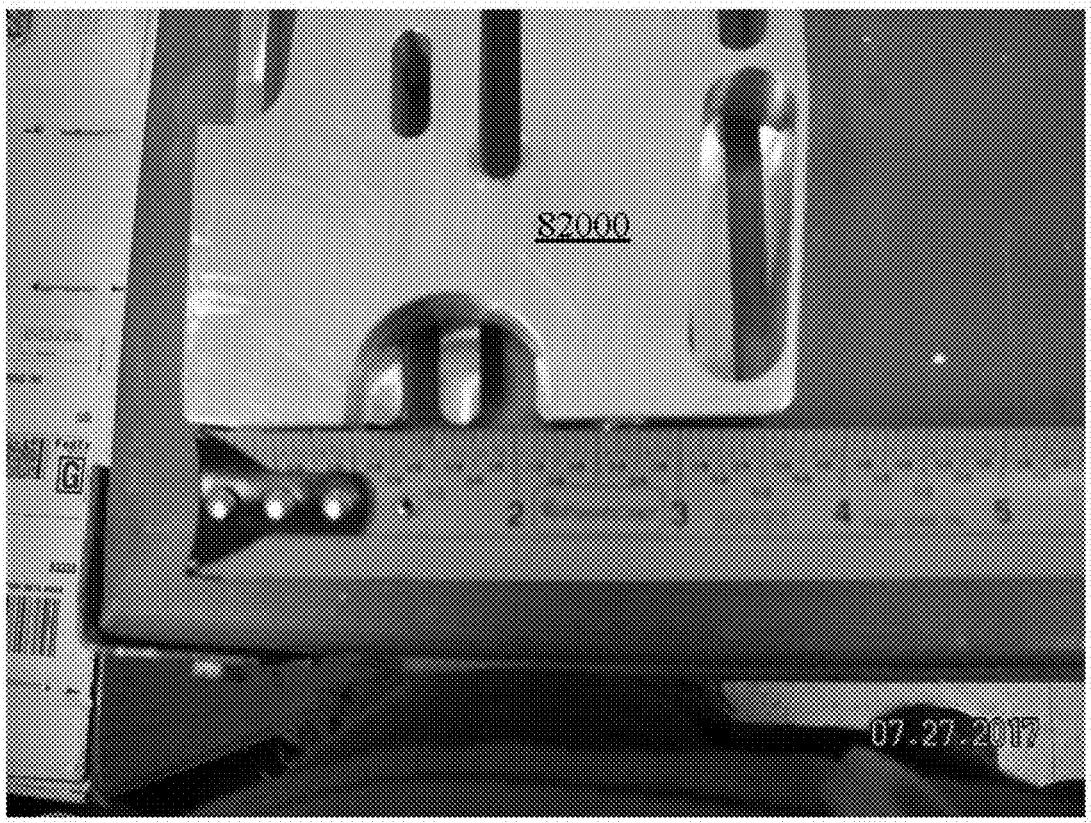

FIG. 82 is a photograph of a perspective view of an exemplary embodiment of a heat exchanger 82000.

Figure 83:
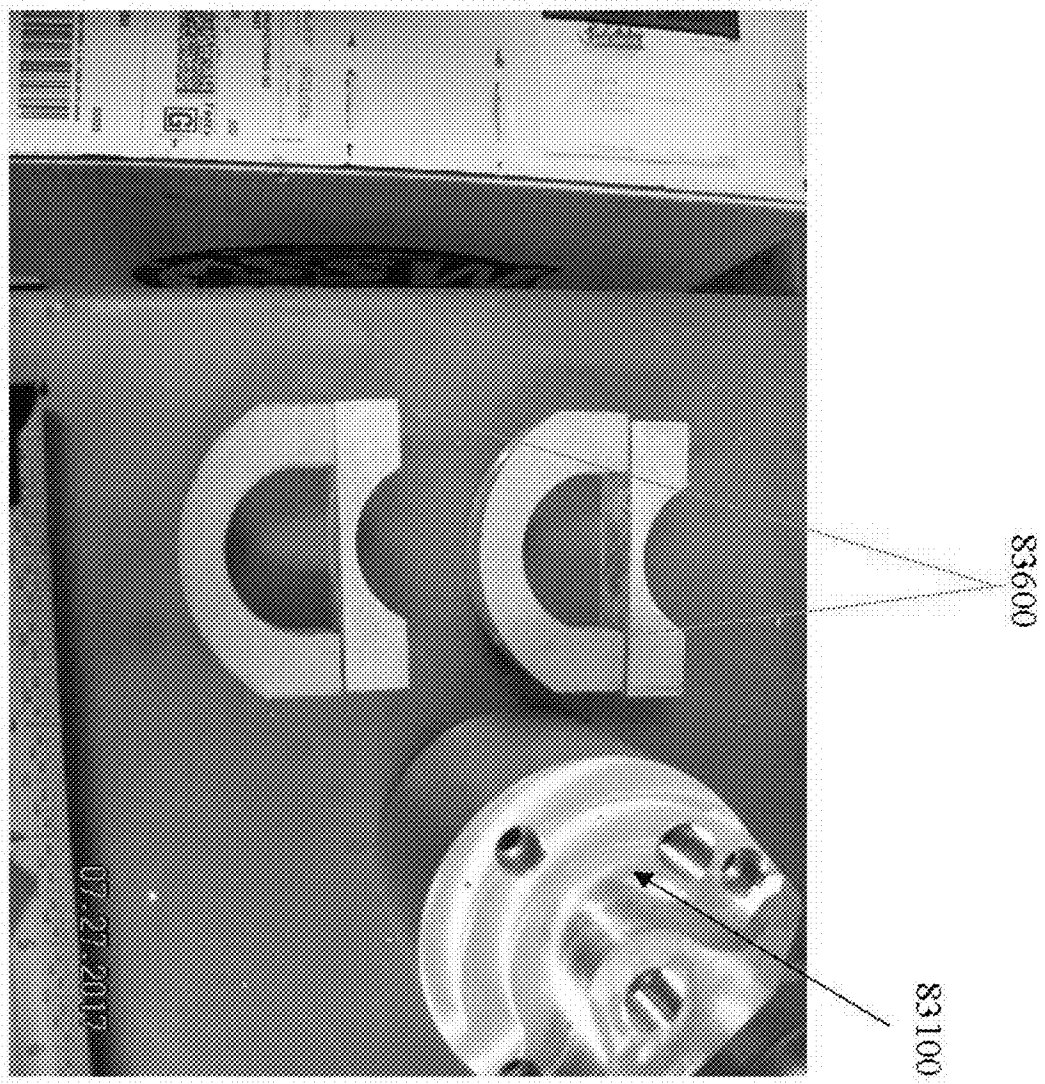

FIG. 83 is a photograph of a perspective view of an exemplary embodiment of a system 83000, which illustrates an exemplary 90-degree oil filter adapter 83100 and exemplary brackets constructed for mounting heat exchanger 83100 to a motorcycle.

Figure 84:
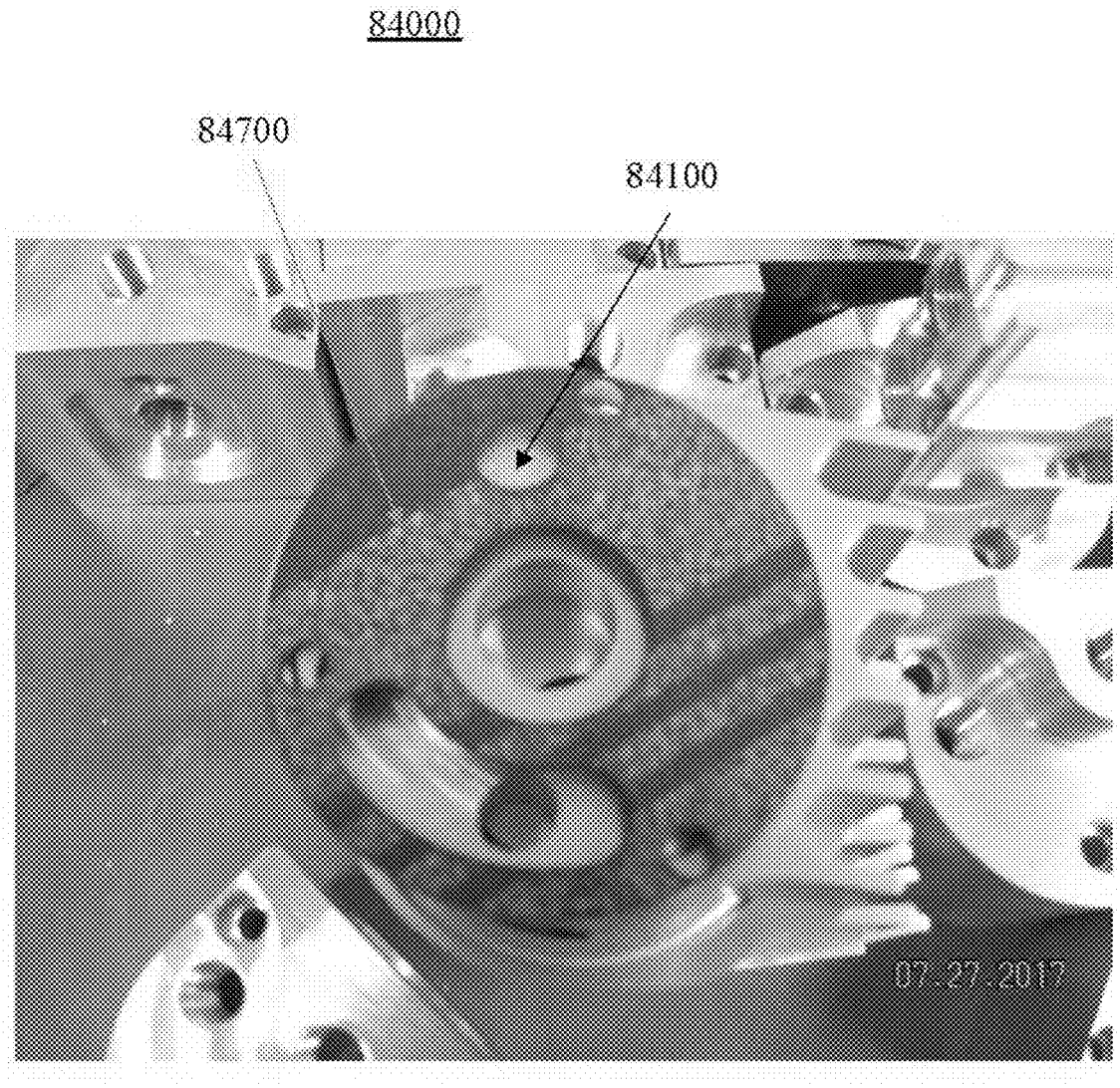

FIG. 84 is a photograph of a perspective view of an exemplary embodiment of a system 84000, which illustrates an exemplary engine adapter plate 84100 and an exemplary gasket 84700. Gasket 84700 is constructed for mounting engine adapter plate 84100 to a motorcycle and thereby seal against leakage.

Figure 85:
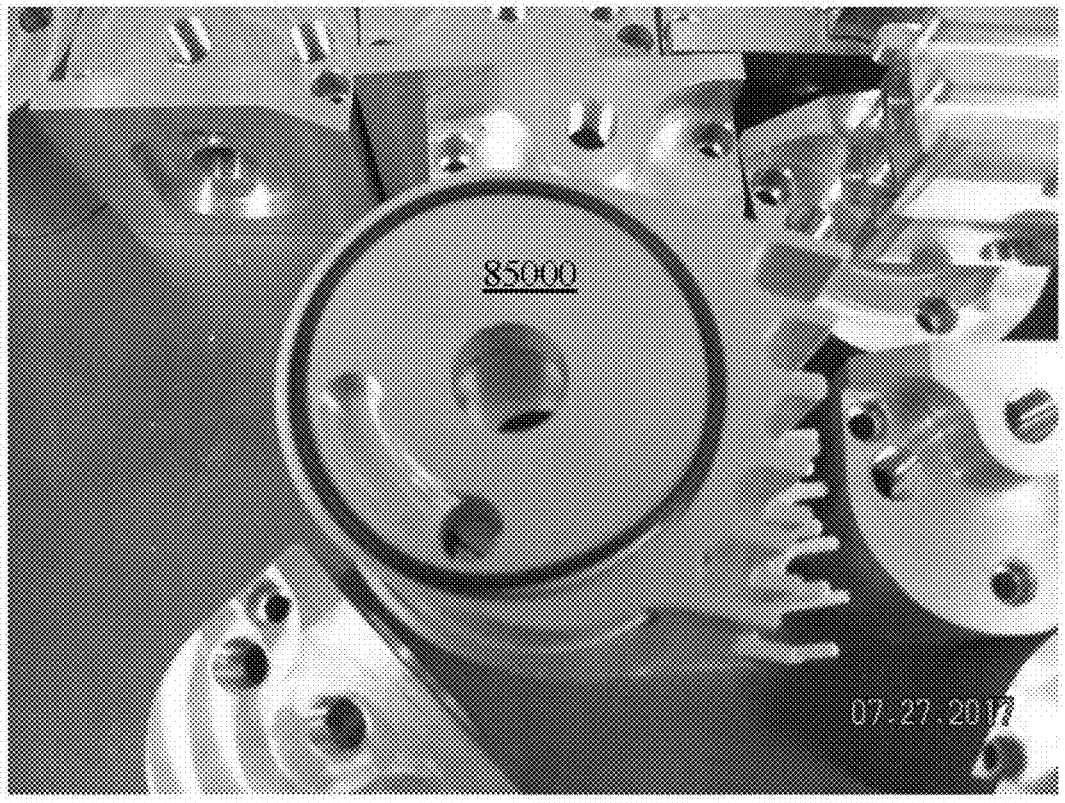

FIG. 85 is a photograph of a perspective view of an exemplary embodiment of a engine adapter plate 85000, which comprises an O-ring seal on an engine side.

Figure 86:
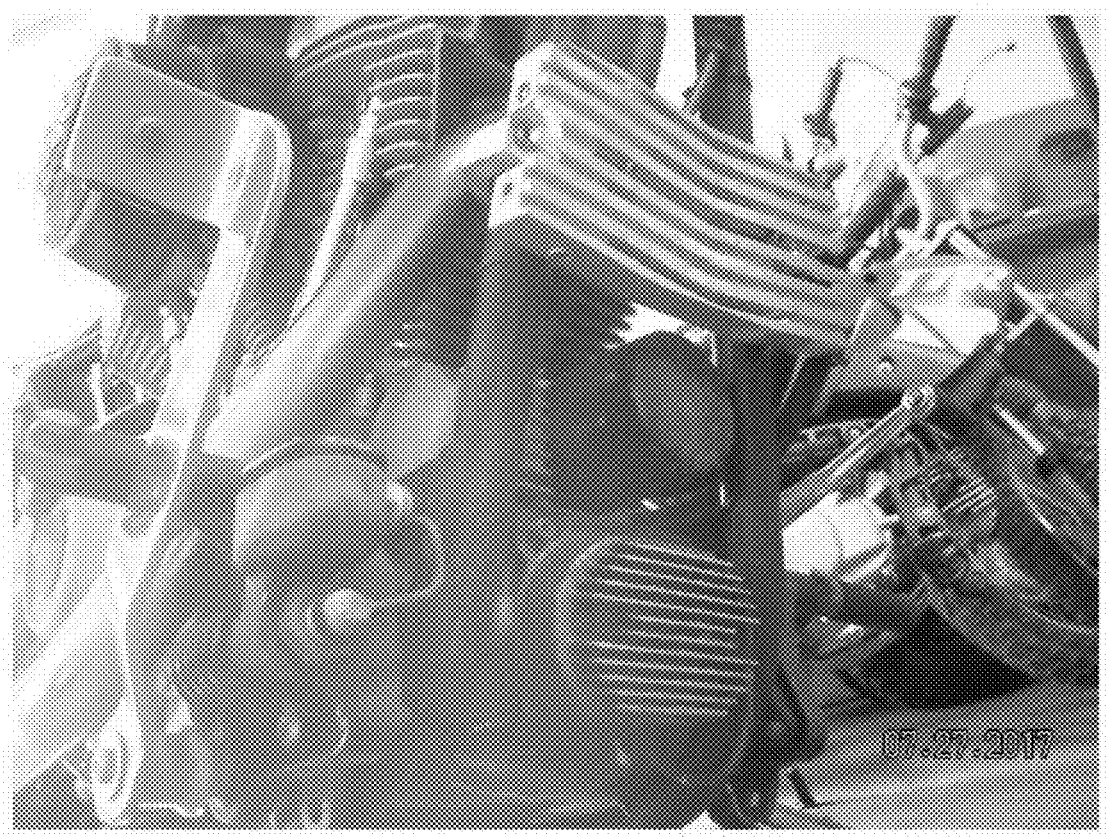

FIG. 86 is a photograph of a perspective view of an exemplary embodiment of a system 86000.

Figure 87:
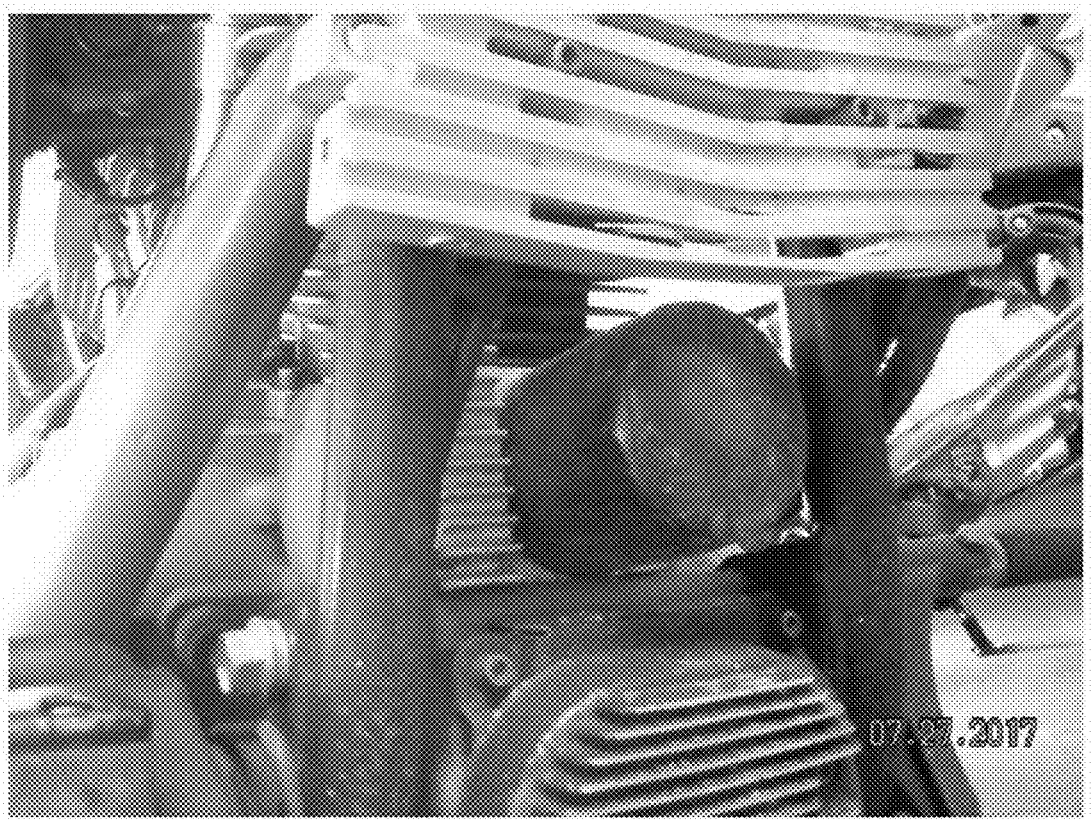

FIG. 87 is a photograph of a perspective view of an exemplary embodiment of a system 87000.

Figure 88:
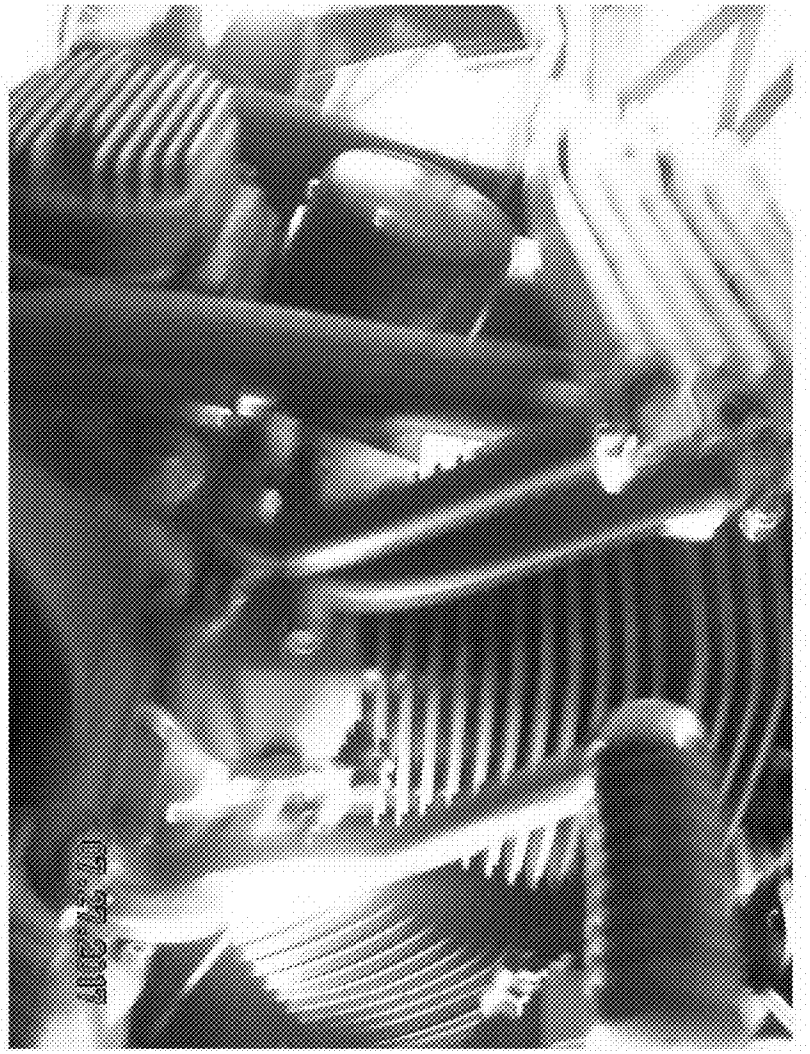

FIG. 88 is a photograph of a perspective view of an exemplary embodiment of a system 88000.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, step, and/or process or portion thereof adapter—a device used to effect operative compatibility between different parts of one or more pieces of an apparatus or system.

and/or—either in conjunction with or in alternative to.

aperture—an opening in something.

apparatus—an appliance or device for a particular purpose associate—to join, connect together, and/or relate.

bracket—a device coupleable to a surface that supports a component.

can—is capable of, in at least some embodiments.

chevron—having a v-shaped portion.

comprising—including but not limited to.

configure—to make suitable or fit for a specific use or situation.

connect—to join or fasten together.

constructed to—made to and/or designed to.

convert—to transform, adapt, and/or change.

coupleable—capable of being joined, connected, and/or linked together.

coupling—linking in some fashion.

define—to establish the outline, form, or structure of determine—to obtain, calculate, decide, deduce, and/or ascertain.

device—a machine, manufacture, and/or collection thereof.

engine—a machine constructed to convert one form of energy into mechanical energy.

fin—a rib on a heat exchanger that provides surface area that facilitates convective heat transfer.

generate—to create, produce, give rise to, and/or bring into existence.

heat energy—energy associated with the motion of atoms or molecules and capable of being transmitted through solid and fluid media by conduction, through fluid media by convection, and through an empty space and/or fluid by radiation.

heat exchanger—a device and/or system used to transfer heat energy between two or more substances.

install—to connect or set in position and prepare for use.

lower—to reduce in magnitude.

may—is allowed and/or permitted to, in at least some embodiments.

method—a process, procedure, and/or collection of related activities for accomplishing something.

motorcycle—a motor vehicle that operates on two wheels or three wheels.

oil filter—a device through which a petroleum lubricant is passed and, within which, the petroleum lubricant passes through a porous substance that is constructed to remove suspended impurities.

operating temperature—a temperature at which a motorcycle operates.

parallel—substantially a same distance apart and generally not converging or diverging.

planar—having a substantially flat surface.

plurality—the state of being plural and/or more than one.

port—an opening for the insertion and/or passage of a part and/or fluid.

portion—a part of a whole.

predetermined—established in advance.

provide—to furnish, supply, give, and/or make available.

receive—to get as a signal, take, acquire, and/or obtain.

repeatedly—again and again; repetitively.

set—a related plurality.

store—to place, hold, and/or retain.

substantially—to a great extent or degree.

support—to bear the weight of, especially from below.

surround—to substantially enclose on at least four sides.

system—a collection of mechanisms, devices, machines, articles of manufacture, processes, data, and/or instructions, the collection designed to perform one or more specific functions.

tube—an elongate member having a longitudinal axis and defining a longitudinal cross-section resembling any closed shape such as, for example, a circle, a non-circle such as an oval (which generally can include a shape that is substantially in the form of an obround, ellipse, limacon, cardioid, cartesian oval, and/or Cassini oval, etc.), and/or a polygon such as a triangle, rectangle, square, hexagon, the shape of the letter "D", the shape of the letter "P", etc. Thus, a right circular cylinder is one form of a tube, an elliptic cylinder is another form of a tube having an elliptical longitudinal cross-section, and a generalized cylinder is yet another form of a tube.

via—by way of and/or utilizing.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:

an engine adapter plate, the engine adapter plate directly coupleable to an engine of a motorcycle, the engine adapter plate having a plurality of protruding fins disposed on a single first surface of the engine adapter plate, the engine adapter plate comprising a curved second surface that extends from a first end of the single first surface to a second end of the single first surface, the engine adapter plate comprising an adapter face;

an oil filter adapter constructed to be installed between the engine adapter plate and an oil filter of the motorcycle, the oil filter adapter comprising a filter adapter face having a substantially rectangular cross section, the oil filter adapter directly coupleable to the engine adapter plate via coupling the adapter face of the engine adapter plate to the filter adapter face of the oil filter adapter, the oil filter adapter defining an oil inlet aperture and an oil outlet aperture, the oil filter adapter comprising a fitting that is coupleable to an oil filter, the oil filter adapter lacking any protruding heat exchange fins;

an oil filter coupleable to the oil filter adapter; and a heat exchanger, the heat exchanger defining an oil inlet port and an oil outlet port, wherein:

the oil inlet port is coupled to the oil outlet aperture of the oil filter adapter via a first tube;

the oil outlet port is coupled to the oil input aperture of the oil filter adapter via a second tube; and oil flows from the engine of the motorcycle through the engine adapter plate, through the oil filter adapter, and through the heat exchanger prior to return to the engine of the motorcycle.

2. The system of claim 1, wherein:

the heat exchanger comprises a plurality of fins that are constructed to exchange heat energy with air surrounding portions of the heat exchanger.

3. The system of claim 1, wherein:

the heat exchanger comprises a plurality of fins that are constructed to exchange heat energy with air surrounding portions of the heat exchanger, wherein each of the plurality of fins comprises a substantially planar portion, wherein each substantially planar portion of each of the plurality of fins is substantially parallel to a substantially planar portion of an adjacent fin of the plurality of fins.

4. The system of claim 1, wherein:

the heat exchanger comprises a plurality of fins that are constructed to exchange heat energy with air surrounding portions of the heat exchanger, wherein each of the plurality of fins comprises portion having a chevron shape.

5. The system of claim 1, wherein:

the heat exchanger is coupled to the motorcycle via a bracket.

6. The system of claim 1, wherein:

each of the plurality of protruding fins has a length that is less than five times its height.

* * * * *